US005545977A

United States Patent [19]

Yamada et al.

[11] Patent Number: 5,545,977

[45] Date of Patent: Aug. 13, 1996

[54] REFERENCE POTENTIAL GENERATING CIRCUIT AND SEMICONDUCTOR INTEGRATED CIRCUIT ARRANGEMENT USING THE SAME

[75] Inventors: Toshio Yamada; Akinori Shibayama; Shunichi Iwanari, all of Osaka; Atsushi Fujiwara, Kyoto, all of Japan

[73] Assignee: Matsushita Electric Industrial Co., Ltd., Osaka, Japan

[21] Appl. No.: 74,561

[22] Filed: Jun. 9, 1993

[30] Foreign Application Priority Data

Jun. 10, 1992 [JP] Japan ..... 4-150285
May 20, 1993 [JP] Japan ..... 5-118221

[51] Int. Cl.[6] ..... G05F 3/22

[52] U.S. Cl. ..... 323/313; 323/314; 323/907

[58] Field of Search ..... 323/312, 313, 323/351, 314, 907; 327/530, 538, 542, 543

[56] References Cited

U.S. PATENT DOCUMENTS

| | | | |
|---|---|---|---|
| 4,295,089 | 10/1981 | Cooperman | 323/351 |
| 4,313,083 | 1/1982 | Gilbert et al. | 323/350 |
| 5,173,656 | 12/1992 | Seevinck et al. | 323/314 |
| 5,239,256 | 8/1993 | Yoshida | 323/313 |
| 5,384,740 | 1/1995 | Etoh et al. | 365/189 |

*Primary Examiner*—Peter S. Wong
*Assistant Examiner*—Adolf Berhane
*Attorney, Agent, or Firm*—McDermott, Will & Emery

[57] ABSTRACT

In a circuit, a resistance element is interposed between a positive power supply line (external power supply voltage level VCC) and an output node. To feedback an output potential, there is disposed an N-type MOSFET of which gate is connected to the output node and of which source is connected to the earth line (earth potential VSS) in the circuit. Another three N-type MOSFETs which are so connected in series to one another as to form a MOS diode, are interposed between the drain of the feedback N-type MOSFET and the output node. The earth line also serves as a reference potential line for the potential of the output node. Variations of the threshold voltages of the MOSFETs due to temperature variations are compensated. This restrains the output potential from varying.

57 Claims, 37 Drawing Sheets

REFERENCE POTENTIAL GENERATING CIRCUIT AND SEMICONDUCTOR INTEGRATED CIRCUIT ARRANGEMENT USING THE SAME

BACKGROUND OF THE INVENTION

The present invention relates to a reference potential generating circuit and a semiconductor integrated circuit arrangement or the like using the same.

Inside of a dynamic random access memory (DRAM) as an example of a semiconductor memory, there are required, in order to assure reliability and a decrease in electric current consumed therein, a variety of voltage levels such as an internal dropped voltage level Vint, a word line increased voltage level VPP, a bit line precharge level Vpr, a substrate bias level VBB and the like, in addition to an externally supplied power voltage level VCC. In a 16M-bit DRAM in which, for example, the VCC is equal to 5 V (with the earth potential VSS=0 V serving as a reference), Vint=3.3 V, VPP=4.5 V, Vpr=1.65 V and VBB=−2 V are generally used.

To obtain such voltage levels, there has been conventionally used a power supply voltage converting circuit using MOSFETs (field-effect-type MOS transistors) as disclosed in Japanese Patent Laid-Open Publication No. 63-244217. However, such a power supply voltage converting circuit presents the problem that, even though variations of an output voltage thereof due to variations of the external power supply voltage level VCC can be restrained, the output voltage varies if the threshold voltages of the MOSFETs vary due to variations of the temperature thereof.

In a semiconductor integrated circuit such as a DRAM or the like, when synchronously operating a plurality of circuit blocks, there are used a variety of delay circuits for adjusting the input/output timings in these circuit blocks. This will be more specifically discussed in the following with a DRAM taken as an examle. In the peripheral circuit block for example, there are disposed a row decoder for selecting memory cells through a word line, and a timing circuit for adjusting the timing at which the sensing amplifier is so activated as to amplify a small potential read out, to a bit line concerned, from one of the memory cells selected by the row decoder. The timing circuit causes activation of the sensing amplifier to be delayed with respect to the selection of a word line by the row decoder. The timing circuit can be formed by a normal inverter chain having a plurality of inverter stages, each inverter comprising two MOSFETs only. In the timing circuit having such a simple arrangement, the delay time therein presents a great temperature dependency.

To reduce the delay time in temperature dependency, there has been proposed a CR delay circuit utilizing time constant to be determined by a resistance element and a capacitor element. Examples of such a CR delay circuit include a CR delay circuit discussed in Japanese Patent Laid-Open Publication No. 63-312715, and a CR delay circuit discussed in "A New CR-Delay Circuit Technology for High-Density and High-Speed DRAMs", IEEE J. Solid-State Circuits, vol. 24, pp. 905–910, 1989 by Yohji WATANABE et al.

FIG. 40 shows an example of a semiconductor integrated circuit arrangement using conventional CR delay circuits. In the semiconductor integrated circuit arrangement in FIG. 40, a peripheral circuit block 302 has a plurality of stages of CR delay circuits 301. Each of the CR delay circuits 301 comprises a comparator circuit 303, a P-type MOSFET 304, an N-type MOSFET 305, an input signal P1, an output signal P2, a charging resistance element R1, voltage-dividing resistance elements R2, R3, and a capacitor element C. From a constant voltage generating circuit 306, a voltage VCC obtained by stabilizing an externally supplied power voltage, is supplied, as an internal power supply voltage, to each of the CR delay circuits 301.

According to the arrangement above-mentioned, the delay time in each of the CR delay circuits 301 depends only constants to be determined by the geometrical dimensions of the resistance elements R1 to R3 and of the capacitor element C. This reduces the delay time in temperature dependency. However, in a semiconductor integrated circuit arrangement, when the conventional CR delay circuits 301 are used in the peripheral circuit block at all parts thereof in which it is required to delay the output signals, the peripheral circuit block is disadvantageously increased in layout area as compared with an arrangement using delay circuits formed by normal inverter chains.

DISCLOSURE OF THE INVENTION

It is an object of the present invention to provide (i) reference potential generating circuits each presenting a small temperature dependency, (ii) constant voltage generating circuit arrangements, voltage level detecting circuit arrangements and temperature detecting circuit arrangements each of which uses any of the reference potential generating circuits above-mentioned, and (iii) useful power supply circuit arrangements and semiconductor integrated circuit arrangements each of which uses any of the arrangements above-mentioned.

To achieve the object above-mentioned, a reference potential generating circuit according to the present invention has a feedback transistor for practically effectively compensating variations of the threshold voltages of MOS transistors due to variations of the tempertures thereof. More specifically, the reference potential generating circuit is arranged such that a predetermined difference in potential is generated between an output node thereof and a first voltage supply line thereof, serving as a reference potential line, out of first and second voltage supply lines thereof across which a DC voltage is applied, so that a predetermined potential is generated at the output node, and comprises: resistance means interposed between the second voltage supply line and the output node; feedback means having a MOS transistor of which gate is connected to the output node and of which source is connected to the first voltage supply line; and diode means having a plurality of another MOS transistors which are connected in series to one another and which are interposed between the drain of the MOS transistor of the feedback means and the output node.

In the reference potential generating circuit above-mentioned, the drain of the MOS transistor forming the feedback means is called an internal node. A difference in potential between the internal node and the output node is substantially equal to the total of the threshold voltages of the plurality of MOS transistors forming the diode means. If the threshold voltages are increased due to a temperature rise, the difference in potential between the internal node and the output node is increased. Accordingly, there is increased a difference in potential between the source and gate of the MOS transistor forming the feedback means. This results in an decrease in the channel resistance of the feedback MOS transistor. This causes the internal node to be lowered in potential. As a result, the potential of the output node is maintained substantially at the level obtained before the threshold voltages vary. More specifically, variations of the threshold voltages due to temperature variations are practically effectively compensated by the feedback means to lower the potential of the output node in temperature dependency.

A first constant voltage generating circuit arrangement according to the present invention is adapted to hold the potential of an output line thereof at a predetermined value, and comprises: a reference potential generating circuit for generating a predetermined difference in potential between an output node thereof and a first voltage supply line thereof, serving as a reference potential line, out of first and second voltage supply lines thereof across which a DC voltage is applied; a comparator circuit for comparing the potential of the output node of the reference potential generating circuit with the potential of the output line; and a driver circuit for driving the output line under control by an output of the comparator circuit. In this circuit arrangement, the reference potential generating circuit has an arrangement identical with that of the reference potential generating circuit according to the present invention above-mentioned. Since the constant voltage generating circuit arrangement utilizes the reference potential generating circuit above-mentioned, the output-line potential can be reduced in temperature dependency.

A second constant voltage generating circuit arrangement according to the present invention comprises: a first reference potential generating circuit for generating a predetermined difference in potential between a first reference potential line thereof and a first node thereof; a second reference potential generating circuit for generating a predetermined difference in potential between a second reference potential line thereof and a second node thereof; a comparator circuit for comparing the potential of the first node with the potential of the second node; and a driver circuit for driving the output line under control by an output of the comparator circuit; the output line being connected to the second reference potential generating circuit such that the potential of the output line is applied to the second reference potential line. In this second constant voltage generating circuit arrangement, the second reference potential generating circuit serves as a voltage shift circuit to shift the operational point of the comparator circuit to an optimum position. This assures a normal operation of the comparator circuit at all times. When the arrangement of the reference potential generating circuit according to the present invention mentioned earlier is utilized, the potential of the output line can be reduced in temperature dependency.

A voltage level detecting circuit arrangement according to the present invention is adapted to judge the magnitude relation between the reference voltage level of a first line thereof and the voltage level to be measured of a second line thereof, and comprises: a first reference potential generating circuit for generating a predetermined difference in potential between the first line and a first node thereof; a second reference potential generating circuit for generating a predetermined difference in potential between the second line and a second node thereof; and a comparator circuit for comparing the potential of the first node with the potential of the second node. According to this voltage level detecting circuit arrangement, a desired voltage level can be detected according to a difference between (i) the difference in potential between the first line and the first node generated by the first reference potential generating circuit and (ii) the difference in potential between the second line and the second node generated by the second reference potential generating circuit. Accordingly, even though each of the output voltages of the first and second reference potential generating circuits presents temperature dependency, there is no temperature dependency in the output potential of the constant voltage generating circuit arrangement.

A temperature detecting circuit arrangement according to the present invention is adapted to judge whether or not ambient temperature has reached a predetermined temperature, and comprises: a first reference potential generating circuit for generating, between a first reference potential line thereof and a first node thereof, a difference in potential presenting a small temperature dependency due to reduction in the influence of variations of the threshold voltages of MOS transistors; a second reference potential generating circuit for generating, between a second reference potential line thereof and a second node thereof, a difference in potential presenting a great temperature dependency resulting from variations of the threshold voltages of MOS transistors; and a comparator circuit for comparing the potential of the first node with the potential of the second node. In this temperature detecting circuit arrangement, a desired temperature can be detected according to a difference in temperature dependency between the first and second reference potential generating circuits. The first reference potential generating circuit presenting a small temperature dependency may be formed by utilizing the reference potential generating circuit according to the present invention mentioned earlier, as it is, and the second reference potential generating circuit presenting a great temperature dependency may be formed by utilizing the reference potential generating circuit according to the present invention mentioned earlier, without the feedback means disposed.

A first power supply circuit arrangement according to the present invention is adapted to increase the potential of an output line thereof according to a temperature rise, this potential serving as a stabilized output voltage to be used as a power supply of each of logic circuits, thus maintaining a delay time in each of the logic circuits constant, and comprises: a temperature detecting circuit for detecting temperature; and a constant voltage generating circuit for changing the potential of the output line according to temperature detected by the temperature detecting circuit, thereby to increase the potential of the output line according to a temperature rise. When the arrangement of the reference potential generating circuit according to the present invention mentioned earlier, is utilized for the constant voltage generating circuit, the output-line potential of the constant voltage generating circuit can be reduced in temperature dependency.

A second power supply circuit arrangement according to the present invention comprises: a first delay circuit in which the delay time of a pulse signal presents a small temperature dependency; a second delay circuit having, as a temperature monitor, a logic circuit part set such that the delay time of a pulse signal at a reference temperature is identical with the delay time in the first delay circuit; a delay time difference detecting circuit for detecting a difference in delay time between the first and second delay circuits; and a constant voltage generating circuit for changing the potential of the output line according to an output of the delay time difference detecting circuit such that the potential of the output line is increased when the delay time in the second delay circuit is greater than that of the first delay circuit, and that the potential of the output line is decreased when the delay time in the second delay circuit is smaller than that in the first delay circuit; a stabilized output voltage supplied from the constant voltage generating circuit to the output line being supplied, as a power supply, to the second delay circuit. According to this second power supply circuit arrangement, the output-line potential serving as a stabilized output voltage is controlled according to a difference in delay time between the first and second delay circuits, so that the delay time in each of the logic circuits using the stabilized output voltage as a power supply, can be maintained constant. When the arrangement of the reference potential generating circuit according to the present invention mentioned earlier, is utilized for the constant voltage generating circuit, the output-line potential of the constant voltage generating circuit can be reduced in temperature dependency.

A first semiconductor integrated circuit arrangement according to the present invention comprises a peripheral circuit block and a delay time correcting circuit block for correcting a delay time in the peripheral circuit block, the delay time correcting circuit block comprising: a first delay circuit for delaying a pulse signal; a second delay circuit having a logic circuit part for delaying a pulse signal identical with a pulse signal supplied to the first delay circuit, the logic circuit part presenting a delay-time temperature dependency which is identical with that of the peripheral circuit block and which is different from that of the first delay circuit, the second delay circuit being arranged such that the delay time of the pulse signal at a reference temperature is equal to that in the first delay circuit; a constant voltage generating circuit for holding, at a fixed value, the potential of an output line thereof to be used as a line for supplying a stabilized power supply voltage to each of the second delay circuit and the peripheral circuit block, the fixed value being variable according to control signals; a delay time difference detecting circuit adapted to supply an accelerating signal when the delay time in the second delay circuit is greater than that in the first delay circuit, and to supply a restraining signal when the delay time in the second delay circuit is smaller than that in the first delay circuit, the accelerating and restraining signals being supplied as control signals according to output signals of the first and second delay circuits; and a control circuit adapted to supply control signals to the constant voltage generating circuit such that the potential of the output line is increased each time the control circuit receives the accelerating signal from the delay time difference detecting circuit, and that the potential of the output line is decreased each time the control circuit receives the restraining signal from delay time difference detecting circuit.

According to the semiconductor integrated circuit arrangement above-mentioned, the output-line potential of the constant voltage generating circuit is so controlled as to eliminate a difference in delay time between the first and second delay circuits, thus correcting the delay time in the peripheral circuit block including delay circuits and the like to each of which the output-line voltage is supplied as a power supply. More specifically, even though the peripheral circuit block uses delay circuits formed by normal inverter chains, the temperature dependency of the delay time in the peripheral circuit block is corrected. Accordingly, the peripheral circuit block can be reduced in layout area as compared with an arrangement using the conventional CR delay circuits mentioned earlier. A difference in delay time between the first and second delay circuits is converted into a difference in pulse width, and the difference in pulse width is converted into the number of logical signals having a predetermined logical level. According to the number of the logical signals, the output-line potential of the constant voltage generating circuit is changed. Alternatively, when there are used an output signal of the first delay circuit and first and second output signals which are supplied from the second delay circuit and which are different in phases from each other, the presence or absence of a difference in delay time, can be detected with a certain range of dead zone. This prevents the output voltage of the constant voltage generating circuit from fluctuating. Further, when there are used the amplifying function of a flip-flop and a monostable multivibrator, the presence or absence of a difference in delay time can be detected with high sensitivity.

In a semiconductor memory such as a DRAM or the like in which the peripheral circuit block has a row decoder for selecting memory cells through word lines, the output line of the constant voltage generating circuit above-mentioned may be used as a power supply voltage supply line for each of the second delay circuit and the row decoder. According to this arrangement, the delay characteristics of the row decoder are conformed to those of the word lines. The delay characteristics of the word lines present a CR-type small temperature dependency to be determined by word-line distribution constant. Originally, the delay characteristics of the row decoder present a transistor-type great temperature dependency. Accordingly, the power supply voltage of the row decoder is controlled according to temperature variations, thereby to change the delay characteristics of the row decoder into delay characteristics presenting a CR-type small temperature dependency. There is thus provided a semiconductor memory assuring high-speed access with reduction in timing margin as to the activation of a sensing amplifier.

In a second semiconductor integrated circuit arrangement according to the present invention, the voltage level detecting circuit arrangement of the present invention mentioned earlier is used for controlling a substrate potential generating circuit in the semiconductor integrated circuit arrangement. This reduces the potential of a substrate in temperature dependency.

In a third semiconductor integrated circuit arrangement according to the present invention, the voltage level detecting circuit arrangement of the present invention mentioned earlier is used for controlling a specific potential generating circuit to generate a specific potential to be applied to a specific circuit block on a semiconductor substrate. This reduces the specific potential in temperature dependency.

A fourth semiconductor integrated circuit arrangement according to the present invention is adapted to increase the potential of an output line according to a temperature rise, this potential serving as a stabilized output voltage to be used, as a common power supply, in each of a plurality of circuit blocks formed by logic circuits on a semiconductor substrate, thereby to maintain a delay time in each of the plurality of circuit blocks constant, and comprises: a first delay circuit in which the delay time of a pulse signal presents a small temperature dependency; a second delay circuit having a logic circuit part, serving as a temperature monitor, set such that the delay time of a pulse signal at a reference temperature is equal to that in the first delay circuit; a delay time difference detecting circuit adapted to supply an accelerating signal when the delay time in the second delay circuit is greater than that in the first delay circuit, and to supply a restraining signal when the delay time in the second delay circuit is smaller than that in the first delay circuit, the accelerating and restraining signals being supplied as control signals according to a difference in delay time between the first and second delay circuits; and a constant voltage generating circuit adapted to increase the potential of an output line thereof each time the constant voltage generating circuit receives the accelerating signal from the delay time difference detecting circuit, and to decrease the potential of the output line each time the constant voltage generating circuit receives the restraining signal from the delay time difference detecting circuit; a stabilized output voltage on the output line in the constant voltage generating circuit, being supplied, as a power supply, to the second delay circuit.

According to the fourth semiconductor integrated circuit arrangement, the output-line potential serving as the stabilized output voltage is controlled according to a difference in delay time between the first and second delay circuits, thus maintaining constant the delay time in each of a plurality of circuit blocks each using, as a power supply, the stabilized output voltage. Thus, a highly reliable semiconductor integrated circuit arrangement can be provided. When the arrangement of the reference potential generating circuit according to the present invention mentioned earlier, is utilized for the constant voltage generating circuit, the output-line potential is reduced in temperature dependency. A plurality of constant voltage generating circuits each having the arrangement of the constant voltage generating circuit above-mentioned, may be disposed as distributed on a semiconductor substrate in the vicinity of a plurality of circuit blocks thereof. In such an arrangement, output currents of the constant voltage generating circuits can be reduced. Further, an output of each of the plurality of constant voltage generating circuits can be centrally controlled only by two signal lines for respectively transmitting the accelerating and restraining signals supplied from the single delay time difference detecting circuit. Further, the first and second delay circuits may be disposed substantially at the center of a semiconductor substrate. Such an arrangement not only controls outputs of the constant voltage generating circuits according to the average temperature of the semiconductor substrate, but also shortens the signal lines for transmitting the accelerating and restraining signals. Further, when the first and second delay circuits are disposed in the vicinity of the center of a heat generating part of a semiconductor substrate, temperture variations can be directly reflected on outputs of the constant voltage generating circuits.

DETAILED DESCRIPTION OF PREFERRED EMBODIMENTS

[First Embodiment (Reference Potential Generating Circuit]

The following description will discuss reference potential generating circuits according to a first embodiment of the present invention with reference to FIGS. 1 to 7.

(1) EXAMPLE 1.1

(Resistance Load and Earth Potential Reference Type)

Figure 1:
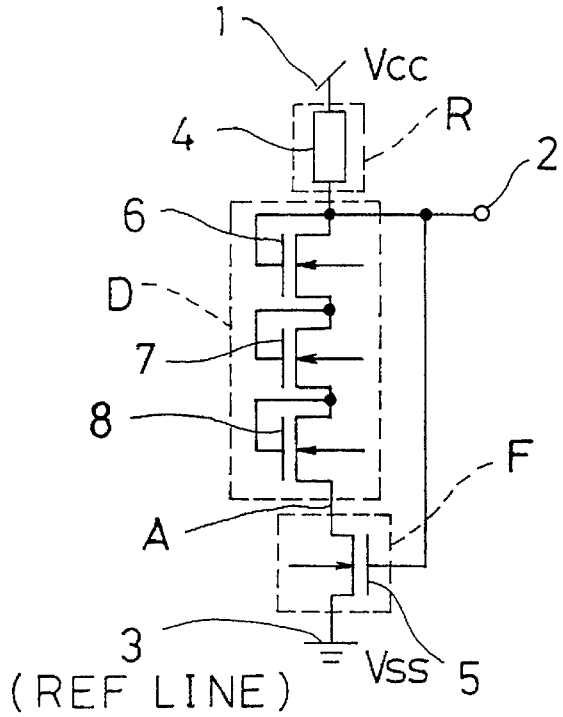
FIG. 1 is the circuit diagram of a first reference potential generating circuit according to a first embodiment of the present invention.

A circuit shown in FIG. 1 is adapted to generate a predetermined difference in potential between the earth line 3 serving as a reference potential line and an output node 2, and comprises resistance means R, feedback means F and diode means D. A resistance element 4 forming the resistance means R is formed by polysilicon resistance or diffusion resistance, and interposed between a power supply line 1 (VCC: external power supply voltage level) and the output node 2. An N-type MOSFET 5 forming the feedback means F is arranged such that the gate thereof is connected to the output node 2 and the source thereof is connected to the earth line 3 (VSS: earth potential). Another three N-type MOSFETs 6, 7, 8 so connected in series as to form the diode means D, are interposed between the drain of the N-type MOSFET 5 of the feedback means F and the output node 2.

(2) EXAMPLE 1.2

(Resistance Load and External Power Supply Voltage Level Reference Type)

Figure 2:
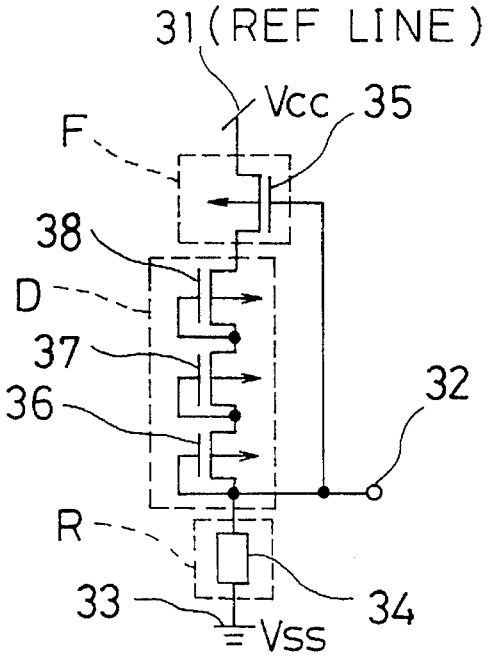
FIG. 2 is the circuit diagram of a second reference potential generating circuit according to the first embodiment of the present invention.

A circuit shown in FIG. 2 is adapted to generate a predetermined difference in potential between a power supply line 31 serving as a reference potential line and an output node 32, and comprises, likewise in FIG. 1, resistance means R, feedback means F and diode means D. A resistance element 34 forming the resistance means R is formed by polysilicon resistance or diffusion resistance, and interposed between the earth line 33 (VSS: earth potential) and the output node 32. A P-type MOSFET 35 forming the feedback means F is arranged such that the gate thereof is connected to the output node 32 and the source thereof is connected to the power supply line 31 (VCC: external power supply voltage level). Another three P-type MOSFETs 36, 37, 38 so connected in series as to form the diode means D, are interposed between the drain of the P-type MOSFET 35 of the feedback means F and the output node 32.

(3) EXAMPLES 1.3 AND 1.4

(Transistor Load Type)

Figure 3:
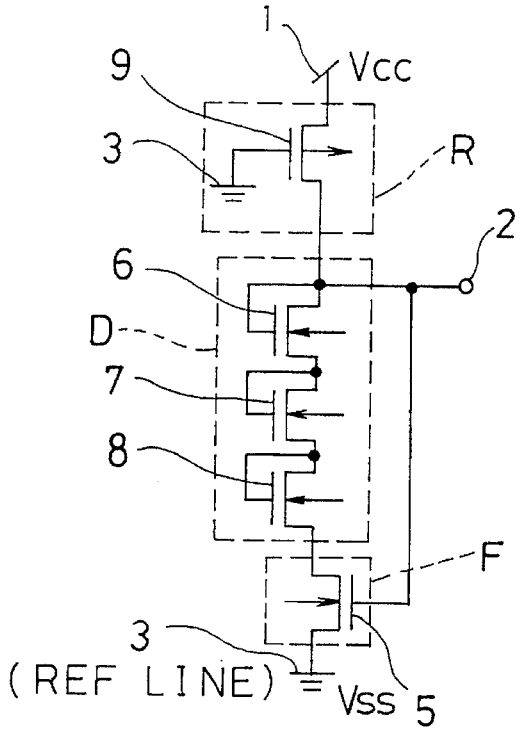
FIG. 3 is the circuit diagram of a third reference potential generating circuit according to the first embodiment of the present invention.

A circuit shown in FIG. 3 uses, as the resistance means R in FIG. 1, the channel resistance of a P-type MOSFET 9 of which gate is connected to the earth line 3.

Figure 4:
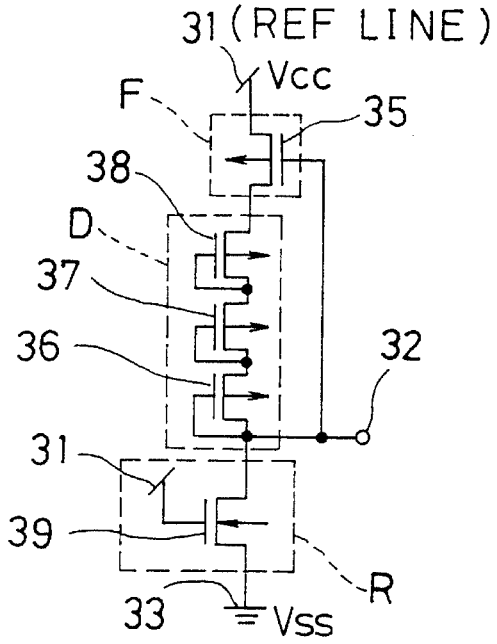
FIG. 4 is the circuit diagram of a fourth reference potential generating circuit according to the first embodiment of the present invention.

A circuit shown in FIG. 4 uses, as the resistance means R in FIG. 2, the channel resistance of an N-type MOSFET 39 of which gate is connected to a power supply line 31.

(4) EXAMPLE 1.5

(Variable Output Type)

Figure 5:
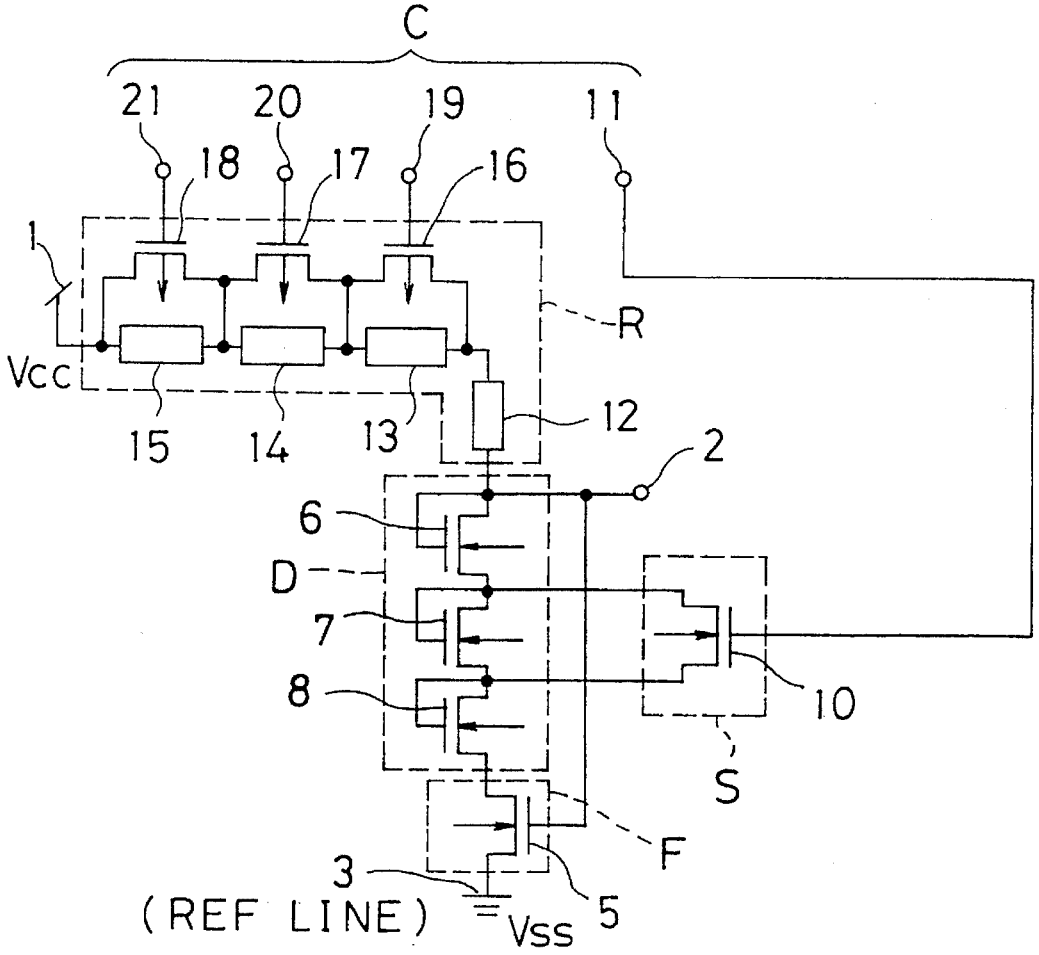
FIG. 5 is the circuit diagram of a fifth reference potential generating circuit according to the first embodiment of the present invention.

A circuit shown in FIG. 5 is adapted such that, in the circuit in FIG. 1, the potential of the output node 2 can be changed according to control signals C. More specifically, there is disposed short-circuiting means S for short-circuiting, out of the three N-type MOSFETs 6, 7, 8 forming the diode means D, one N-type MOSFET 7 across the source and drain thereof, and the resistance means R is arranged such that the resistance value thereof is variable. The short-circuiting means S is formed by another N-type MOSFET 10 having the gate to which an on/off control signal is given through a first control input terminal 11. The resistance means R has four resistance elements 12, 13, 14, 15 connected in series to one another, and further has three P-type MOSFETs 16, 17, 18 for respectively short-circuiting three resistance elements 13, 14, 15 out of the four resistance elements 12 to 15 above-mentioned. On/off control signals are respectively given to the gates of the three P-type MOSFETs 16, 17, 18 through respective second to fourth control input terminals 19, 20, 21.

(5) EXAMPLE 1.6

(Variable Output Type)

Figure 6:
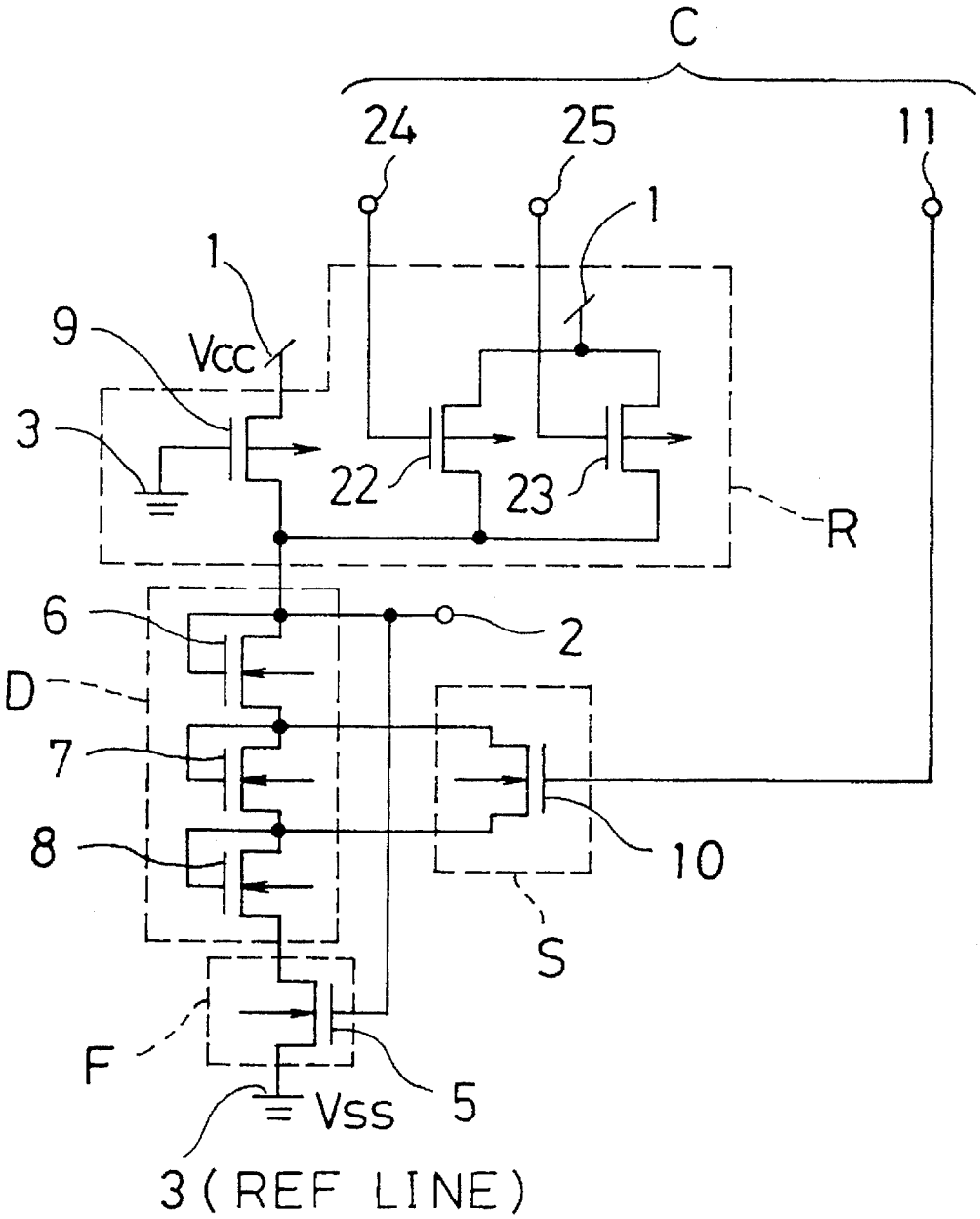
FIG. 6 is the circuit diagram of a sixth reference potential generating circuit according to the first embodiment of the present invention.

A circuit shown in FIG. 6 is adapted such that, in the circuit of the transistor load type in FIG. 3, the potential of the output node 2 can be changed according to the control signals C. More specifically, there is disposed short-circuiting means S formed by another N-type MOSFET 10 for partially short-circuiting the three N-type MOSFETs 6, 7, 8 which form the diode means D, and second and third P-type MOSFETs 22, 23 are connected in parallel to the P-type MOSFET 9 so interposed between the power supply line 1 and the output node 2 as to form the resistance means R. On/off control signals are respectively given to the gate of the N-type MOSFET 10 forming the short-circuiting means S and to the gates of second and third P-type MOSFETs 22, 23 in the resistance means R through respective first to third control input terminals 11, 24, 25.

The following description will discuss the operation of each of the reference potential generating circuits having the arrangements above-mentioned.

In the circuit having the basic arrangement shown in FIG. 1, a small electric current always flows from the power supply line 1 to the earth line 3 serving as the reference potential line through the resistance means R, the diode means D and the feedback means F. When the drain of the N-type MOSFET 5 forming the feedback means F is set as an internal node A, a difference in potential between the internal node A and the output node 2 is substantially equal to the total of the threshold voltages Vt of the three N-type MOSFETs 6, 7, 8 forming the diode means D, i.e., 3 Vt. If the threshold voltages Vt are increased due to an increase in ambient temperature, a difference in potential between the internal node A and the output node 2 is increased. This results in an increase in difference in potential between the source and gate of the N-type MOSFET 5 forming the feedback means F, resulting in a decrease in the channel resistance of the feedback N-type MOSFET 5. This causes the internal node A to be lowered in potential, so that the potential of the output node 2 is maintained substantially at the level obtained before the threshold voltages Vt change. That is, the dependency on temperature of the potential of the output node 2 becomes small. The foregoing is a brief description of the operational principle of the circuit in FIG. 1.

In the circuit having the arrangement in FIG. 2, the power supply line 31 serves as the reference potential line unlike in FIG. 1. However, the circuit in FIG. 2 operates according to an operational principle similar to that above-mentioned. More specifically, a difference in potential between the power supply line 31 and the output node 32 is maintained constant regardless of variations of the threshold voltages Vt.

The circuits respectively having the arrangements in FIGS. 3 and 4 utilize, as the resistance means R, the channel resistances of the MOSFETs 9, 39. When the channel resistance of a MOSFET is utilized, the circuit arrangement can be reduced in layout area as compared with an arrangement using a resistance element having small sheet resistance formed by silicon resistance or diffusion resistance as in the arrangement in FIG. 1 or 2.

Each of the arrangements in FIGS. 5 and 6 is adapted such that the resistance value of the resistance means R and the number of MOSFETs connected in series to form the diode means D can be changed according to the control signals C, thus enabling the potential of the output node 2 to be changed. Particularly, according to the arrangement in FIG. 6, the reference potential generating circuit can be formed by MOSFETs only. In FIG. 6, the N-type MOSFET 10 forming the short-circuiting means S is disposed for coarse adjustment of the output, while the second and third P-type MOSFETs 22, 23 in the resistance means R are disposed for fine adjustment of the output.

In each of the arrangements in FIGS. 1 to 6, when the total of the conductances of the MOSFETs forming the diode means D is equal to the conductance of the MOSFET forming the feedback means F, the effect of reducing the temperature dependency can be maximized. More specifically, such effect can be maximized when the ratio of W1/L1 to W2/L2 is substantially equal to N:1, wherein W1 and L1 are respectively the channel width and channel length of each of the MOSFETs forming the diode means D, N is the number of these MOSFETs connected in series, and W2 and L2 are respectively the channel width and channel length of the MOSFET forming the feedback means F.

Figure 7:
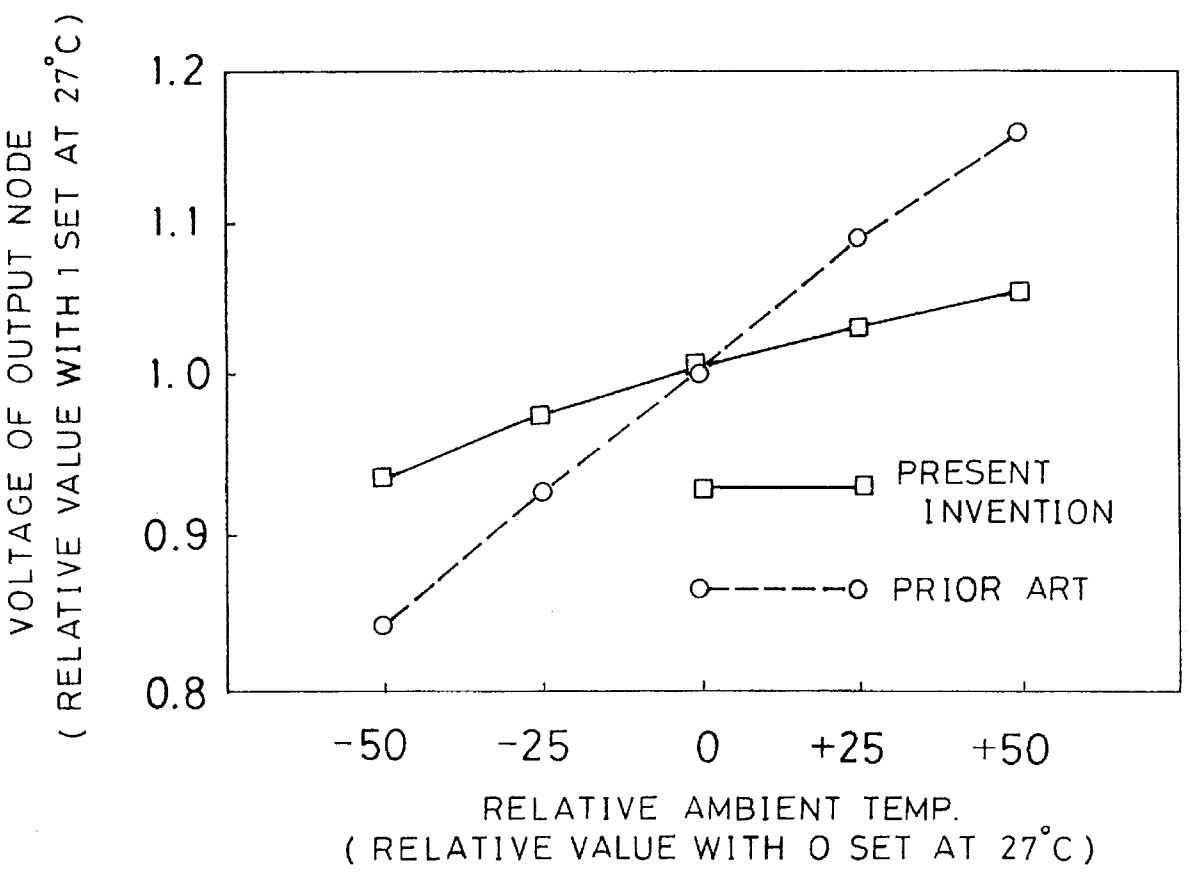
FIG. 7 is a graph illustrating how the reference potential generating circuit according to the first embodiment of the present invention improves the output potential thereof in temperature dependency.

FIG. 7 shows the results of an simulation of the reference potential generating circuit according to the first embodiment. It is apparent from FIG. 7 that, in this embodiment, the output potential is decreased in temperature dependency.

[Second Embodiment (Constant Voltage Generating Circuit Arrangement)]

The following description will discuss constant voltage generating circuit arrangements according to a second embodiment of the present invention with reference to FIGS. 8 to 12.

(1) EXAMPLE 2.1

(Basic Type)

Figure 8:
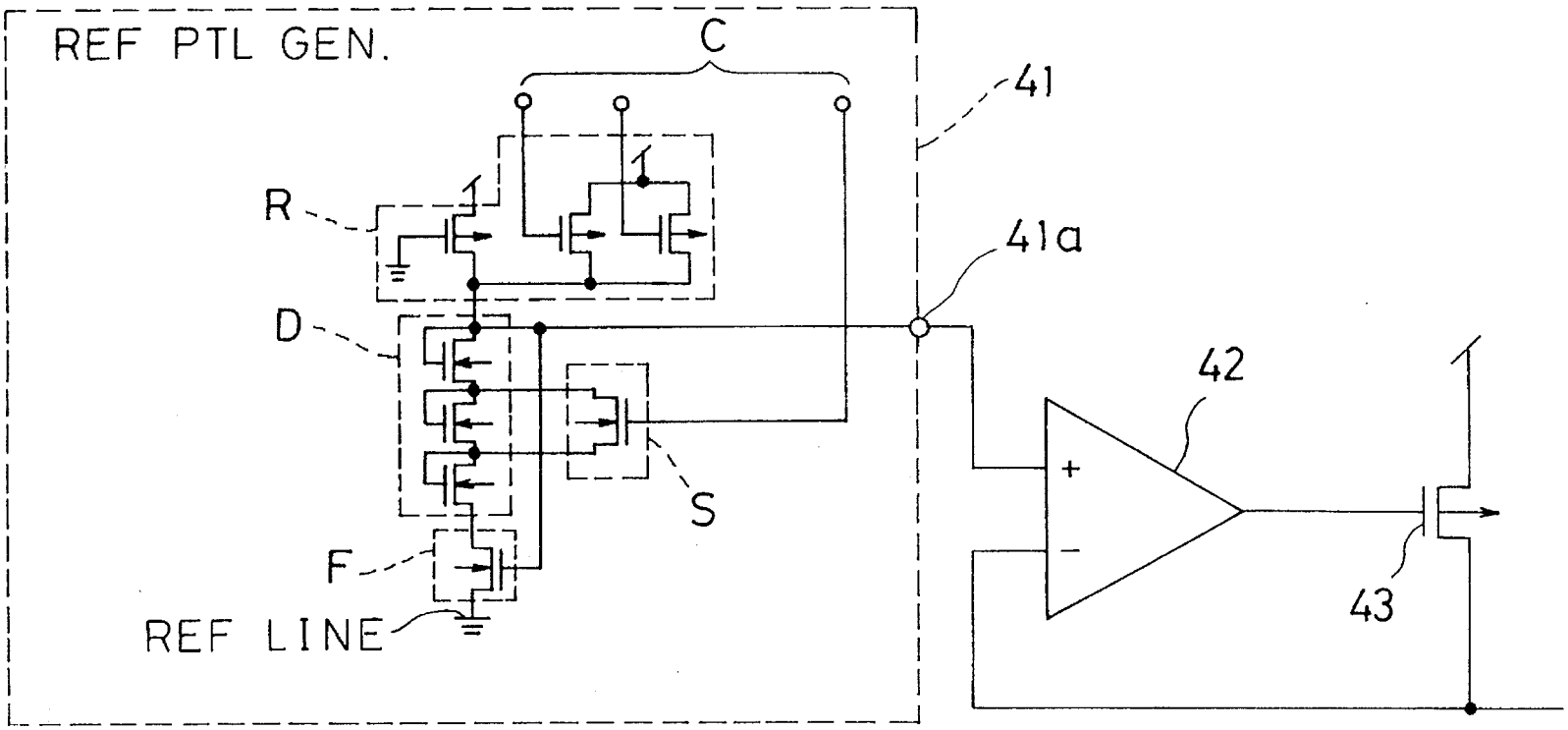
FIG. 8 is the circuit diagram of a first constant voltage generating circuit arrangement according to a second embodiment of the present invention.

An arrangement in FIG. 8 is adapted to hold the potential of an output line 44 at a predetermined value, and comprises a reference potential generating circuit 41 identical with the circuit shown in FIG. 6, a comparator circuit 42 and a P-type MOSFET 43 serving as a driver circuit for driving the output line 44. The comparator circuit 42 is adapted to compare the potential of an output node 41*a* of the reference potential generating circuit 41 with the potential of the output line 44. An output of the comparator circuit 42 is supplied to the gate of the P-type MOSFET 43.

In the arrangement above-mentioned, when the potential of the output line 44 is liable to be lowered due to, for example, an increase in load current, the comparator circuit 42 detects a difference between the reference potential of the output node 41*a* in the reference potential generating circuit 41 and the potential of the output line 44, so that the gate voltage of the P-type MOSFET 43 is so controlled as to increase the drain current thereof. This prevents the output voltage from being lowered. Thus, a stabilized output voltage can be obtained at the output line 44. Further, the circuit arrangement in FIG. 8 is adapted such that the resistance means R and the short-circuiting means S so operate as to enable the setting of the stabilized output voltage to be changed according to the control signals C.

However, the constant voltage generating circuit arrangement in FIG. 8 presents the following problem. When the target voltage to be generated is near to the external power supply voltage level VCC, the output potential of the reference potential generating circuit 41 should be set to such a voltage level. In such a case, however, the comparator circuit 42 does not operate in a normal manner.

Figure 9:
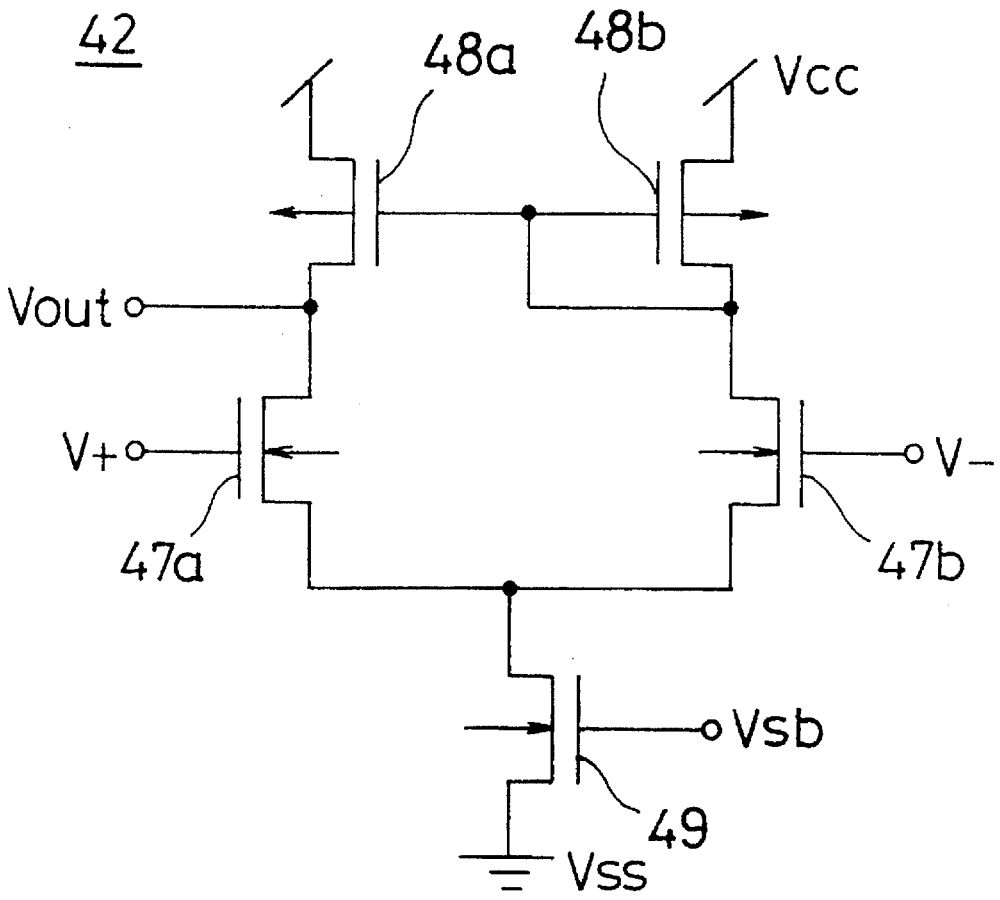
FIG. 9 is a circuit diagram illustrating the arrangement of a comparator circuit shown in FIG. 8.
Figure 10:
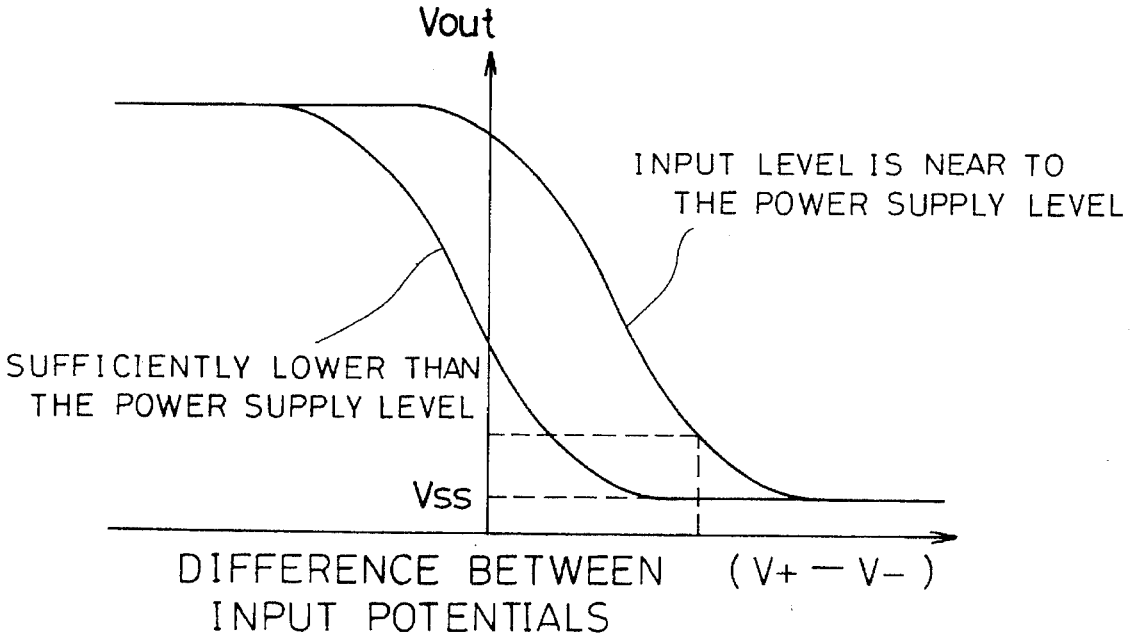
FIG. 10 is a view illustrating that there are instances where the comparator circuit in FIG. 9 does not effect a normal comparing operation.

FIG. 9 shows a typical arrangement of the comparator circuit 42 using MOSFETs. In FIG. 9, there are disposed (i) differential N-type MOSFETs 47*a*, 47*b* having the gates to which input potentials $V_+$, $V_-$ are given, (ii) current mirror P-type MOSFETs 48*a*, 48*b*, and (iii) a common N-type MOSFET 49 having the gate to which a standby signal Vsb is given. FIG. 10 shows the input/output characteristics of the comparator circuit 42. As shown in FIG. 10, when the input voltage is near to the power supply level, an output Vout of the comparator circuit 42 cannot be lowered to the earth potential VSS. More specifically, the comparator circuit 42 does not effect a normal comparing operation in the vicinity of the point where the input voltage becomes smaller than the threshold voltages of the current mirror P-type MOSFETs 48*a*, 48*b*.

The following will discuss a constant voltage generating circuit arrangement additionally having a voltage shift circuit to shift the operational point of the comparator circuit 42 to an optimum position.

(2) EXAMPLE 2.2

(Voltage Shift Circuit Addition Type)

Figure 11:
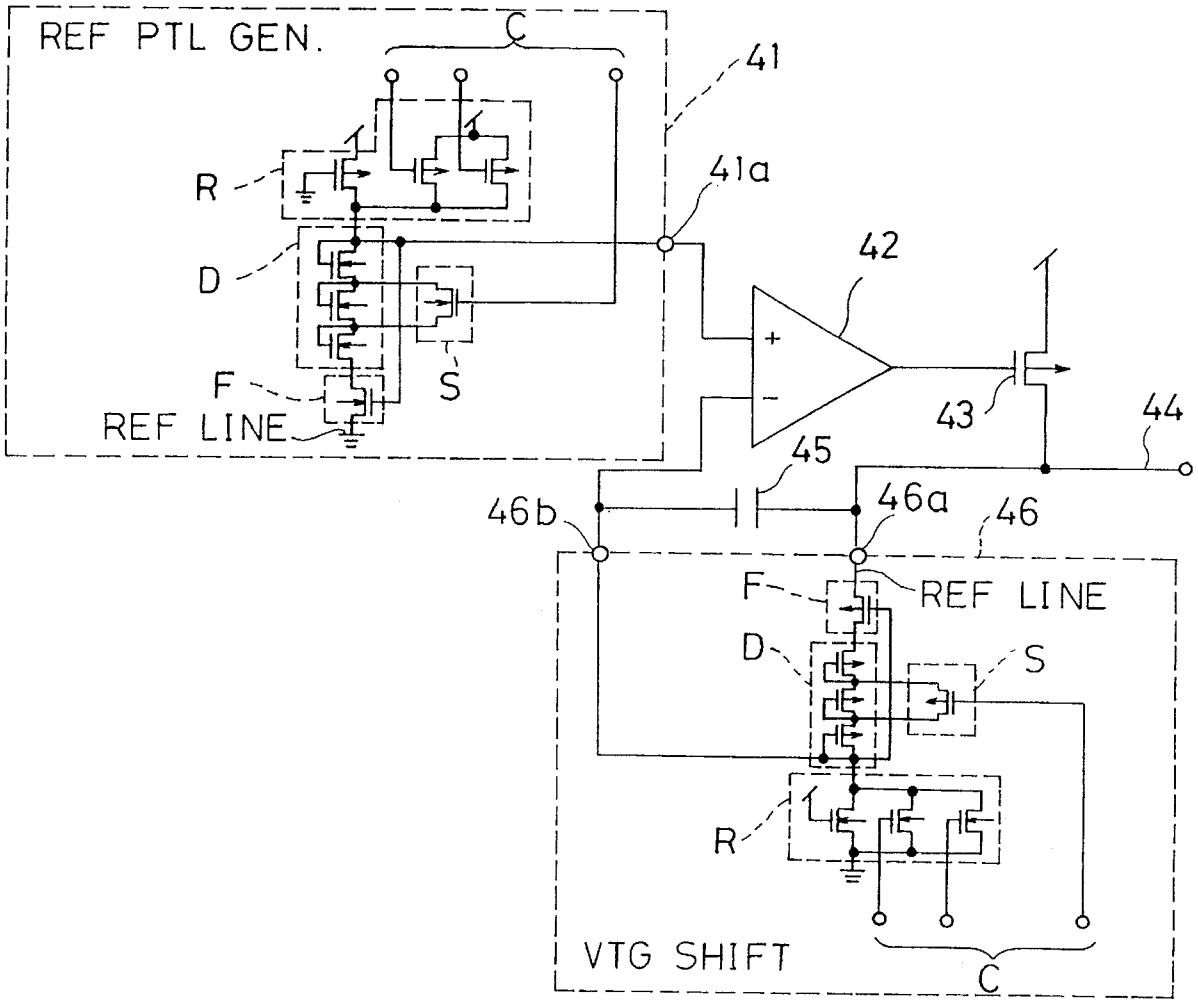
FIG. 11 is the circuit diagram of a second constant voltage generating circuit arrangement according to the second embodiment of the present invention.

An arrangement in FIG. 11 comprises, in addition to the circuit arrangement shown in FIG. 8, a capacitor element 45 and a voltage shift circuit 46. The capacitor element 45 is interposed between the output line 44 and a feedback input terminal of the comparator circuit 42 to prevent an occurrence of oscillation in the loop circuit formed by the comparator circuit 42 and the P-type MOSFET 43. The voltage shift circuit 46 comprises, in addition to the reference potential generating circuit in FIG. 4, short-circuiting means S for partially short-circuiting the P-type MOSFETs forming the diode means D therein, and is arranged such that the resistance value of resistance means R is variable. Here, it is to be noted that the power supply line 31 serves as the reference potential line in the reference potential generating circuit in FIG. 4, but the output line 44 serves as a reference potential line through an input node 46*a* in the voltage shift circuit 46 in FIG. 11. More specifically, the voltage shift circuit 46 is adapted to generate a predetermined difference in potential between the output line 44 and the output node 46*b* of the circuit 46. The potential of the output node (first node) 41*a* in the reference potential generating circuit 41 is given as a reference input to the comparator circuit 42, while the potential of the output node (second node) 46*b* in the voltage shift circuit 46 is given as a feedback input to the comparator circuit 42.

The following description will briefly discuss the operational principle of the constant voltage generating circuit arrangement in FIG. 11.

Since the voltage shift circuit 46 is interposed between the output line 44 and the feedback input terminal of the comparator circuit 42, the potential of the feedback input terminal of the comparator circuit 42 is set to a level lower by a predetermined voltage than the potential of the output line 44. As apparent from the previous description of the operation of the reference potential generating circuit, this amount of shift does not change regardless of temperature variations. Likewise, the reference input from the reference potential generating circuit 41 to the comparator circuit 42 is set lower than the target stabilized output voltage. This enables the operational point of the comparator circuit 42 to be shifted to the range where the comparator circuit 42 operates in a normal manner. Further, the constant voltage generating circuit arrangement in FIG. 11 is adapted such that the resistance means R and the short-circuiting means S in each of the reference potential generating circuit 41 and the voltage shift circuit 46 so operate as to enable the setting of the stabilized output voltage to be changed according to the control signals C.

The capacitor element 45 is disposed for preventing the loop circuit formed by the comparator circuit 42 and the P-type MOSFET 43 from being oscillated. Such oscillation may occur due to delay in appearance of variations of the stabilized output voltage in the form of variations of the feedback input because of the insertion of the voltage shift circuit 46. That is, provision is made such that only variable components pass through the capacitor element 45.

(3) EXAMPLE 2.3

(Programmable Constant Voltage Generating Circuit Arrangement)

Figure 12:
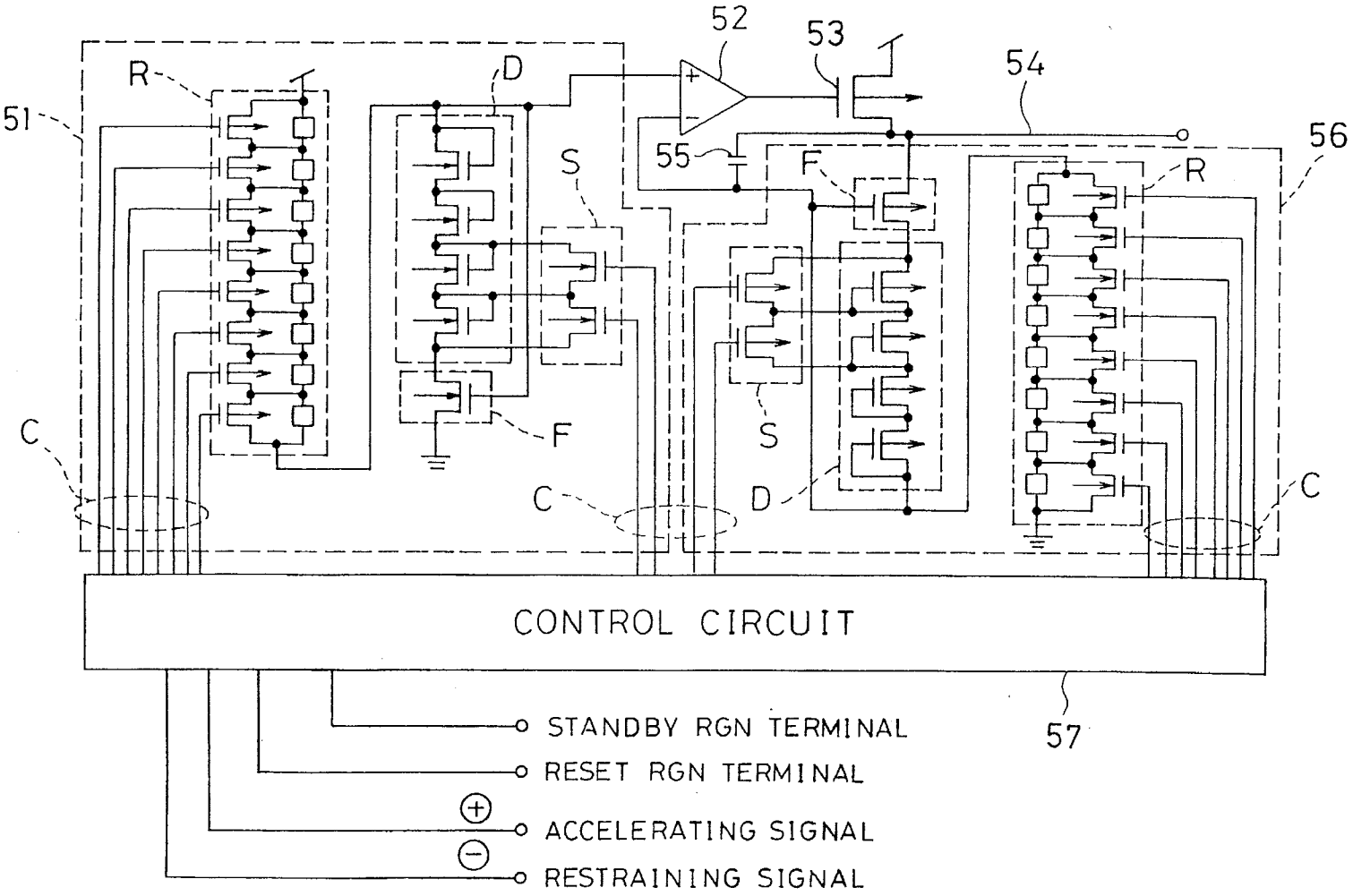
FIG. 12 is the circuit diagram of a third constant voltage generating circuit arrangement according to the second embodiment of the present invention.

FIG. 12 shows a programmable constant voltage generating circuit arrangement developed from the constant voltage generating circuit arrangement in FIG. 11. In FIG. 12, there are disposed a reference potential generating circuit 51 identical with the circuit according to the first embodiment of the present invention, a comparator circuit 52, a P-type MOSFET 53 serving as a driver circuit, a stabilized voltage output line 54, a capacitor element 55 and a voltage shift circuit 56. Each of resistance means R in the reference potential generating circuit 51 and the voltage shift circuit 56 is adapted such that the resistance value thereof is changed according to control signals C. Each of the reference potential generating circuit 51 and the voltage shift circuit 56 has short-circuiting means S for short-circuiting, according to the control signals C, at least one of a plurality of MOS transistors across the source and drain thereof, the plurality of MOS transistors forming diode means D. A control circuit 57 is adapted to supply the control signals C to the reference potential generating circuit 51 and the voltage shift circuit 56, thereby to change the potential of the output line 54.

The control circuit 57 has a function of generating the control signals C such that the output-line potential as the stabilized output voltage is increased each time the control circuit 57 receives an accelerating signal, and that the output-line potential is lowered each time the control circuit 57 receives a restraining signal. That is, the increase and decrease in output voltage can be controlled by two signal lines only.

When the control circuit 57 receives a standby signal through a standby recognizing terminal, the control circuit 57 generates the control signals C such that an electric current consumed in each of the reference potential generating circuit 51, the comparator circuit 52 and the voltage shift circuit 56 is decreased in amount. That is, the resistance values of the resistance means R in the reference potential generating circuit 51 and the voltage shift circuit 56 are set to maximum values, and a common N-type MOSFET in the comparator circuit 52 (corresponding to the N-type MOSFET 49 in FIG. 9) is turned off to decrease the amount of a current flowing in the comparator circuit 52. It is noted that control signals supplied to the comparator circuit 52 are not shown in FIG. 12.

Further, the control circuit 57 has a function of generating the control signals C such that the potential of the output line 54 is initially set to a default value when the control circuit 57 receives a power-on reset signal through a reset recognizing terminal.

The constant voltage generating circuit arrangement in FIG. 8 can be developed to a programmable constant voltage generating circuit arrangement as shown in FIG. 12.

[Third Embodiment (Voltage Level Detecting Circuit Arrangement)]

Figure 13:
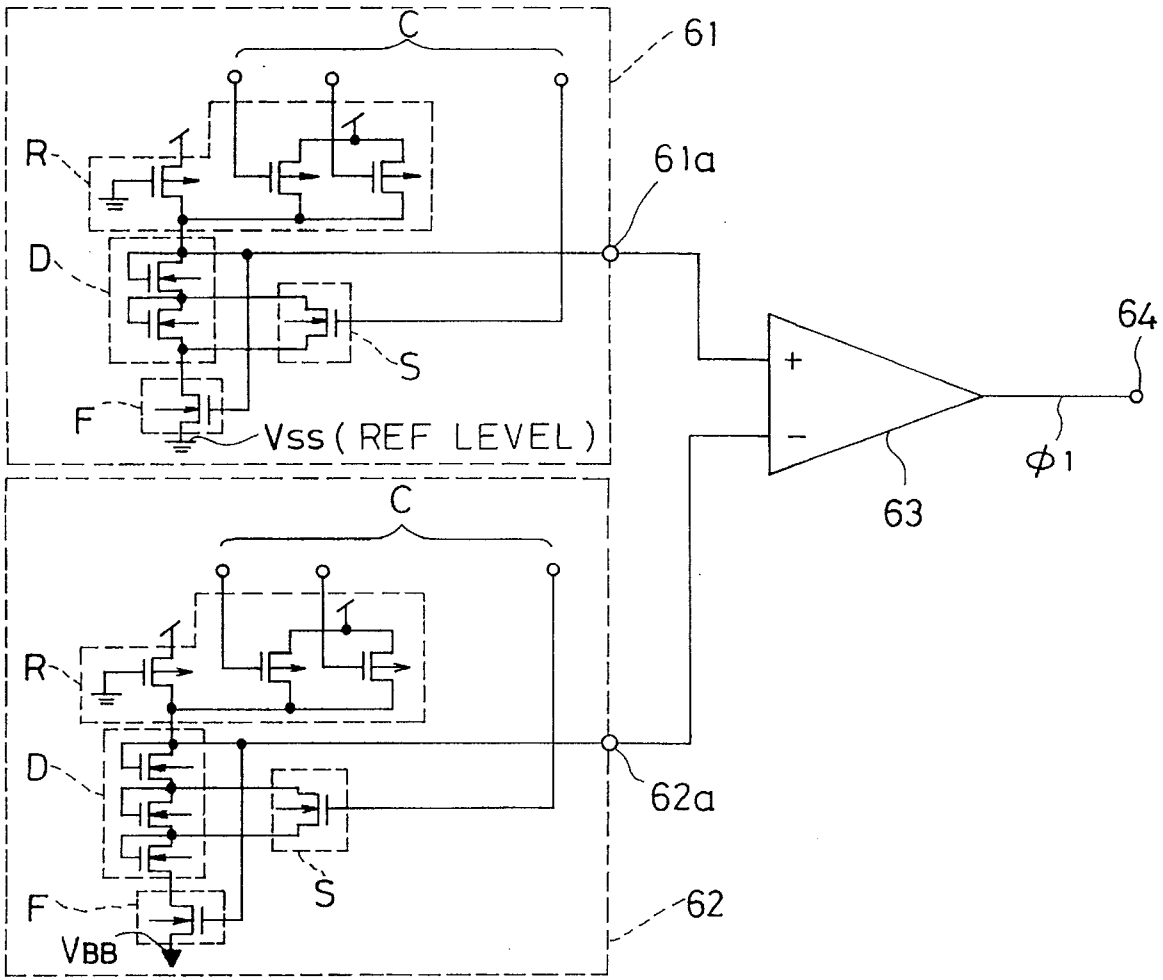
FIG. 13 is the circuit diagram of a first voltage level detecting circuit arrangement according to a third embodiment of the present invention.

The following description will discuss voltage level detecting circuit arrangements according to a third embodiment of the present invention with reference to FIGS. 13 to

17.

As mentioned earlier, a DRAM integrated circuit arrangement requires a substrate bias level VBB and a word line increased voltage level VPP, in addition to a power supply voltage level VCC externally supplied with the earth potential VSS serving as a reference.

(1) EXAMPLE 3.1

(VBB Level Detecting Circuit Arrangement)

FIG. 13 shows a VBB level detecting circuit arrangement in which the earth potential VSS serves as a reference voltage level and the substrate bias level VBB serves as the level of a voltage to be measured.

In FIG. 13, a first reference potential generating circuit 61 is adapted to generate a predetermined difference in potential between the earth line (VSS: earth potential) thereof and a first node 61*a* thereof, and comprises resistance means R, feedback means F, diode means D and short-circuiting means S which are respectively similar to those in FIG. 6. A second reference potential generating circuit 62 is adapted to generate a predetermined difference in potential between a line to be measured having the substrate bias level VBB and a second node 62*a* thereof, and also comprises resistance means R, feedback means F, diode means D and short-circuiting means S which are respectively similar to those in FIG. 6. The number of N-type MOSFETs connected in series to form the diode means D is greater in the second reference potential generating circuit 62 than in the first reference potential generating circuit 61. The level of a substrate bias to be detected is mainly determined by the difference in the number of the MOSFETs. A comparator circuit 63 is adapted to compare the potential of the first node 61*a* and the potential of the second node 62*a*. An output of the comparator circuit 63 is derived, as a substrate level detection output ϕ1, from an output terminal 64 thereof. This VBB level detecting circuit arrangement is characterized in that the voltage level detecting characteristics thereof do not depend on temperature.

(2) EXAMPLE 3.2

(VPP Level Detecting Circuit)

Figure 14:
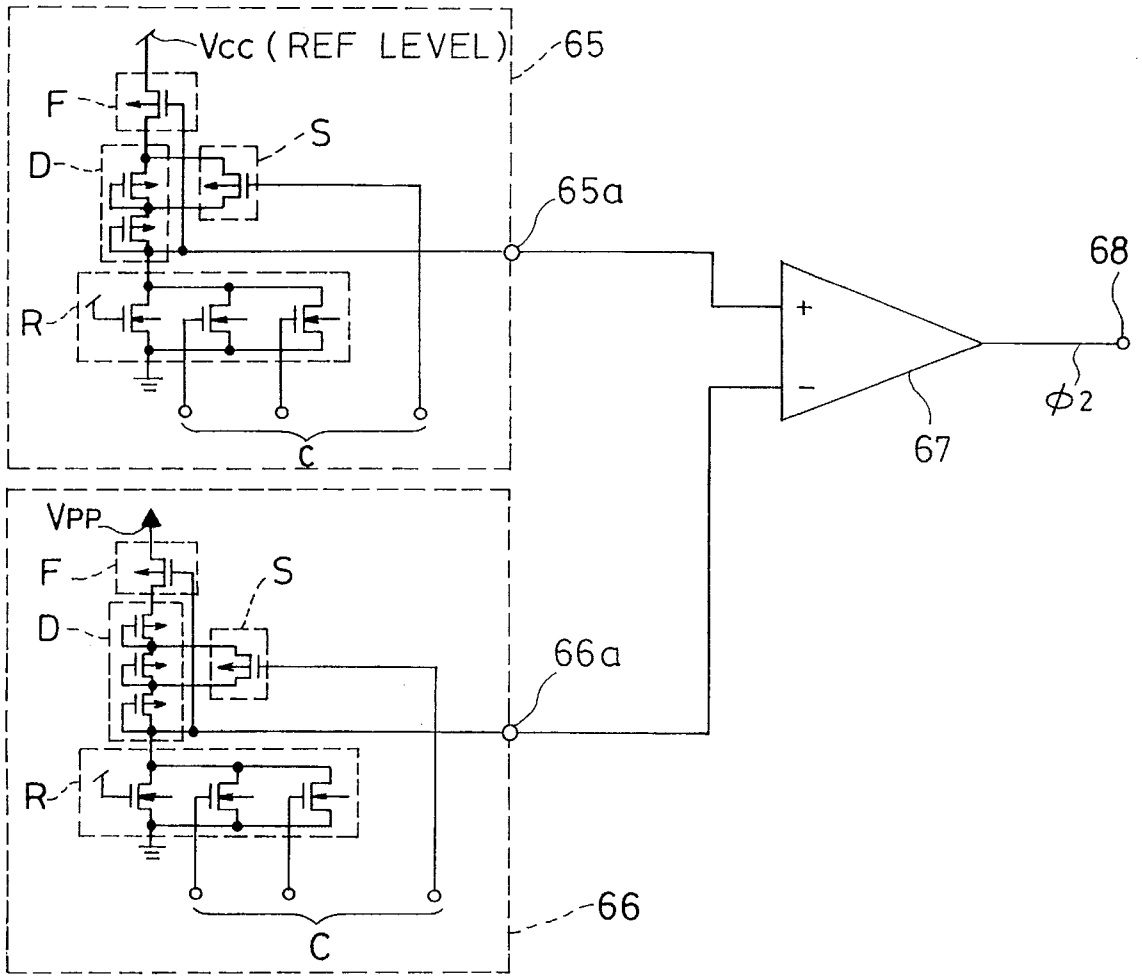
FIG. 14 is the circuit diagram of a second voltage level detecting circuit arrangement according to the third embodiment of the present invention.

FIG. 14 shows a VPP level detecting circuit arrangement in which an external power supply voltage level VCC serves as a reference voltage level and a word line increased voltage level VPP serves as the level of a voltage to be measured. In FIG. 14, a first reference potential generating circuit 65 is adapted to generate a predetermined difference in potential between a power supply line (VCC: external power supply voltage level) thereof and a first node 65*a* thereof. A second reference potential generating circuit 66 is adapted to generate a predetermined difference in potential between a line to be measured thereof having the word line increased voltage level VPP and a second node 66*a* thereof. A comparator circuit 67 is adapted to compare the potential of the first node 65*a* and the potential of the second node 66*a*. In FIG. 14, there are also shown an output terminal 68 and an increased voltage level detection output ϕ2. The VPP level detecting circuit arrangement in FIG. 14 differs from the VBB level detecting circuit arrangement in FIG. 13, in that each of the first and second reference potential generating circuits 65, 66 is a modification of the circuit mainly using P-type MOSFETs in FIG. 4. Also, this VPP level detecting circuit arrangement is characterized in that the voltage level detecting characteristics thereof do not depend on temperature.

(3) EXAMPLES 3.3 AND 3.4

(Hysteresis Characteristic Type)

Figure 15:
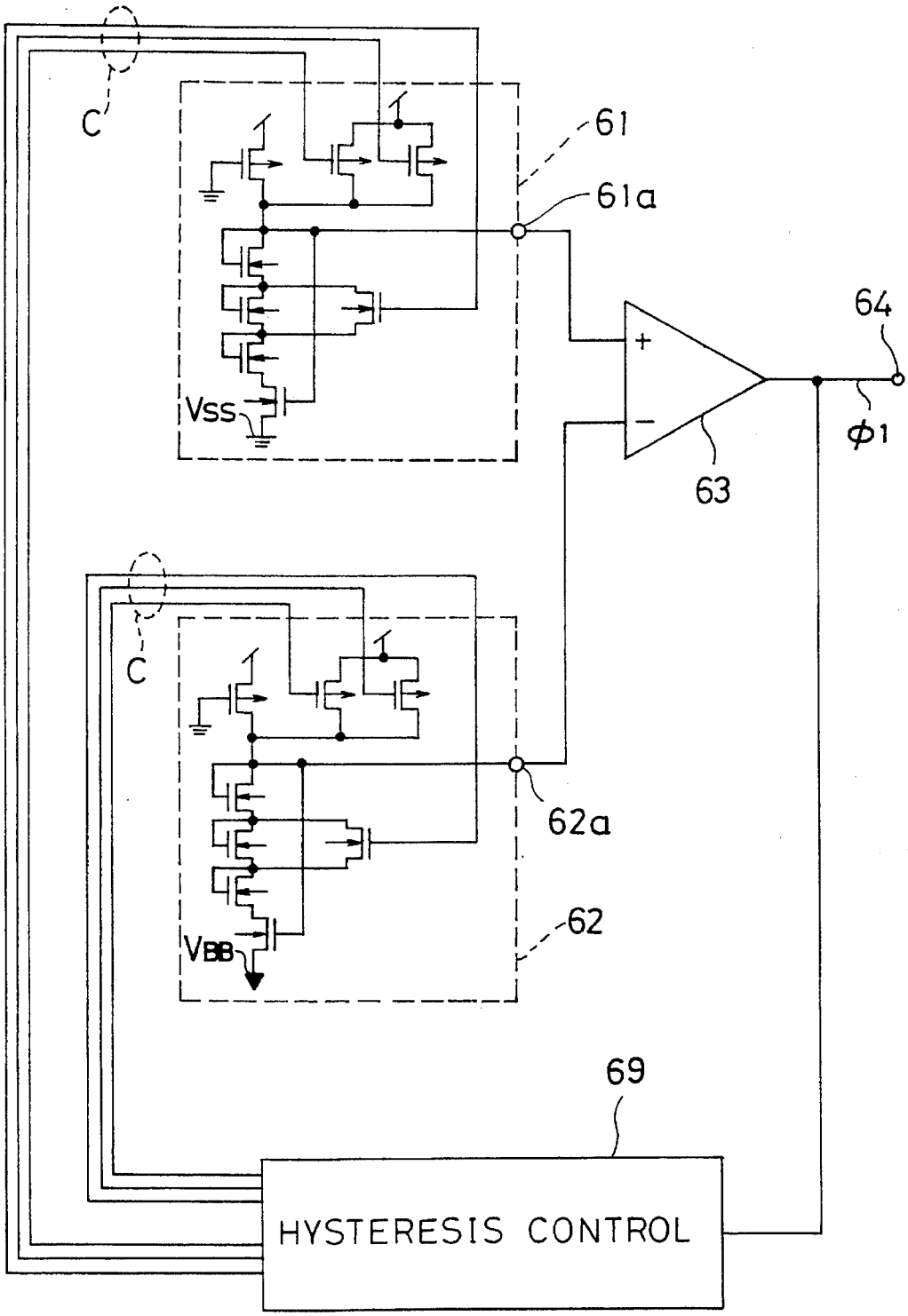
FIG. 15 is the circuit diagram of a third voltage level detecting circuit arrangement according to the third embodiment of the present invention.
Figure 16:
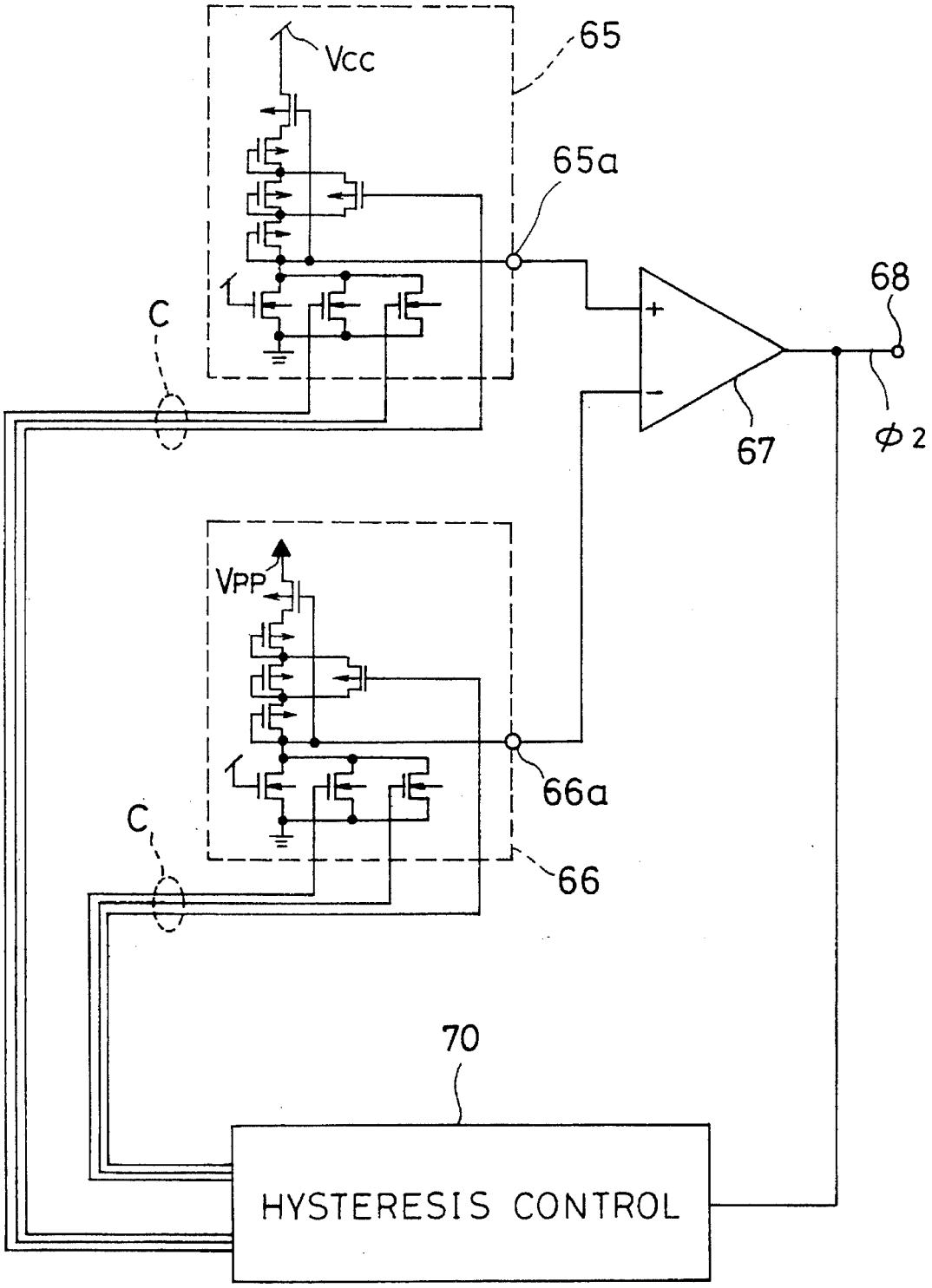
FIG. 16 is the circuit diagram of a fourth voltage level detecting circuit arrangement according to the third embodiment of the present invention.

FIG. 15 shows an arrangement in which a VBB level detecting circuit arrangement similar to the arrangement shown in FIG. 13 additionally has hysteresis characteristics, and FIG. 16 shows an arrangement in which a VPP level detecting circuit arrangement similar to the arrangement shown in FIG. 14 additionally has hysteresis characteristics. Each of the first reference potential generating circuits 61, 65 and the second reference potential generating circuits 62, 66 is adapted such that resistance means thereof and short-circuiting means thereof so operate as to enable the potential of an output node of each of the circuits above-mentioned to be changed according to control signals C. These arrangements in FIGS. 15, 16 additionally have respective hysteresis control circuits 69, 70 for generating the control signals C such that the voltage level detecting characteristics are changed according to level detection outputs ϕ1, ϕ2 supplied from comparator circuits 63, 67.

Figure 17:
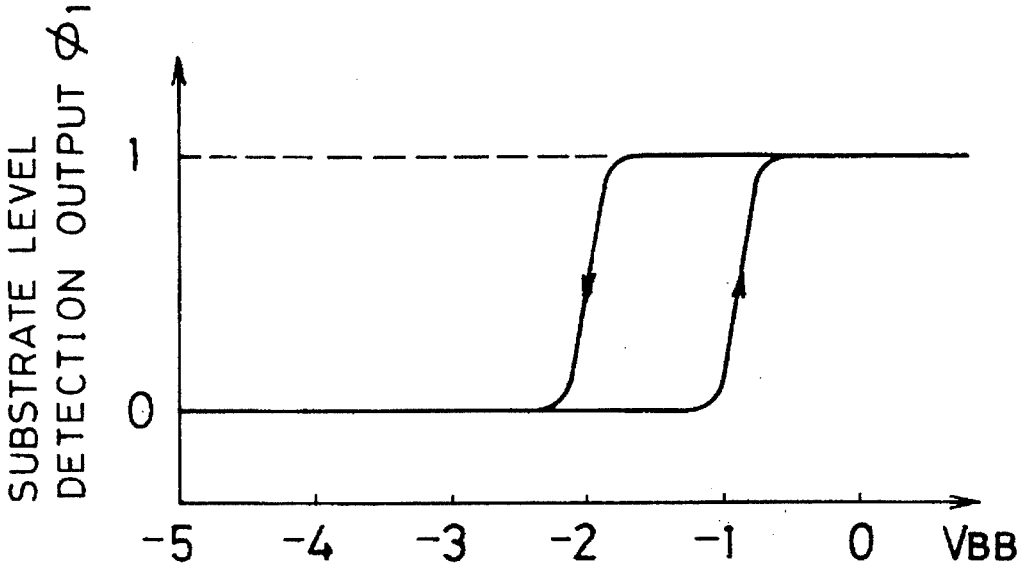
FIG. 17 is a graph illustrating the hysteresis characteristics of the voltage level detecting circuit arrangement in FIG. 15.

FIG. 17 shows the characteristics of the VBB level detecting circuit arrangement in FIG. 15. As apparent from FIG. 17, the hysteresis control circuit 69 operates such that a level where the substrate level detection output ϕ1 becomes 1, is different from a level where the substrate level detection output ϕ1 is returned to 0. It is therefore possible to stabilize the operation of the VBB level detecting circuit arrangement even though noise or the like is generated in the substrate bias level VBB which is the detection level. The VPP level detecting circuit arrangement in FIG. 16 has hysteresis characteristics similar to those shown in FIG. 17.

[Fourth Embodiment (Temperature Detecting Circuit Arrangement)]

The following description will discuss temperature detecting circuit arrangements according to a fourth embodiment of the present invention with reference to FIGS. 18 to 22.

(1) EXAMPLE 4.1

(Earth Potential Reference Type)

Figure 18:
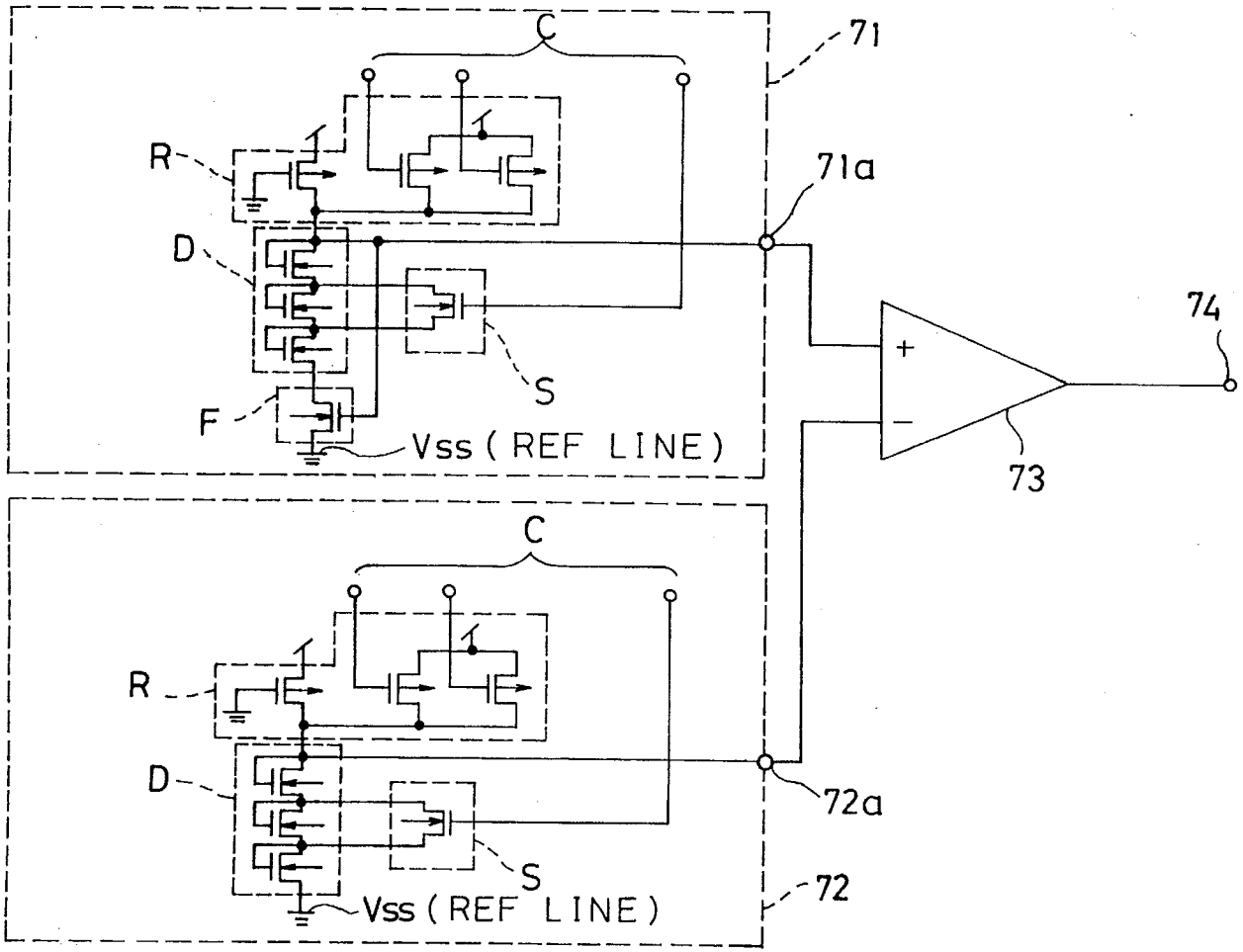
FIG. 18 is the circuit diagram of a first temperature detecting circuit arrangement according to a fourth embodiment of the present invention.

An arrangement shown in FIG. 18 is adapted to judge whether or not ambient temperature has reached a predetermined temperature, and comprises first and second reference potential generating circuits 71, 72 and a comparator circuit 73. The first reference potential generating circuit 71 is adapted to generate, between the earth line (VSS: earth potential) thereof and a first node 71*a* thereof, a difference in potential presenting a small temperature dependency due to reduction in the influence of variations of the threshold voltages of MOS transistors. The first reference potential generating circuit 71 has resistance means R, feedback means F, diode means D and short-circuiting means S which are similar to those shown in FIG. 6. The second reference potential generating circuit 72 is adapted to generate, between the earth line (VSS: earth potential) thereof and a second node 72*a* thereof, a difference in potential presenting a great temperature dependency resulting from variations of the threshold voltages of MOS transistors. The second reference potential generating circuit 72 has the same arrangement as that of the first reference potential generating circuit 71, except for the provision of feedback means F. More specifically, in the second reference potential generating circuit 72, a series circuit comprising a plurality of N-type MOSFETs forming the diode means D is connected, at one end thereof, directly to the earth line. The comparator circuit 73 is adapted to compare the potential of the first node 71*a* with the potential of the second node 72*a*. An output of the comparator circuit 73 is derived through an output terminal 74 thereof.

An output of the first reference potential generating circuit 71, i.e., the potential of the first node 71*a*, does not vary with variations of ambient temperature as mentioned earlier. On the other hand, since the second reference potential generating circuit 72 has no feedback means for restraining the temperature dependency, the potential of the second node 72*a* varies with variations of ambient temperature. That is, as ambient temperature varies, a difference in potential between the first and second nodes 71*a*, 72*a* is increased. The comparator circuit 73 detects such a difference in potential, which is then supplied as an output of temperature detection.

(2) EXAMPLE 4.2

(External Power Supply Voltage Level Reference Type)

Figure 19:
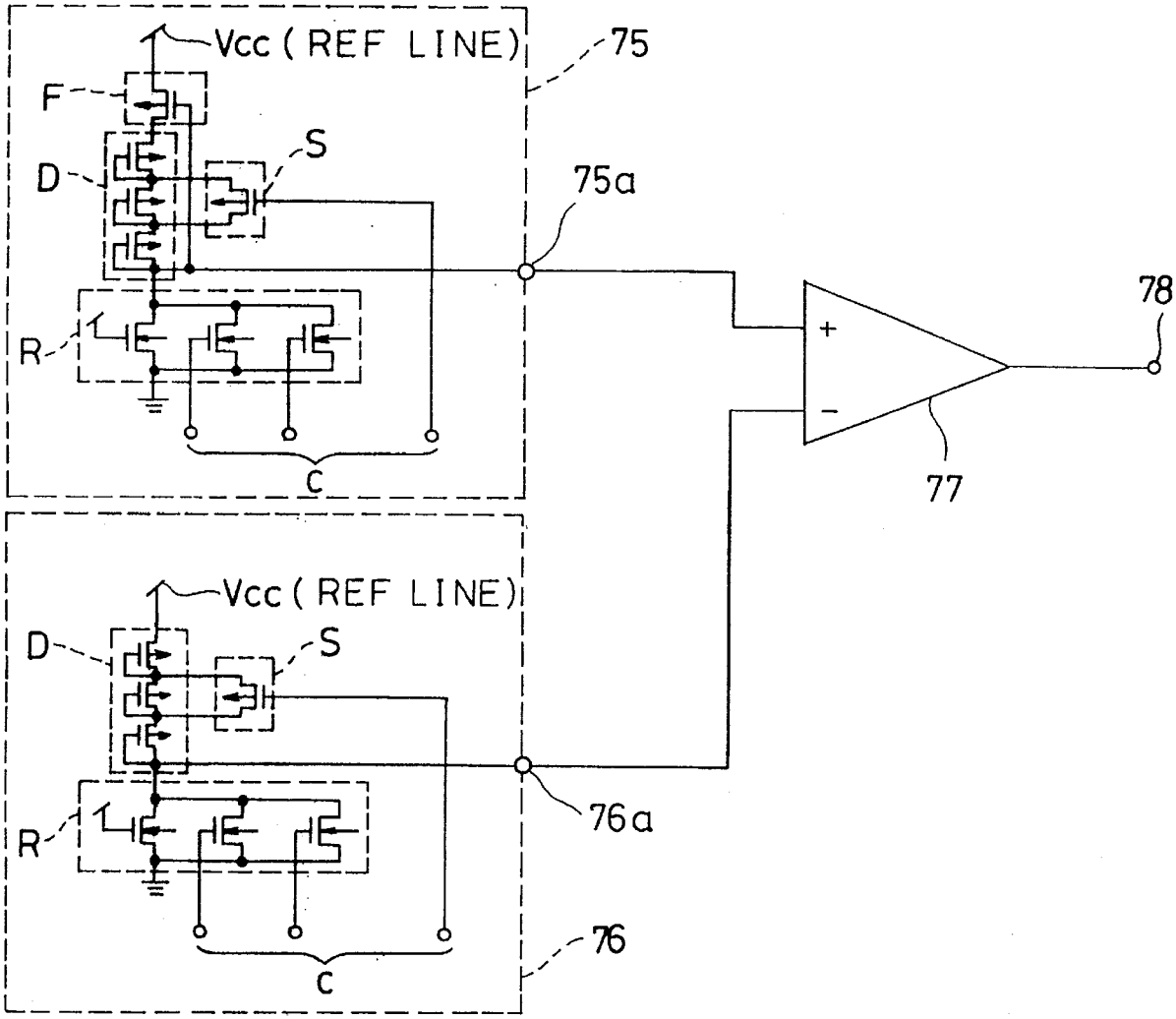
FIG. 19 is the circuit diagram of a second temperature detecting circuit arrangement according to the fourth embodiment of the present invention.

FIG. 19 shows another temperature detecting circuit arrangement according to the fourth embodiment. In FIG. 19, a first reference potential generating circuit 75 is adapted to generate a difference in potential presenting a small temperature dependency between a power supply line (VCC: external power supply voltage level) thereof and a first node 75*a* thereof. A second reference potential generating circuit 76 is adapted to generate a difference in potential presenting a great temperature dependency between a power supply line (VCC: external power supply voltage level) thereof and a second node 76*a* thereof. A comparator circuit 77 is adapted to compare the potential of the first node 75*a* with the potential of the second node 76*a*. The temperature detecting circuit arrangement in FIG. 19 has an output terminal 78. Likewise in FIG. 18, feedback means F is disposed only in the first reference potential generating circuit 75 out of the first and second reference potential generating circuits 75, 76. The circuit arrangement in FIG. 19 differs from that in FIG. 18 in that the first and second reference potential generating circuits 75, 76 are modifications of the arrangement mainly using P-type MOSFETs in FIG. 4, but is similar in operational principle to the circuit arrangement in FIG. 18.

(3) EXAMPLES 4.3 AND 4.4

(Hysteresis Characteristic Type)

Figure 20:
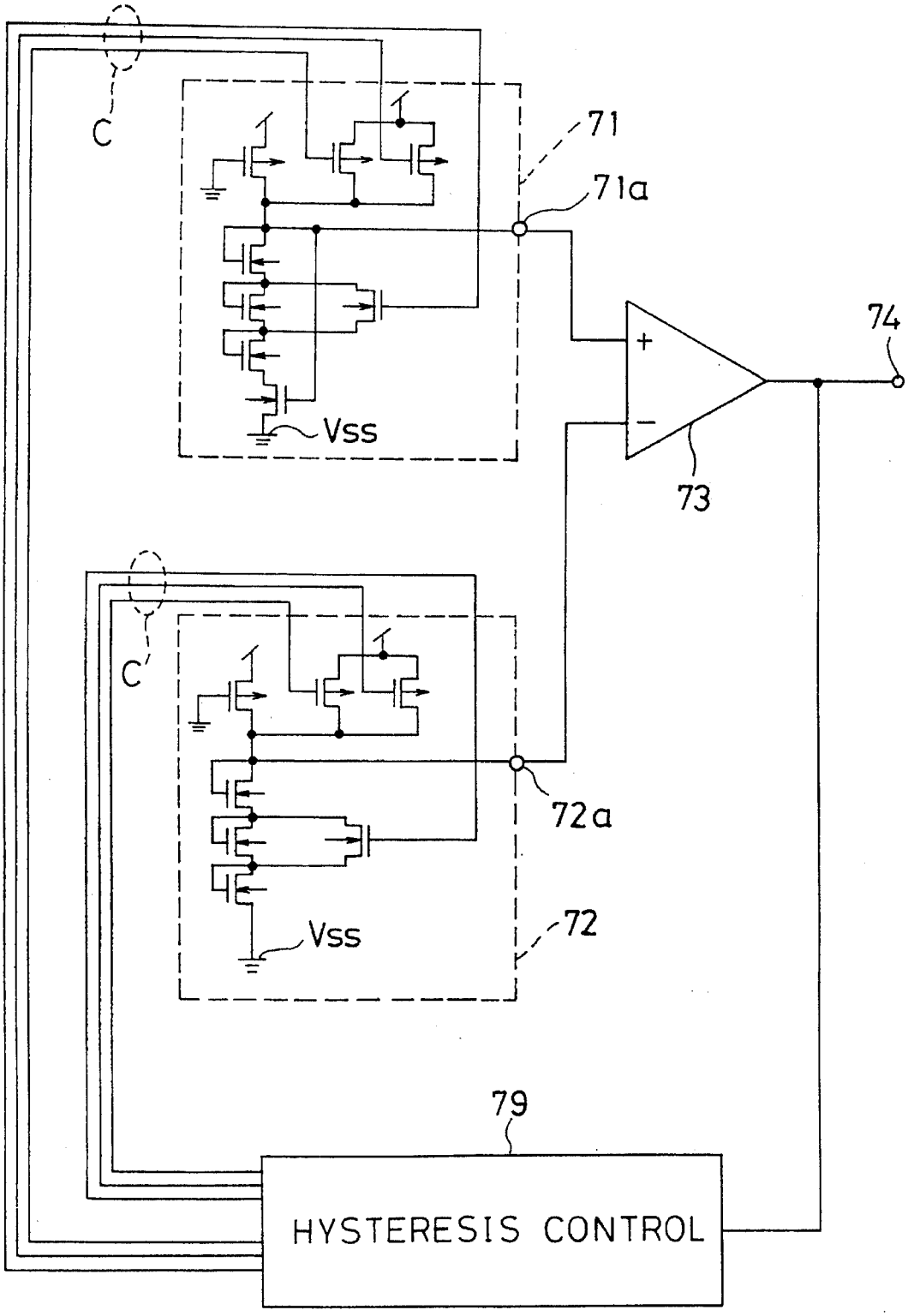
FIG. 20 is the circuit diagram of a third temperature detecting circuit arrangement according to the fourth embodiment of the present invention.
Figure 21:
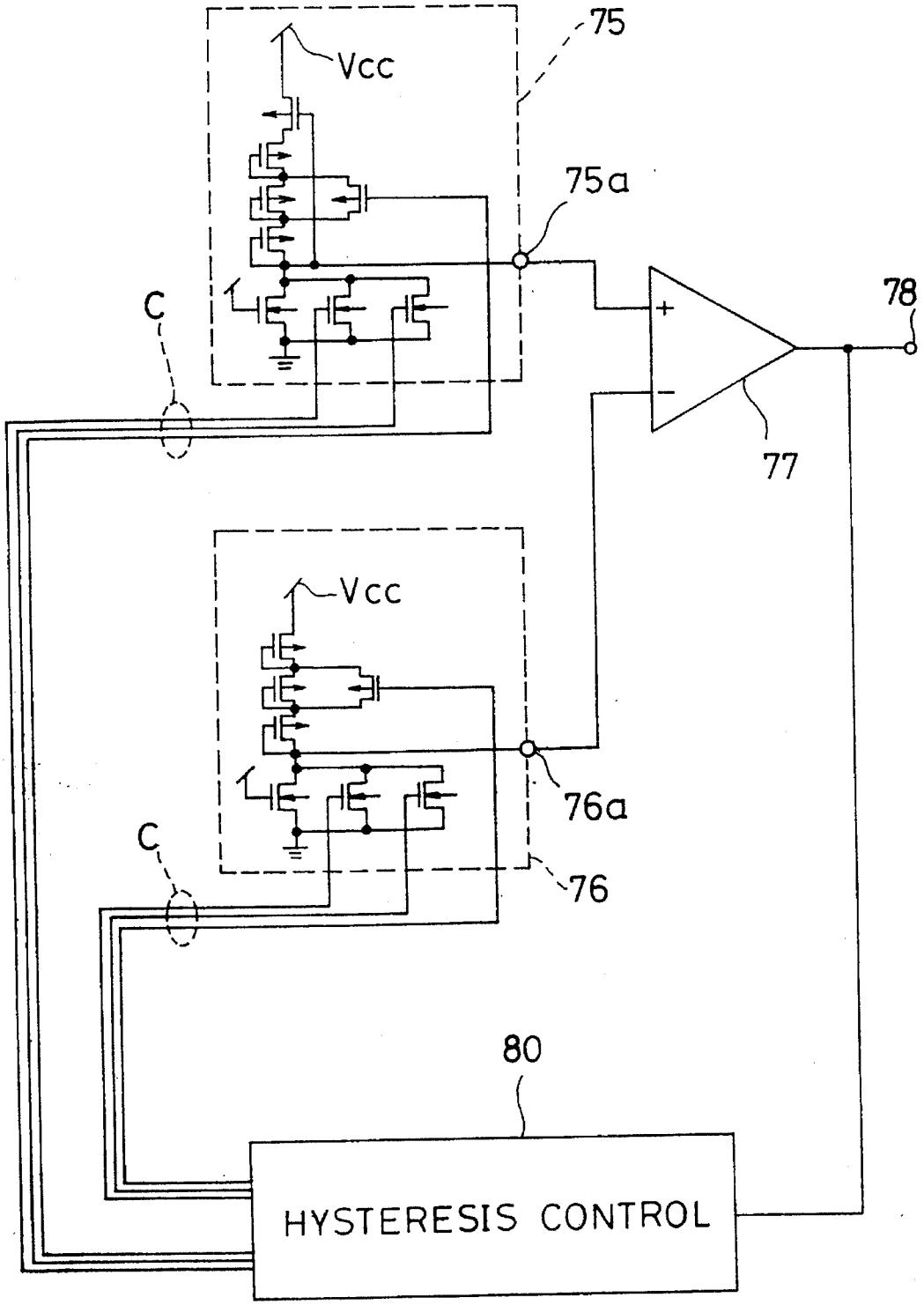
FIG. 21 is the circuit diagram of a fourth temperature detecting circuit arrangement according to the fourth embodiment of the present invention.

FIGS. 20 and 21 respectively show temperature detecting circuit arrangements in which the temperature detecting circuit arrangements in FIGS. 18, 19 are additionally provided with hysteresis characteristics. The first reference potential generating circuits 71, 75 and the second reference potential generating circuits 72, 76 are adapted such that the resistance means and the short-circuiting means so operate as to enable the potentials of output nodes of the circuits above-mentioned to be changed according to control signals C. These circuit arrangements in FIGS. 20, 21 additionally have respective hysteresis control circuits 79, 80 for generating the control signals C such that the temperature detecting characteristics are changed according to temperature detection outputs of the comparator circuits 73, 77.

Figure 22:
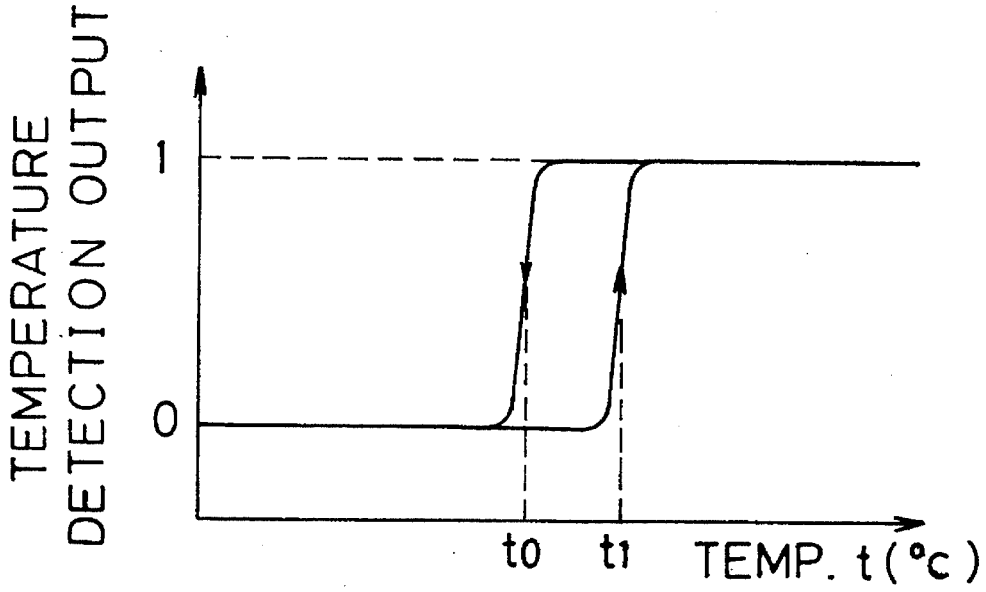
FIG. 22 is a graph illustrating the hysteresis characteristics of the temperature detecting circuit arrangement in FIG. 20.

FIG. 22 shows the characteristics of the temperature detecting circuit arrangement in FIG. 20. As apparent from FIG. 22, the hysteresis control circuit 79 operates such that temperature t1 where the temperature detection output is equal to 1, is different from temperature t0 where the temperature detection output is returned to 0. This prevents the temperature detecting circuit arrangement from being erroneously operated even though ambient temperature momentarily fluctuates. The temperature detecting circuit arrangement in FIG. 21 has hysteresis characteristics similar to those shown in FIG. 22.

[Fifth Embodiment (Power Supply Circuit Arrangement of the Active Voltage Control System)]

Figure 23:
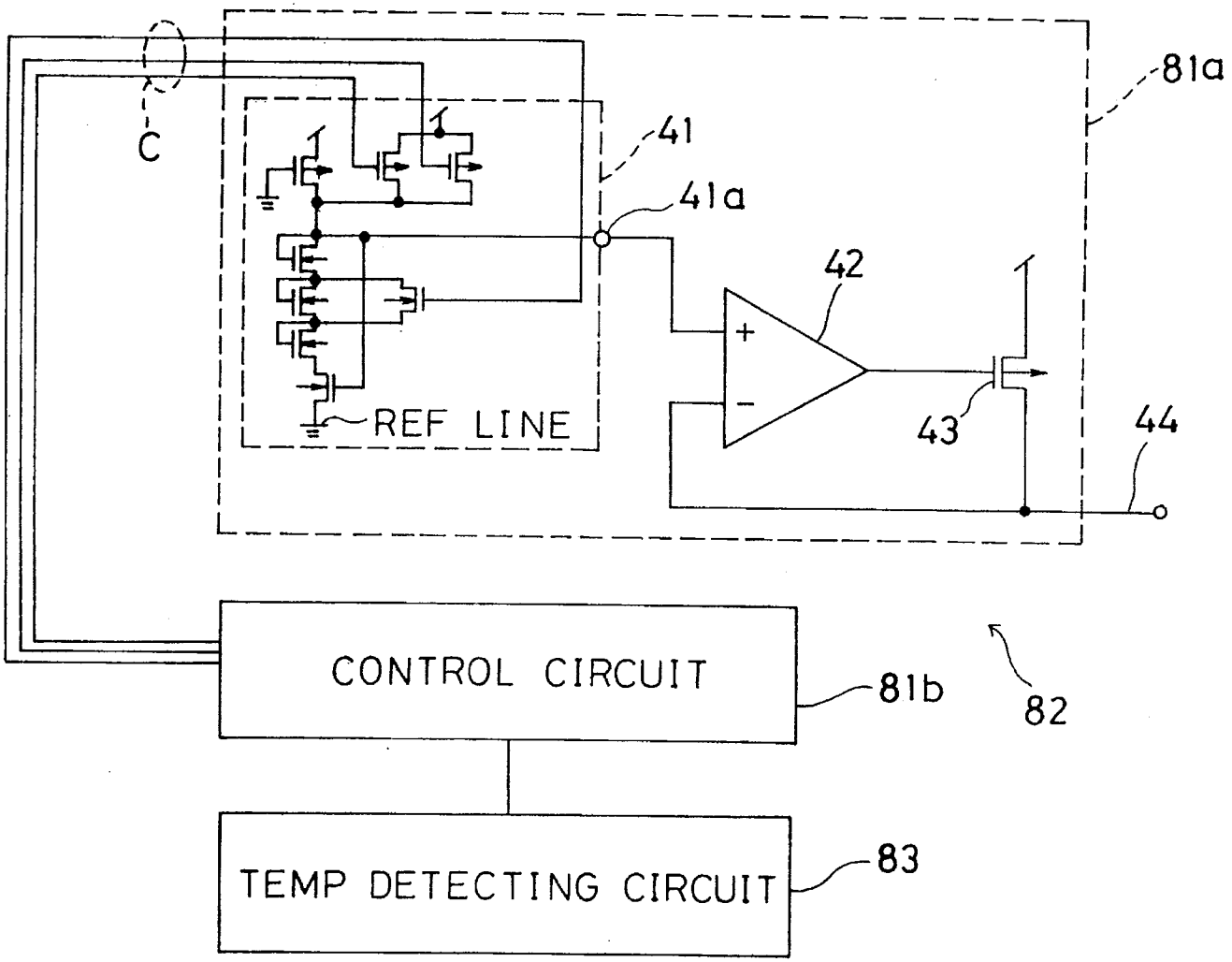
FIG. 23 is the circuit diagram of a first power supply circuit arrangement of the active control system according to a fifth embodiment of the present invention.
Figure 24:
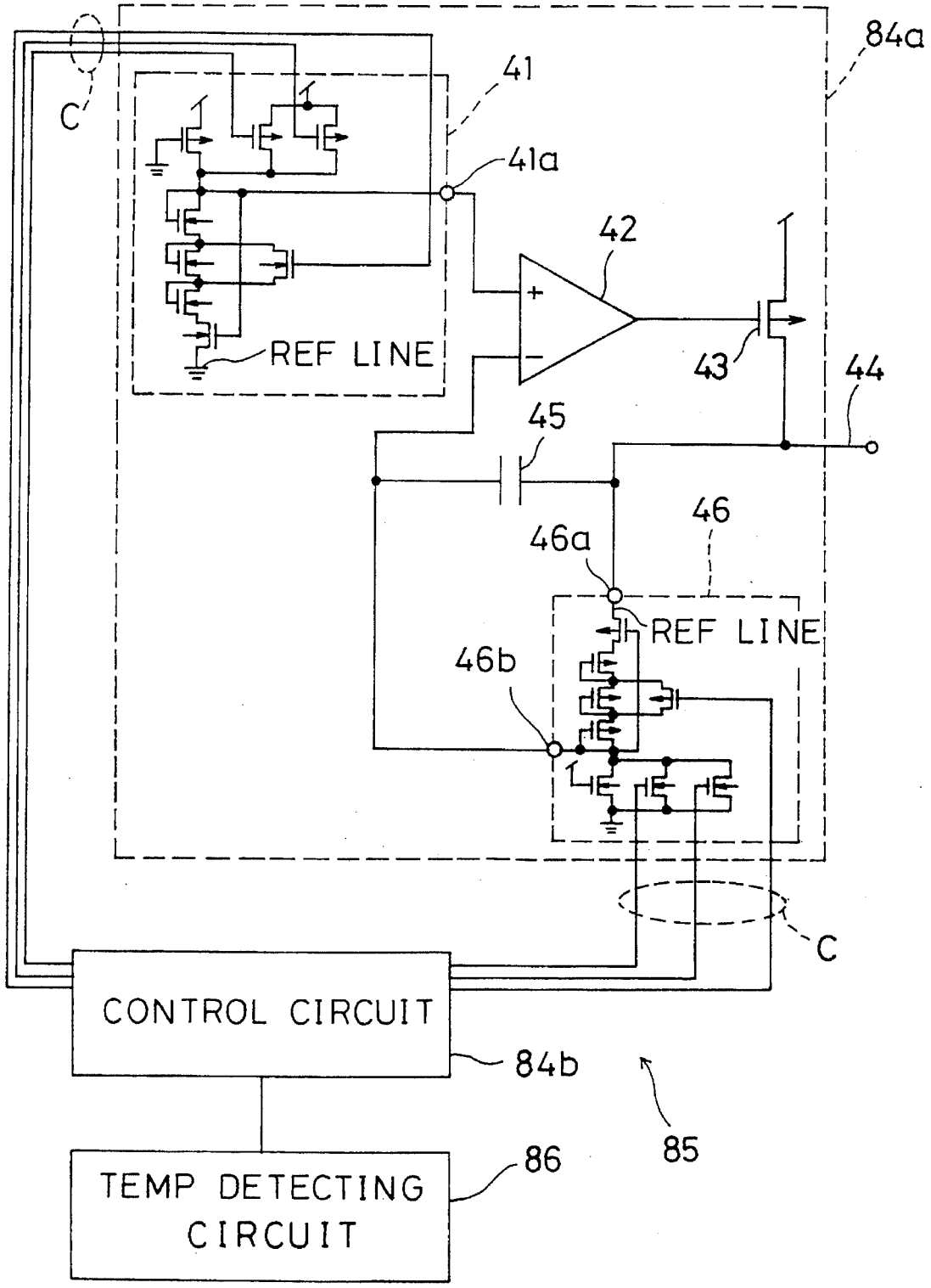
FIG. 24 is the circuit diagram of a second power supply circuit arrangement of the active control system according to the fifth embodiment of the present invention.
Figure 25:
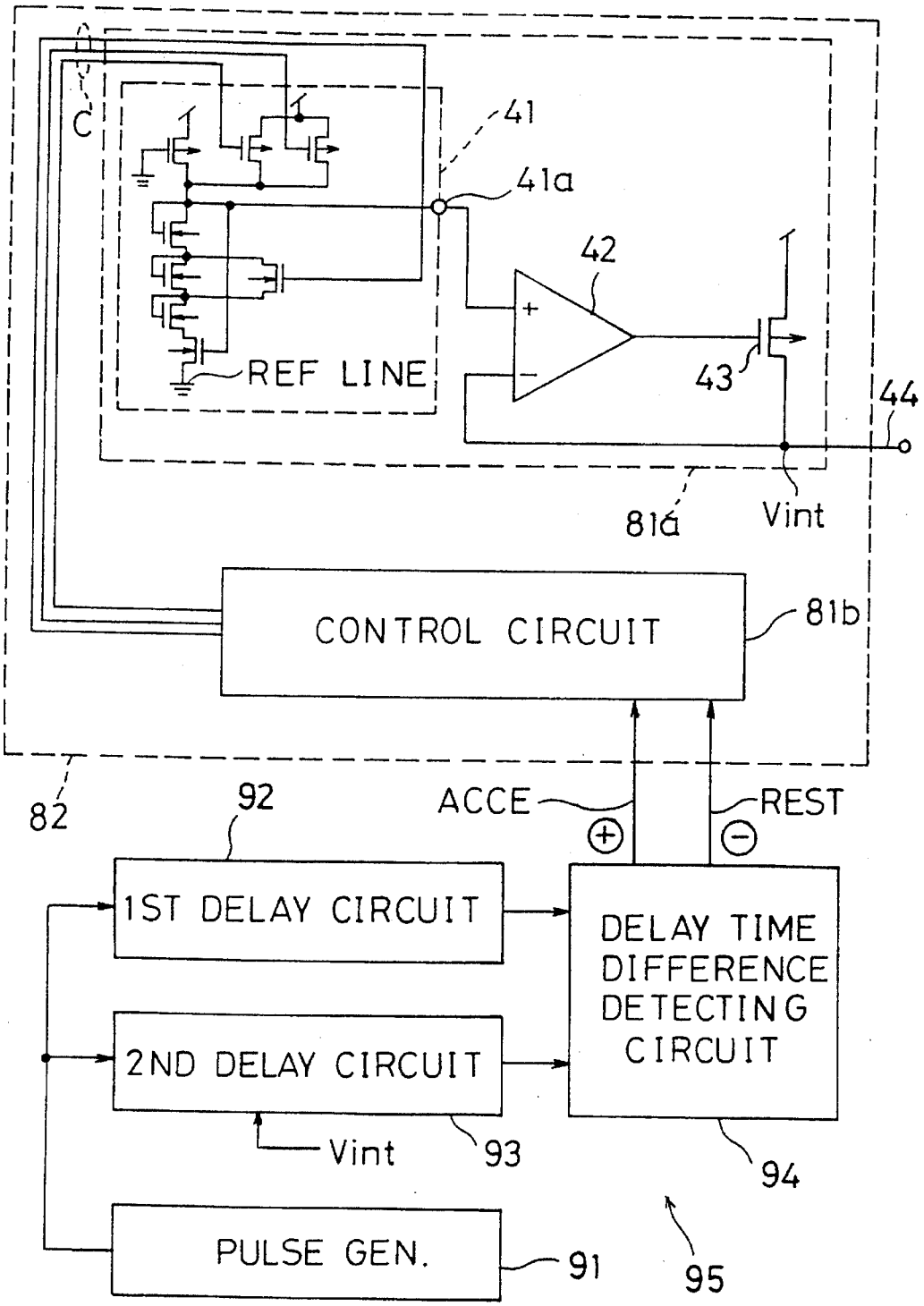
FIG. 25 is the circuit diagram of a third power supply circuit arrangement of the active control system according to the fifth embodiment of the present invention.

The following description will discuss power supply circuit arrangements of the active voltage control system according to a fifth embodiment of the present invention, with reference to FIGS. 23 to 25.

A conventional power supply circuit arrangement has been developed with the object of maintaining the output voltage constant regardless of variations of ambient temperature. However, the logic circuits of a semiconductor integrated circuit arrangement are generally delayed in operation if ambient temperature rises. Each of the power supply circuit arrangements of the active voltage control system according to the fifth embodiment, is adapted to increase the power supply voltage to prevent the logic circuits from being delayed in operation when ambient temperature rises.

(1) EXAMPLES 5.1 AND 5.2

(Temperature Control Type)

A power supply circuit arrangement in FIG. 23 employs a constant voltage generating circuit 81*a* identical with the circuit arrangement in FIG. 8 adapted such that the resistance means and the short-circuiting means so operate as to enable the potential of the output line 44 to be changed according to the control signals C. In the circuit arrangement in FIG. 23, a control circuit 81*b* for generating the control signals C is added to the constant voltage generating circuit 81*a*, thus forming a programmable constant voltage generating circuit arrangement 82. The control circuit 81*b* is adapted to be operated according to an output of a temperature detecting circuit 83.

A power supply circuit arrangement in FIG. 24, too, employs a constant voltage generating circuit 84*a* identical with the circuit arrangement in FIG. 11 adapted to enable the potential of the output line 44 to be changed according to the control signals C. In the circuit arrangement in FIG. 24, a control circuit 84*b* for generating the control signals C is added to the constant voltage generating circuit 84*a*, thus forming a programmable constant voltage generating circuit arrangement 85. The control circuit 84*b* is adapted to be operated according to an output of a temperature detecting circuit 86. As the temperature detecting circuits 83, 86, there may be used the circuit arrangements shown in FIGS. 18 to 21.

To increase the potential of the output line 44 according to a temperature rise, the power supply circuit arrangements in FIGS. 23, 24 are adapted to generate, according to temperatures detected by the temperature detecting circuits 83, 86, the control signals C to be supplied from the control circuits 81*b*, 84*b* to the constant voltage generating circuits 81*a*, 84*a*. However, the power supply circuit arrangements in FIGS. 23, 24 are adapted to conform, in qualitative tendency, temperature variations to power voltage variations, but are not adapted to clearly indicate to which extent the power voltage is to be increased according to a temperature rise. The following will discuss an arrangement improved in this point in the form of a power supply circuit arrangement of the active voltage control system of the delay time control type.

(2) EXAMPLE 5.3

(Delay Time Control Type)

In a power supply circuit arrangement in FIG. 25, the temperature detecting circuit 83 for controlling the programmable constant voltage generating circuit arrangement 82 in FIG. 23 is replaced with an active voltage control circuit arrangement 95 comprising a pulse generating circuit 91, a first delay circuit 92, a second delay circuit 93 and a delay time difference detecting circuit 94.

The pulse generating circuit 91 is adapted to divide system clock (RAS or the like in a DRAM), an internal refresh signal or the like to generate a pulse signal, which is then supplied to the first and second delay circuits 92, 93. The first delay circuit 92 is arranged such that the delay time of a pulse signal presents a small temperature dependency, and utilizes a resistance element and a capacitor element for delaying an output signal. Examples of the first delay circuit 92 presenting a small temperature dependency include the conventional CR delay circuit mentioned earlier. The second delay circuit 93 has, as a temperature monitor, a logical gate set such that the delay time of a pulse signal at a reference temperature (room temperature) is identical with that in the first delay circuit 92. The logical gate refers to a general logic circuit such as a NAND gate or the like used in the peripheral circuit block of a DRAM. The delay time difference detecting circuit 94 is adapted to detect a difference in delay time between the first and second delay circuits 92, 93. The delay time difference detecting circuit 94 has a function of supplying an accelerating signal when the delay time in the second delay circuit 93 is greater than that in the first delay circuit 92, and of supplying a restraining signal when the delay time in the second delay circuit 93 is smaller than that in the first delay circuit 92.

The programmable constant voltage generating circuit 82 has a reference potential generating circuit 41 adapted such that resistance means and short-circuiting means thereof so operate as to change the potential of an output node 41*a* thereof according to control signals C, thus enabling the potential of an output line 44 thereof to be changed, the output-line potentioal serving as a stabilized output voltage. The programmable constant voltage generating circuit 82 has a function of increasing the potential of the output line 44 each time the accelerating signal is received from the delay time difference detecting circuit 94, and of decreasing the potential of the output line 44 each time the restraining signal is received. The stabilized output voltage which is supplied, as an internal dropped voltage level Vint for example, from the programmable constant voltage generating circuit 82 to the output line 44, is supplied, as a power supply, to at least the second delay circuit 93.

The following description will discuss the operation of the power supply circuit arrangement in FIG. 25. When temperature rises, the delay time in the second delay circuit 93 is increased. On the other hand, the delay time in the first delay circuit 92 presenting a small temperature dependency, is not increased so much. This generates a difference in delay time between the first and second delay circuits 92, 93. The delay time difference detecting circuit 94 detects such a difference in delay time and then supplies, to the programmable constant voltage generating circuit 82, an accelerating signal for increasing the potential of the output line 44. This accelerating signal is supplied each time the pulse generating circuit 91 generates a pulse signal. Accordingly, the potential Vint of the output line 44 is increased to cancel an increase in delay time in the second delay circuit 93 to which the potential Vint is supplied as a power supply.

On the other hand, when the delay time in the second delay circuit 93 is decreased and becomes smaller than the delay time in the first delay circuit 92 presenting a small temperature dependency, a restraining signal is sent to the programmable constant voltage generating circuit 82 to lower the stabilized output voltage Vint on the output line 44. By a series of these operations, the stabilized output voltage Vint on the output line 44 is adjusted such that the delay time in the second delay circuit 93 is substantially equal to that in the first delay circuit 92. Consequently, the delay time in each of a plurality of logic circuits (not shown) using the voltage Vint as a power supply, can be maintained constant. With the use of such a power supply circuit arrangement of the active voltage control system, there can be achieved highly reliable semiconductor integrated circuit arrangements, to be discussed in the following.

The temperature detecting circuit 86 for controlling the programmable constant voltage generating circuit 85 in FIG. 24, may be replaced with a pulse generating circuit, first and second delay circuits and a delay time difference detecting circuit which are respectively similar to those shown in FIG. 25.

[Sixth Embodiment (Semiconductor Integrated Circuit Arrangement)]

The following description will discuss semiconductor integrated circuit arrangements according to a sixth embodiment of the present invention, with reference to FIGS. 26 to 39.

(1) EXAMPLE 6.1

(Semiconductor Integrated Circuit Arrangement with Delay Time Correcting Circuit: Delay Time Difference Detecting Circuit of the Logical Product Type)

Figure 26:
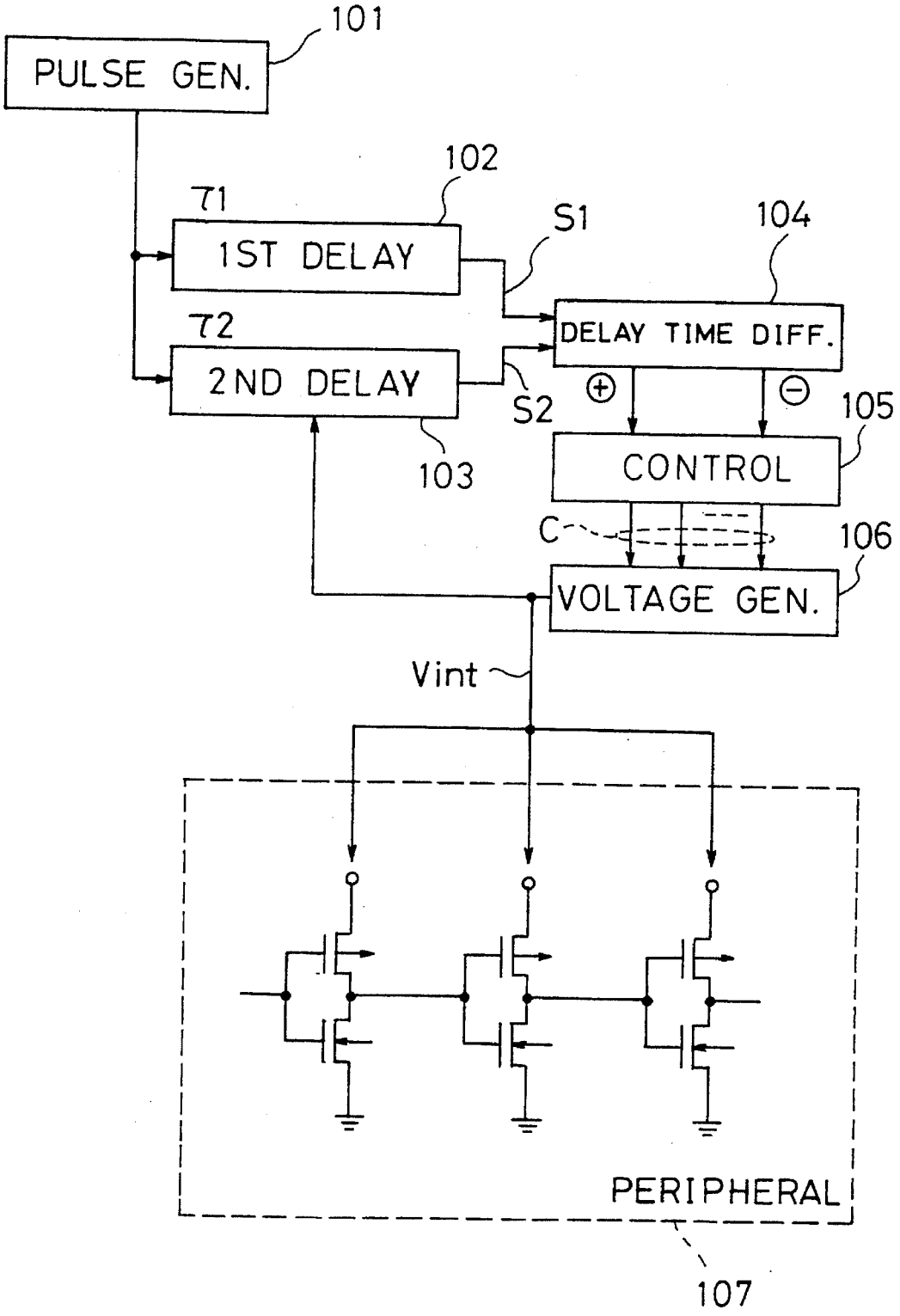
FIG. 26 is the circuit diagram of a first semiconductor integrated circuit arrangement according to a sixth embodiment of the present invention.

FIG. 26 shows a semiconductor integrated circuit arrangement to which the power supply circuit technology in FIG. 25 is applied. In FIG. 26, circuit blocks 101 to 106 respectively correspond to the pulse generating circuit 91, the first delay circuit 92 presenting a small temperature dependency, the second delay circuit 93 formed by logical gates, the delay time difference detecting circuit 94, the control circuit 81*b* and the constant voltage generating circuit 81*a* in FIG. 25. In the semiconductor integrated circuit arrangement in FIG. 26, an output voltage Vint of the constant voltage generating circuit block 106 is supplied, as a power supply voltage, to each of the second delay circuit block 103 and a peripheral circuit block 107. The peripheral circuit block 107 has a delay circuit formed by a normal inverter chain having a plurality of stages of inverters, each inverter comprising one P-type MOSFET and one N-type MOSFET only. The output voltage Vint of the constant voltage generating circuit block 106 is supplied, as a power supply voltage, to each of the inverters.

According to this arrangement, the output voltage Vint of the constant voltage generating circuit block 106 is changed until there is not observed a difference between a delay time τ1 in the first delay circuit block 102 and a delay time τ2 in the second delay circuit block 103, thus correcting a delay time in the inverter chain of the peripheral circuit block 107 to which the output voltage Vint is supplied as a power supply. More specifically, even though the peripheral circuit block 107 uses a delay circuit formed by a normal inverter chain, the delay circuit can be provided with delay characteristics presenting a small temperature dependency, and the peripheral circuit block 107 can be reduced in layout area as compared with an arrangement using the conventional CR delay circuit mentioned earlier. When importance is particularly set to the temperature characteristics of the pulse generating circuit block 101, an external pulse signal presenting a small temperature dependency may be supplied directly to the first and second delay circuit blocks 102, 103.

The following description will successively discuss in detail the arrangements of the delay time difference detecting circuit block 104, the control circuit block 105 and the constant voltage generating circuit block 106 in FIG. 26.

Figure 27:
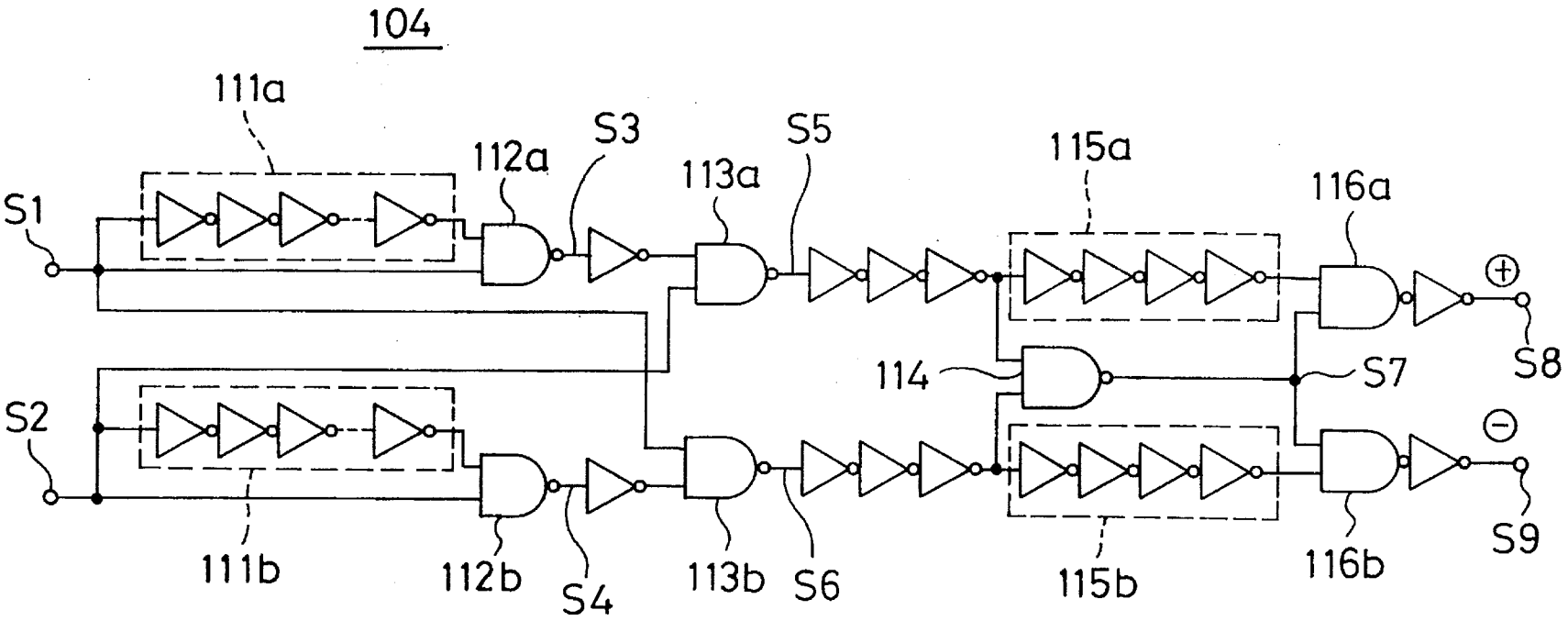
FIG. 27 is the circuit diagram of a delay time difference detecting circuit in FIG. 26.

FIG. 27 shows the arrangement of the delay time difference detecting circuit block 104. The delay time difference detecting circuit block 104 is adapted to receive, as input signals, an output signal S1 of the first delay circuit block 102 and an output signal S2 of the second delay circuit block 103, and comprises first delay circuit parts 111*a*, 111*b*, first NAND circuits 112*a*, 112*b*, second NAND circuits 113*a*, 113*b*, a third NAND circuit 114, second delay circuit parts 115*a*, 115*b* and fourth NAND circuits 116*a*, 116*b*. The first delay circuit parts 111*a*, 111*b* are formed by a plurality of stages of inverters for respectively delaying the input signals S1, S2, the number of inverter stages of the circuit part 111*a* being an odd number and the same as the number of inverter stages of the circuit part 111*b*. The first NAND circuits 112*a*, 112*b* are adapted to receive the input signals S1, S2 and output signals of the first delay circuit parts 111*a*, 111*b*. The second NAND circuits 113*a*, 113*b* are adapted to receive the input signals S1, S2 and the signals obtained by respectively inverting output signals S3, S4 of the first NAND circuits 112*a*, 112*b*. The third NAND circuit 114 is adapted to receive the signals obtained by respectively inverting output signals S5, S6 of the second NAND circuits 113*a*, 113*b*. The second delay circuit parts 115*a*, 115*b* are formed by a plurality of stages of inverters for delaying input signals of the third NAND circuit 114, the number of inverter stages of the circuit part 115*a* being an even number and the same as the number of inverter stages of the circuit part 115*b*. The fourth NAND circuits 116*a*, 116*b* are adapted to receive output signals of the second delay circuit parts 115*a*, 115*b* and an output signal S7 of the third NAND circuit 114. The fourth NAND circuits 116*a*, 116*b* are adapted to respectively supply first and second detection signals S8, S9 as the accelerating and restraining signals mentioned earlier.

Figure 28:
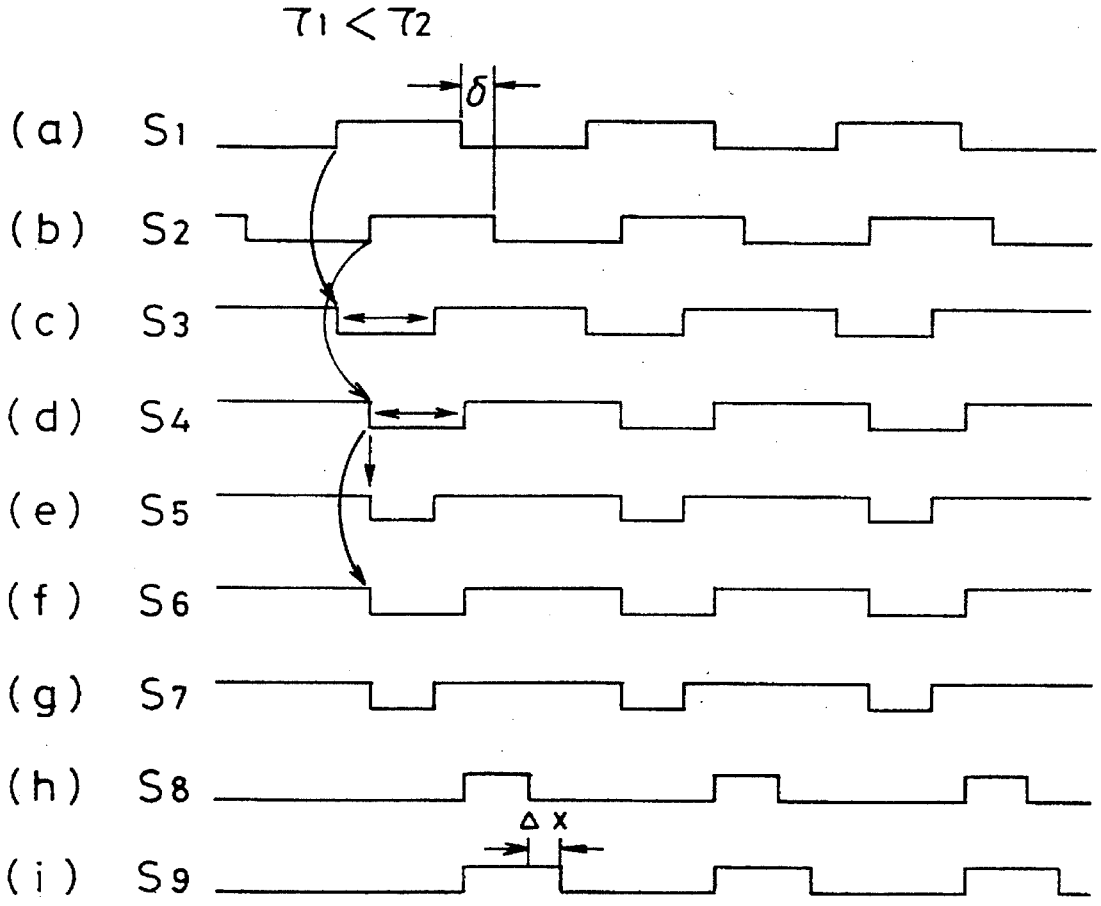
FIGS. 28 (*a*) to (*i*) is a timing chart illustrating signal waveforms at respective parts of the delay time difference detecting circuit in FIG. 27.

FIGS. 28 (*a*) to (*i*) shows a diagram of operational waveforms of the delay time difference detecting circuit block 104 where τ1 is smaller than τ2. The first delay circuit parts 111*a*, 111*b* and the first NAND circuits 112*a*, 112*b* generate, from the input signals S1, S2, the signals S3, S4 having the same pulse width. By the second NAND circuits 113*a*, 113*b*, the signals S3, S4 are converted into the signals S5, S6 having the same falling timing. The third NAND circuit 114 selects, as the signal S7, the signal S5 or S6 of which pulse width is smaller. The fourth NAND circuits 116*a*, 116*b* supply the first and second detection signals S8, S9 based on the signal S7. At this time, since the delay time τ2 in the second delay circuit block 103 is greater than the delay time τ1 in the first delay circuit block 102, the pulse width of the second detection signal S9 is greater than that of the first detection signal S8, and a difference Δx in pulse width between the detection signals S8, S9 is proportional to a difference in delay time δ between the input signals S1 and S2. However, the first and second detection signals S8, S9 rise at the same timing.

On the other hand, where τ1 is greater than τ2 (not shown), the first and second detection signals S8, S9 which rise at the same time, are supplied from the delay time difference detecting circuit block 104, and the pulse width of the second detection signal S9 is smaller than that of the first detection signal S8. As will be discussed later, the delay time difference detecting circuit block 104 so operates as to increase the output voltage Vint of the constant voltage generating circuit block 106 when the pulse width of the second detection signal S9 is greater, and to decrease the output voltage Vint when the pulse width of the first detection signal S8 is greater.

Figure 29:
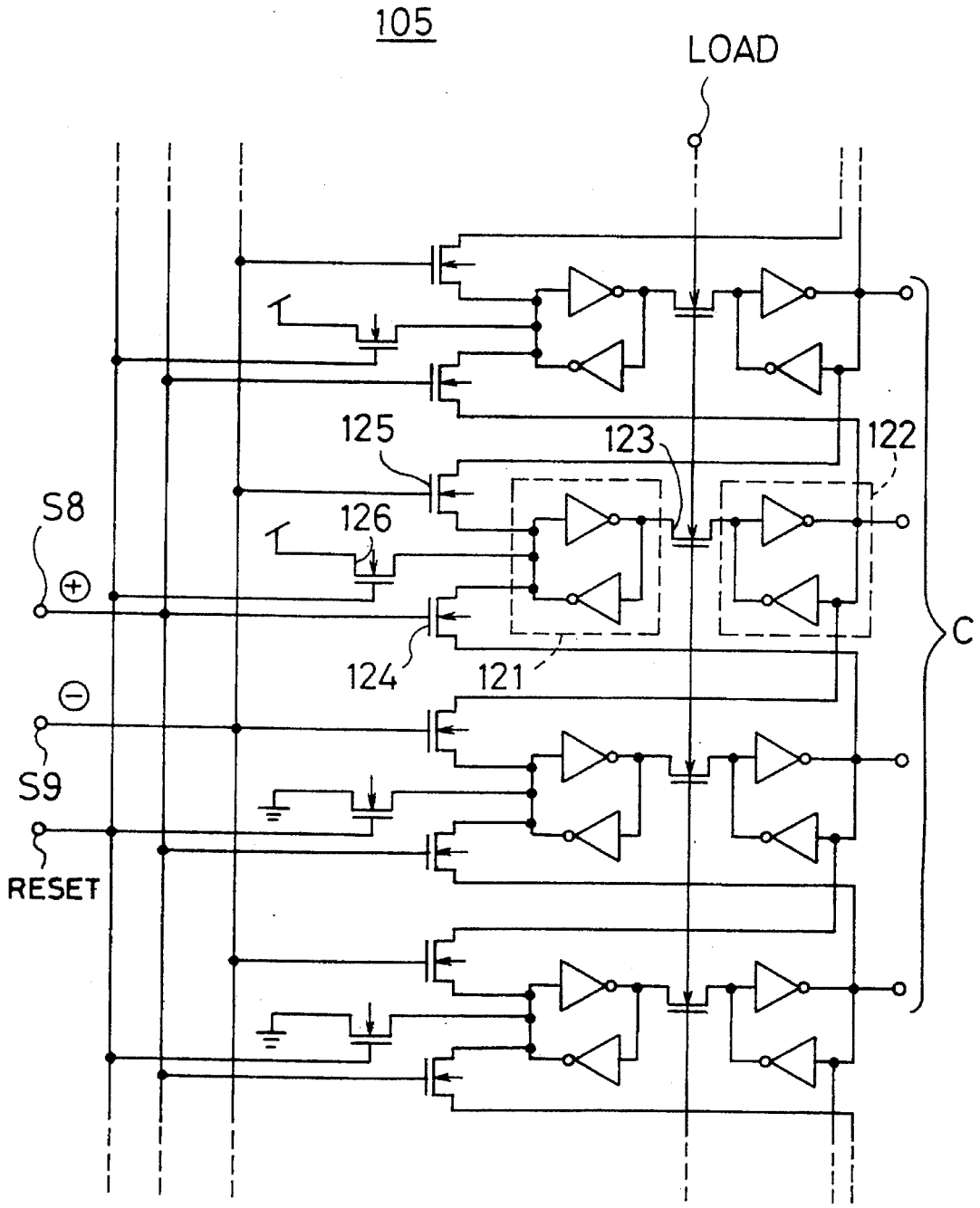
FIG. 29 is a circuit diagram illustrating the arrangement of a control circuit in FIG. 26.

FIG. 29 shows the arrangement of the control circuit block 105. The control circuit block 105 is adapted to receive, as input signals, the first and second detection signals S8, S9 from the delay time difference detecting circuit block 104, a LOAD signal and a RESET signal, and is made in the form of M-stage bidirectional shift registers. The shift register at each stage comprises first and second latch circuits 121, 122, and first to fourth switching elements 123 to 126 each comprising an N-type MOSFET. At each stage, the first switching element 123 is interposed between the output side of the first latch circuit 121 and the input side of the second latch circuit 122, and has the gate to which the LOAD signal is applied. At each stage, the second switching element 124 is interposed between the input side of the first latch circuit 121 and the output side of the second latch circuit 122 at the immediately lower stage, and has the gate to which the first detection signal S8 is applied. At each stage, the third switching element 125 is interposed between the input side of the first latch circuit 121 and the output side of the second latch circuit 122 at the immediately upper stage, and has the gate to which the second detection signal S9 is applied. At each of the upper-half stages, the fourth switching element 126 is disposed between the input side of the first latch circuit 121 and a power supply line (VCC: external power supply voltage level). At each of the lower-half stages, the fourth switching element 126 is disposed between the input side of the first latch circuit 121 and the earth line (VSS: earth potentil). The RESET signal is applied to the gate of each fourth switching element 126.

According to the arrangement above-mentioned, the RESET signal opens the fourth switching elements 124 at all the stages, and the pulse of the LOAD signal opens the first switching elements 123 at all the stages. Accordingly, the first and second latch circuits 121, 122 at all the stages are initially set. The second latch circuits 122 at the upper-half stages supply logical signals in HIGH, and the second latch circuits 122 at the lower-half stages supply logical signals in LOW. M-piece logical signals held by the second latch circuits 122 serve as the initial signals of control signals C to be supplied to the constant voltage generating circuit block 106.

After the RESET signal has been set inactive, the delay time difference detecting circuit block 104 supplies the first and second detection signals S8, S9 of which rising timings are identical with each other. For example, when τ1 is smaller than τ2 and the second detection signal S9 is therefore greater in pulse width than the first detection signal S8 as shown in FIGS. 28 (*h*) and (*i*), the first detection signal S8 is changed in state to LOW prior to the second detection signal S9, so that the output of the second latch circuit 122 at the lowest stage of the upper-half stages is changed into a logical signal in LOW. More specifically, where τ1 is smaller than τ2, the number of LOW signals out of the M-piece logical signals forming the control signals C is increased as the pulse of the LOAD signal is supplied successively to the first switching elements 123. On the other hand, where τ1 is greater than τ2, the number of HIGH logical signals is increased.

Figure 30:
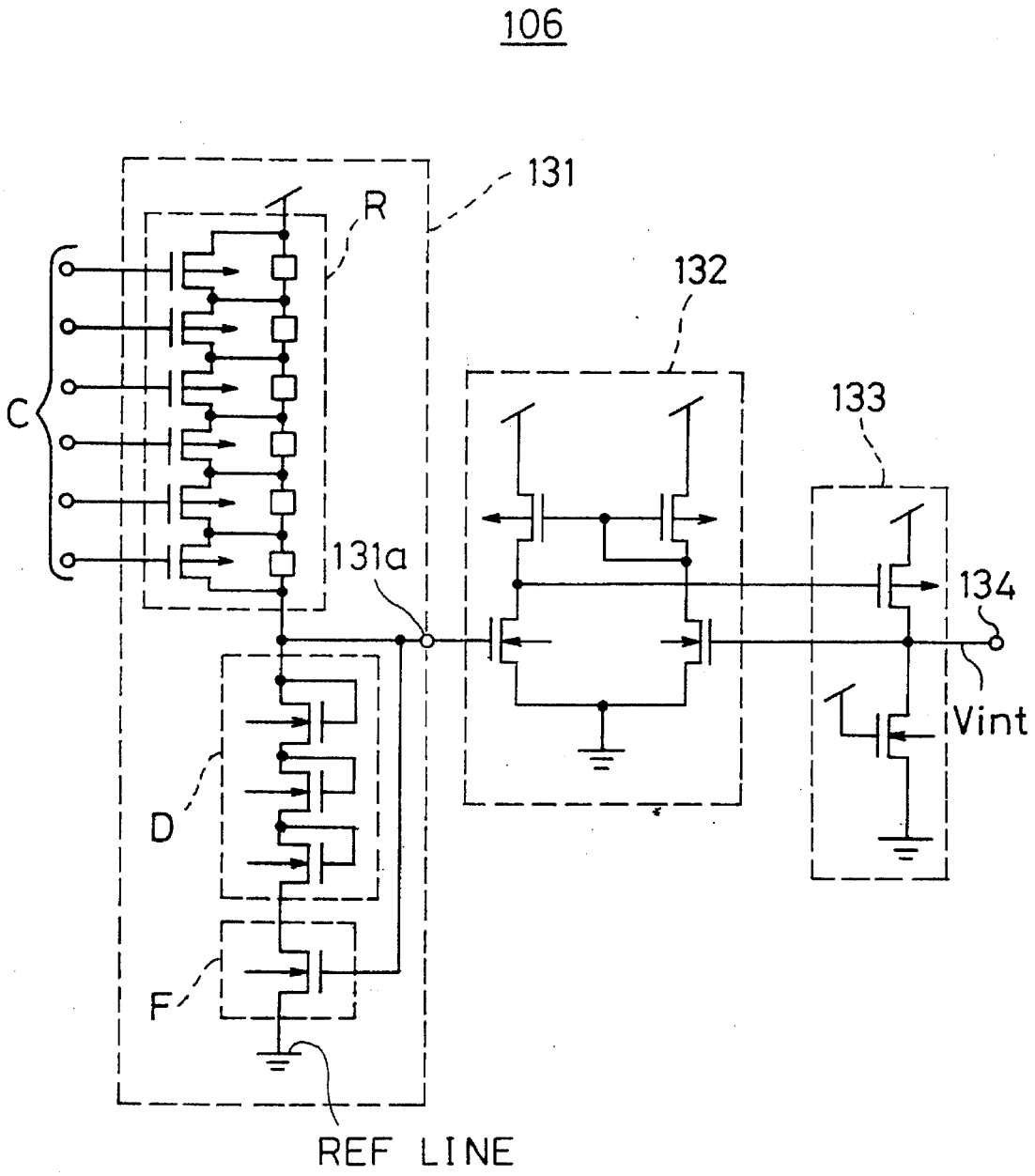
FIG. 30 is a circuit diagram illustrating the arrangement of a constant voltage generating circuit in FIG. 26.

FIG. 30 shows the arrangement of the constant voltage generating circuit block 106. The constant voltage generating circuit block 106 is adapted to receive, as input signals, the control signals C from the control circuit block 105, and comprises a reference potential generating circuit 131, a comparator circuit 132 and a driver circuit 133 likewise in FIG. 8. The constant voltage generating circuit block 106 is adapted to change the potential of an output line 134 (Vint: internal dropped voltage level) thereof according to the control signals C. The reference potential generating circuit 131 is adapted to generate a predetermined difference in potential between the earth line serving as a reference potential line and an output node 131*a* thereof, and comprises resistance means R, feedback means F and diode means D. M-piece resistance elements so connected in series to one another as to form the resistance means R, are interposed between a power supply line (VCC: external power supply voltage level) thereof and the output node 131*a*. To short-circuit each resistance element across both terminals thereof, a P-type MOSFET is connected in parallel to each resistance element. Applied to the gates of the P-type MOSFETs are M-piece logical signals forming the control signals C supplied from the control circuit block 105. The N-type MOSFET forming the feedback means F is arranged such that the gate thereof is connected to the output node 131*a* and the source thereof is connected to the earth line (VSS: earth potential). Another three N-type MOSFETs so connected in series to one another as to form the diode means D, are interposed between the drain of the N-type MOSFET of the feedback means F and the output node 131*a*. The comparator circuit 132 serving as a current mirror-type differential amplifier, comprises two P-type MOSFETs and two N-type MOSFETs, and is adapted to compare the potential of the output node 131*a* of the reference potential generating circuit 131 and the potential of the output line 134. The driver circuit 133 for driving the output line 134 comprises (i) a P-type MOSFET having the gate to which an output of the comparator circuit 132 is applied, and (ii) a normally-ON N-type MOSFET.

According to the arrangement above-mentioned, when τ1 is smaller than τ2 and therefore the number of the LOW logical signals out of the control signals C supplied from the control circuit block 105 is increased, the potential of the output node 131*a* in the reference potential generating circuit 131 is increased. This results in an increase in output voltage Vint so as to reduce the delay time τ2 in the second delay circuit block 103. On the other hand, where τ1 is greater than τ2, the number of HIGH logical signals is increased. This results in an decrease in output voltage Vint so as to increase the delay time τ2 in the second delay circuit block 103. More specifically, the output voltage Vint is so changed as to eliminate a difference in delay time between the first and second delay circuit blocks 102, 103.

(2) EXAMPLE 6.2

(Semiconductor Integrated Circuit Arrangement with Delay Time Correcting Circuit: Delay Time Difference Detecting Circuit of the Logical Sum Type)

Figure 31:
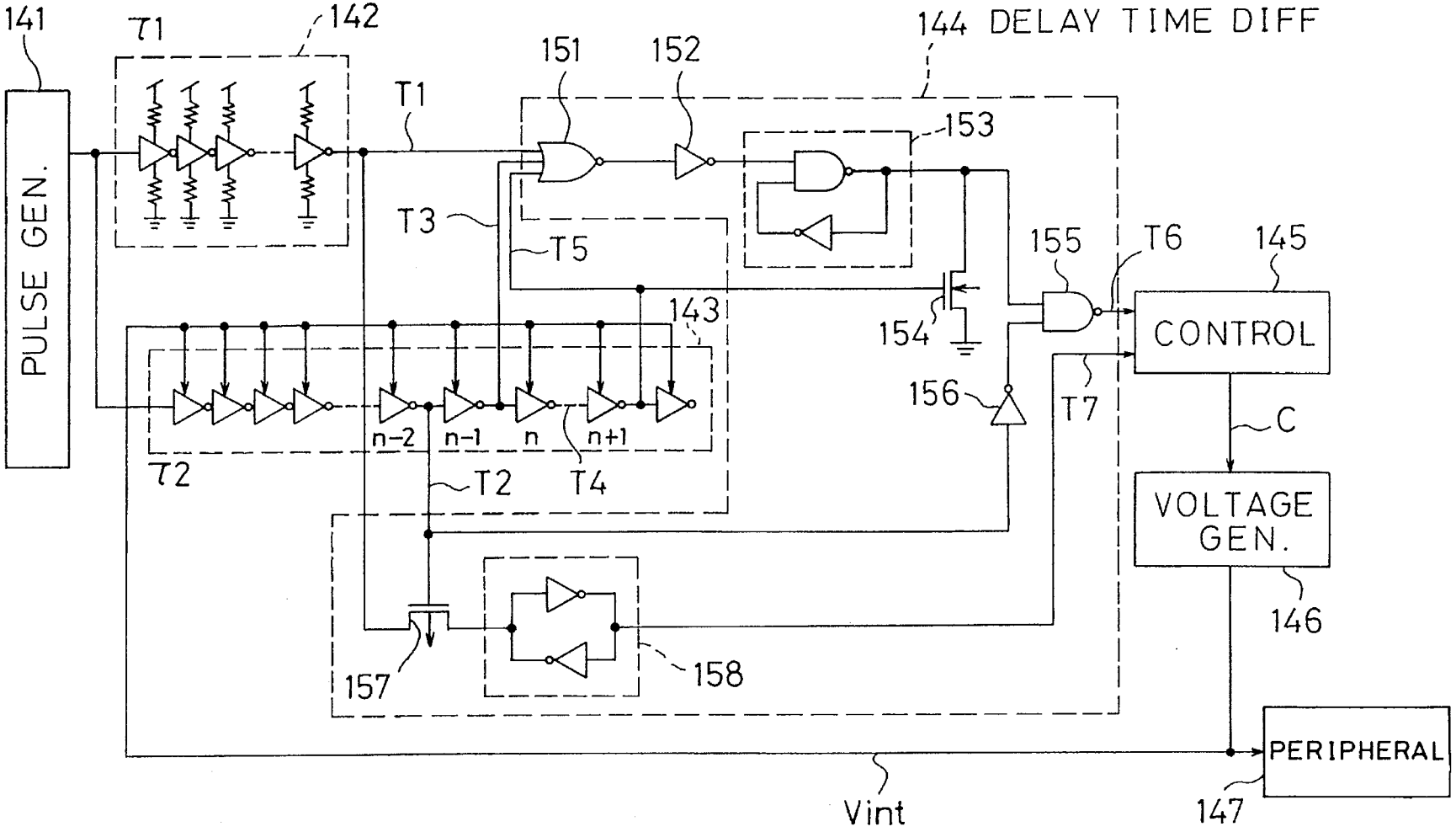
FIG. 31 is the circuit diagram of a second semiconductor integrated circuit arrangement according to the sixth embodiment of the present invention.

An arrangement in FIG. 31 is adapted to detect the presence or absence of a difference in delay time with the use of one signal supplied from a first delay circuit block and two signals which are supplied from a second delay circuit block and of which phases are different from each other. In FIG. 31, there are disposed a pulse generating circuit block 141, a first delay circuit block 142, a second delay circuit block 143, a delay time difference detecting circuit block 144, a control circuit block 145, a constant voltage generating circuit block 146 and a peripheral circuit block 147, these circuit blocks respectively corresponding to the circuit blocks 101 to 107 in FIG. 26.

The second delay circuit block 143 comprises a normal inverter chain having a plurality of stages of inverters, the number of the stages being not less than (n+2). A delay time 2 in the second delay circuit block 143 is determined by an output signal T4 of the nth-stage inverter serving as a reference signal. The temperature dependencies of the delay characteristics of the first and second delay circuit blocks 142, 143 are set such that the delay time τ2 is equal to a delay time τ1 in the first delay circuit block 142 at a reference temperature. While only one output signal T1 is derived from the first delay circuit block 142, the second delay circuit block 143 supplies three signals, i.e., an output signal of the (n−2)th-stage inverter T2 (auxiliary output signal), an output signal of the (n−1)th-stage inverter T3 (first output signal) and an output signal of the (n+1)th-stage inverter T5 (second output signal).

The delay time difference detecting circuit block 144 comprises a three-input NOR circuit 151, a first inverter 152, a first latch circuit 153, a first switching element 154 formed by an N-type MOSFET, a NAND circuit 155, a second inverter 156, a second switching element 157 formed by a P-type MOSFET, and a second latch circuit 158. The NOR circuit 151 is adapted to receive, as input signals, the output signal T1 of the first delay circuit block 142 and the first and second output signals T3, T5 of the second delay circuit block 143. The first inverter 152 is adapted to supply, to the input side of the first latch circuit 153, the signal obtained by inverting an output signal of the NOR circuit 151. The first switching element 154 is interposed between the output side of the first latch circuit 153 and the earth line. The second output signal T5 of the second delay circuit block 143 is applied to the gate of the first switching element 154 to initialize the first latch circuit 153. The NAND circuit 155 is adapted to receive, as input signals, an output signal of the first latch circuit 153 and the signal obtained by inverting the auxiliary output signal T2 of the second delay circuit block 143 by the second inverter 156, and to supply a first detection signal T6 representing the presence or absence of a difference between the delay time τ1 in the first delay circuit block 142 and the delay time τ2 in the second delay circuit block 143. The second switching element 157 is interposed between the output side of the first delay circuit block 142 and the input side of the second latch circuit 158. The auxiliary output signal T2 supplied from the second delay circuit block 143 is applied to the gate of the second switching element 157. The second latch circuit 158 is adapted to supply a second detection signal T7 representing which delay time is greater, out of the delay times in the first and second delay circuit blocks 142, 143. The first and second detection signals T6, T7 supplied from the delay time difference detecting circuit block 144 having the arrangement above-mentioned, are supplied, as the accelerating and restraining signals, to the control circuit block 145.

Figure 32:
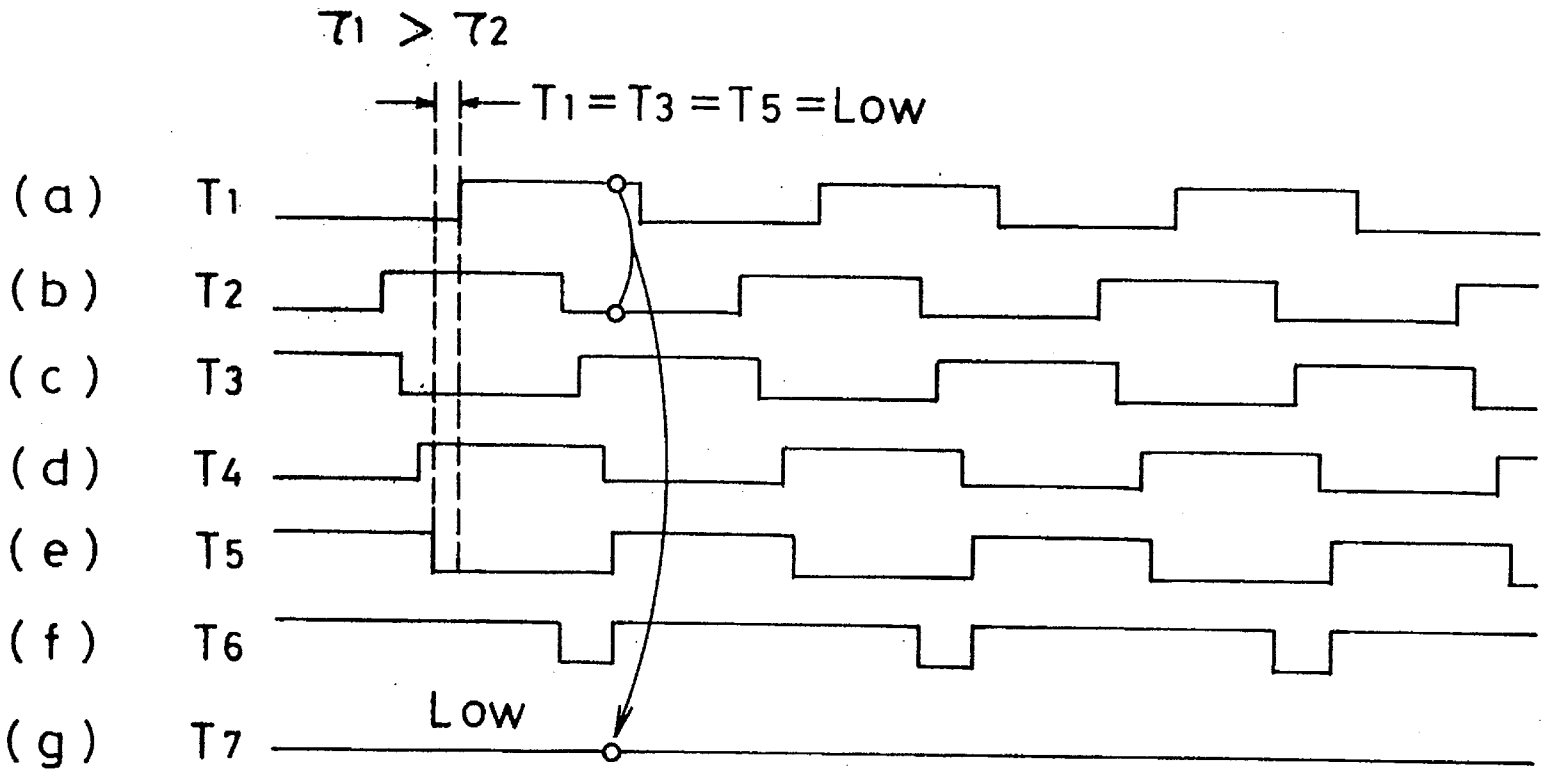
FIGS. 32 (*a*) to (*g*) is a timing chart illustrating signal waveforms at respective parts in FIG. 31 where $\tau 1$ is greater than $\tau 2$.
Figure 33:
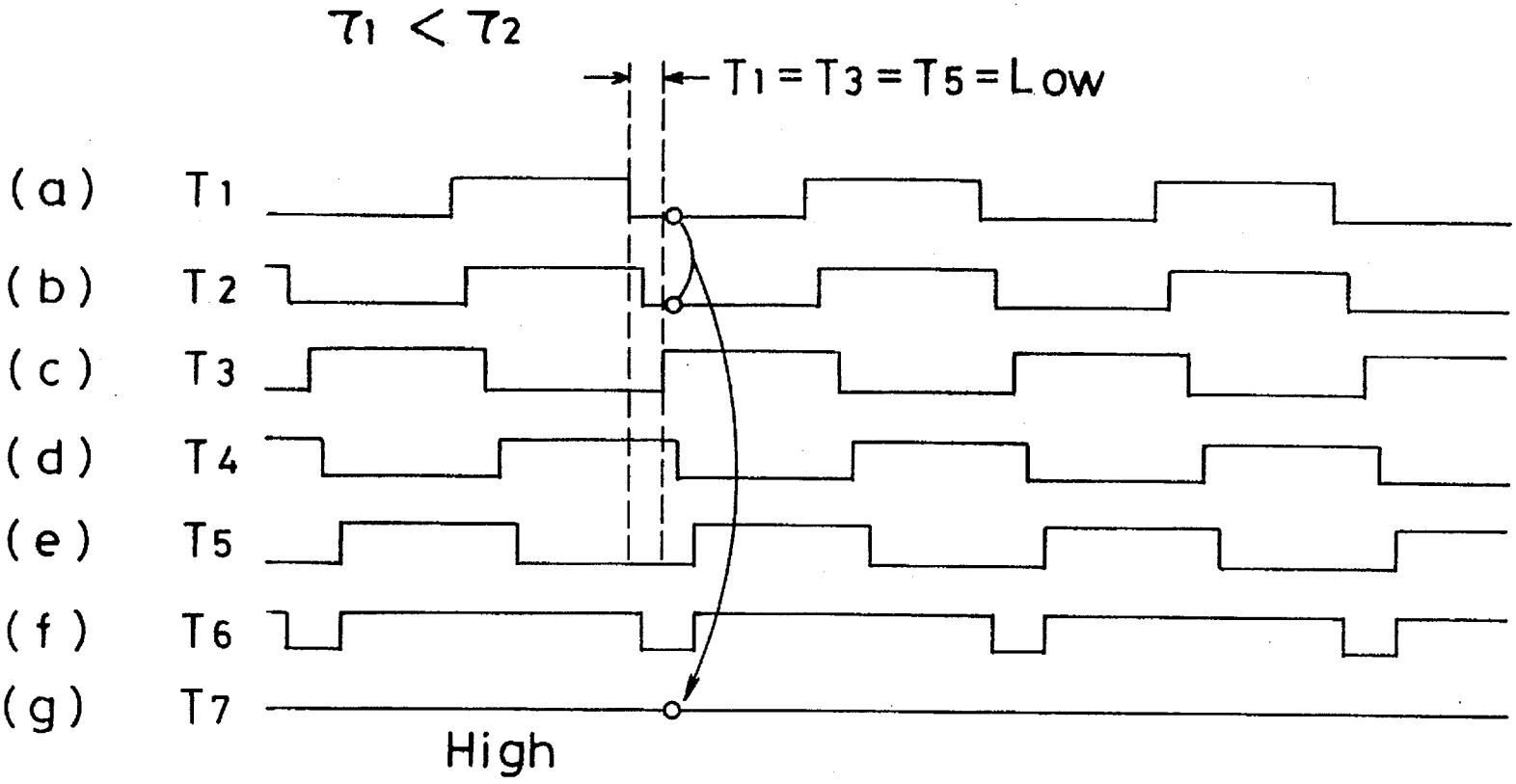
FIGS. 33 (*a*) to (*g*) is a view similar to FIGS. 32 (*a*) to (*g*) , where $\tau 1$ is smaller than $\tau 2$.

FIGS. 32 (*a*) to (*g*) shows a diagram of operational waveforms of the delay time difference detecting circuit block 144 where τ1 is greater than τ2. FIGS. 33 (*a*) to (*g*) is a diagram similar to that in FIG. 32, where τ1 is smaller than τ2. The output of the first latch circuit 153 is initialized to LOW when the second output signal T5 of the second delay circuit block 143 becomes HIGH to turn on the first switching element 154. As a result, the first detection signal T6 becomes HIGH. When there is a period of time during which the output signal T1 of the first delay circuit block 142 and the first and second output signals T3, T5 of the second delay circuit block 143 become LOW simultaneously, the NOR circuit 151 recognizes that there is a difference between the delay time τ1 in the first delay circuit block 142 and the delay time τ2 in the second delay circuit block 143. This causes the output of the first latch circuit 153 to be changed in state from LOW to HIGH. Accordingly, as shown in FIG. 32 (*f*) and FIG. 33 (*f*), the first detection signal T6 is changed from HIGH to LOW. The first detection signal T6 once changed to LOW in the manner above-mentioned, is held as LOW by the first latch circuit 153 until the second output signal T5 is changed to HIGH to again turn on the first switching element 154. When there is no instances where the three input signals T1, T3, T5 of the NOR circuit 151 become LOW simultaneously, the first detection signal T6 is never changed to LOW but held as HIGH at all times.

On the other hand, when the output signal T1 of the first delay circuit block 142 is HIGH at the time when the auxiliary output signal T2 of the second delay circuit block 143 is changed from HIGH to LOW as shown in FIGS. 32 (*a*) and (*b*), the second latch circuit 158 sets the second detection signal T7 to LOW such that there is informed, to the control circuit block 145, a judgment that the delay time τ2 in the second delay circuit block 143 is smaller than the delay time τ1 in the first delay circuit block 142 (τ1 is greater than τ2). On the other hand, when the output signal T1 of the first delay circuit block 142 is LOW at the time when the auxiliary output signal T2 is changed from HIGH to LOW as shown in FIGS. 33 (*a*) and (*b*), the second detection signal T7 is set to HIGH so as to inform that τ1 is smaller than τ2.

When the second detection signal T7 is LOW representing that τ1 is greater than τ2 at the time when the control circuit block 145 receives a LOW pulse as the first detection signal T6, the control circuit block 145 supplies the control signals C to the constant voltage generating circuit block 146 so as to lower its output voltage Vint. When the second detection signal T7 is HIGH representing that τ1 is smaller than τ2 at the time when the control circuit block 145 receives a LOW pulse as the first detection signal T6, the control circuit block 145 supplies the control signals C so as to increase the output voltage Vint. When the first detection signal T6 is held as HIGH, changing the output voltage Vint is stopped. Thus, the delay time in the peripheral circuit block 147 using, as a power supply, the output voltage Vint of the constant voltage generating circuit block 146, can be corrected by changing the output voltage Vint until there is observed no difference between the delay time τ1 in the first delay circuit block 142 and the delay time τ2 in the second delay circuit block 143.

The arrangement in FIG. 31 utilizes, as reference signals for the output signal T1 of the first delay circuit block 142, the output signal T3 of the (n−1)th-stage inverter in the second delay circuit block 143 and the output signal T5 of the (n+1)th-stage inverter therein. Accordingly, the presence or absence of a difference in delay time is detected with a certain range of dead zone. This prevents the output voltage Vint of the constant voltage generating circuit block 146 from fluctuating. The range of the dead zone can be optionally changed dependent on two reference signals selected from the output signals of the second delay circuit block 143. The auxiliary output signal used for ON/OFF control of the second switching element 157 is not limited to the output signal T2 of the (n−2)th-stage inverter, as far as the logical level of the second detection signal T7 can be set by the pulse output timing of the first detection signal T6.

(3) EXAMPLE 6.3

(Semiconductor Integrated Circuit Arrangement with Delay Time Correcting Circuit: Delay Time Difference Detecting Circuit of the Flip-Flop Type)

Figure 34:
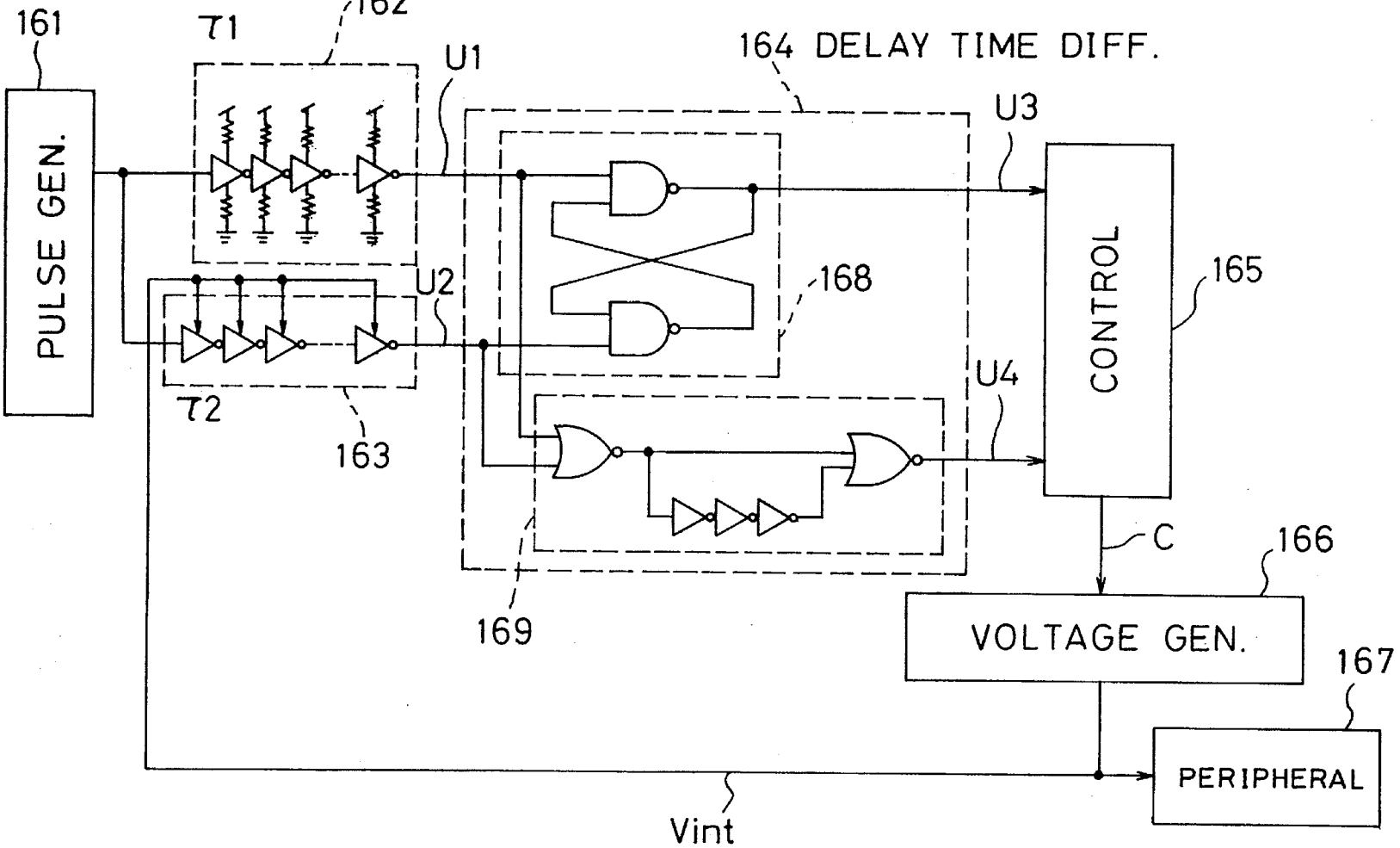
FIG. 34 is the circuit diagram of a third semiconductor integrated circuit arrangement according to the sixth embodiment of the present invention.

An arrangement in FIG. 34 is adapted to detect the presence or absence of a difference in delay time with the use of one signal supplied from a first delay circuit block and one signal supplied from a second delay circuit block. In FIG. 34, there are disposed a pulse generating circuit block 161, a first delay circuit block 162, a second delay circuit block 163, a delay time difference detecting circuit block 164, a control circuit block 165, a constant voltage generating circuit block 166 and a peripheral circuit block 167, these blocks respectively corresponding to the circuit blocks 101 to 107 in FIG. 26.

The delay time difference detecting circuit block 164 has a flip-flop 168 and a monostable multivibrator 169. The flip-flop 168 comprises two NAND circuits, and is adapted to receive, as input signals, output signals U1, U2 of the first and second delay circuit blocks 162, 163, and to supply a first detection signal U3 representing which delay time is greater, out of the delay times in the first and second delay circuit blocks 162, 163. The monostable multivibrator 169 comprises two NOR circuits and three inverters, and is adapted to receive, as input signals, the output signals U1, U2 of the first and second delay circuit blocks 162, 163, and to supply a second detection signal U4 representing the presence or absence of a difference between the delay time τ1 in the first delay circuit block 162 and the delay time τ2 in the second delay circuit block 163. The first and second detection signals U3, U4 supplied from the delay time difference detecting circuit block 164 having the arrangement above-mentioned, are supplied, as the accelerating and restraining signals mentioned earlier, to the control circuit block 165.

Figure 35:
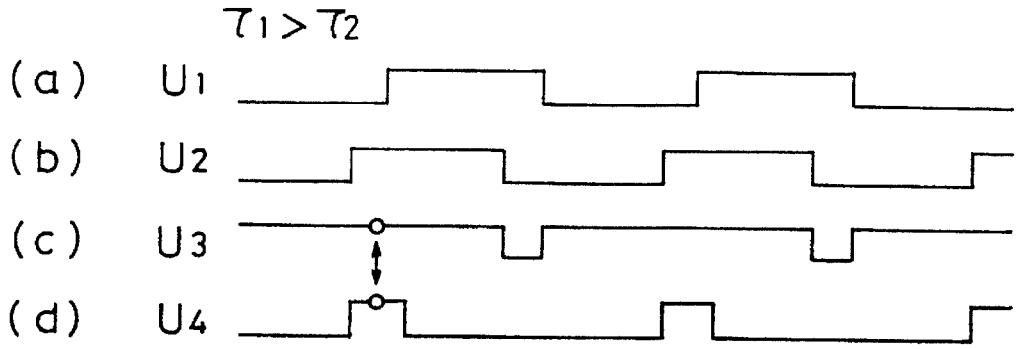
FIGS. 35 (*a*) to (*d*) is a timing chart illustrating input/output signal waveforms of a delay time difference detecting circuit in FIG. 34 where $\tau 1$ is greater than $\tau 2$.
Figure 36:
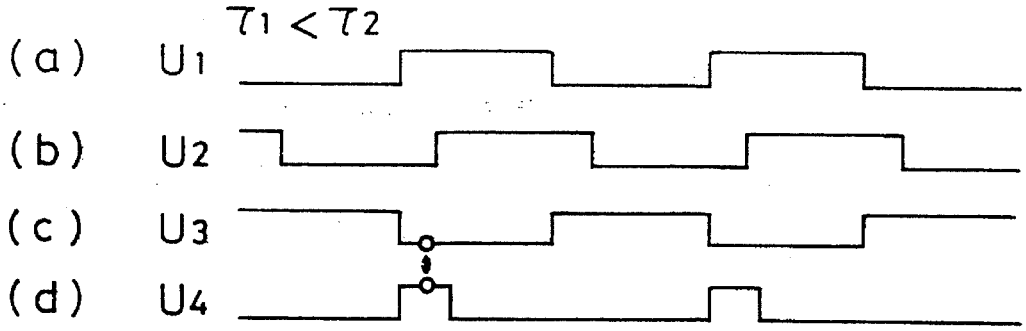
FIGS. 36 (*a*) to (*d*) is a view similar to FIGS. 35 (*a*) to (*d*), where $\tau 1$ is smaller than $\tau 2$.

FIGS. 35 (*a*) to (*d*) shows a diagram of operational waveforms of the delay time difference detecting circuit block 164 where τ1 is greater than τ2. FIGS. 36 (*a*) to (*d*) is a diagram similar to that in FIG. 35, where τ1 is smaller than τ2. When the two input signals U1, U2 are LOW, the flip-flop 168 causes the first detection signal U3 to be HIGH. At the point where the signal U2 is changed from LOW to HIGH prior to the signal U1 as shown in FIGS. 35 (*a*) and (*b*), the first detection signal U3 is maintained as HIGH. On the contrary, at the point when the signal U1 is changed from LOW to HIGH prior to the signal U1 as shown in FIGS. 36 (*a*) and (*b*), the flip-flop 168 effects an amplifying function to cause the first detection signal U3 to be rapidly changed to LOW. To determin the activating timing of the control circuit block 165, the monostable multivibrator 169 generates, as the second detection signal U4, a HIGH pulse signal having a predetermind width from the rising point of one signal, out of the two input signals U1, U2, which has been changed to HIGH prior to the other signal. More specifically, the delay time difference detecting circuit block 164 having the arrangement in FIG. 34, can detect a small difference in delay time between the first and second delay circuit blocks 162, 163, with the use of the flip-flop 168 and the monostable multivibrator 169.

When the first detection signal U3 is HIGH representing that τ1 is greater than τ2 at the time when the control circuit block 165 receives a HIGH pulse as the second detection signal U4, the control circuit block 165 is adapted to supply control signals C to the constant voltage generating circuit block 166 so as to lower its output voltage Vint. When the first detection signal U3 is LOW representing that τ1 is smaller than τ2 at the time the control circuit block 165 receives a HIGH pulse as the second detection signal U4, the control circuit block 165 is adapted to supply the control signals C so as to increase the output voltage Vint. When the second detection signal U4 is maintained as LOW because of no difference in delay time, changing the output voltage Vint is stopped. Thus, the delay time in the peripheral circuit block 167 using, as a power supply, the output voltage Vint of the constant voltage generating circuit block 166, can be corrected by changing the output voltage Vint until there is observed no difference between the delay time τ1 in the first delay circuit block 162 and the delay time τ2 in the second delay circuit block 163.

(4) EXAMPLE 6.4

(Semiconductor Integrated Circuit Arrangement with Delay Time Correcting Circuit: Example of Application to Ring Oscillator Unit)

Figure 37:
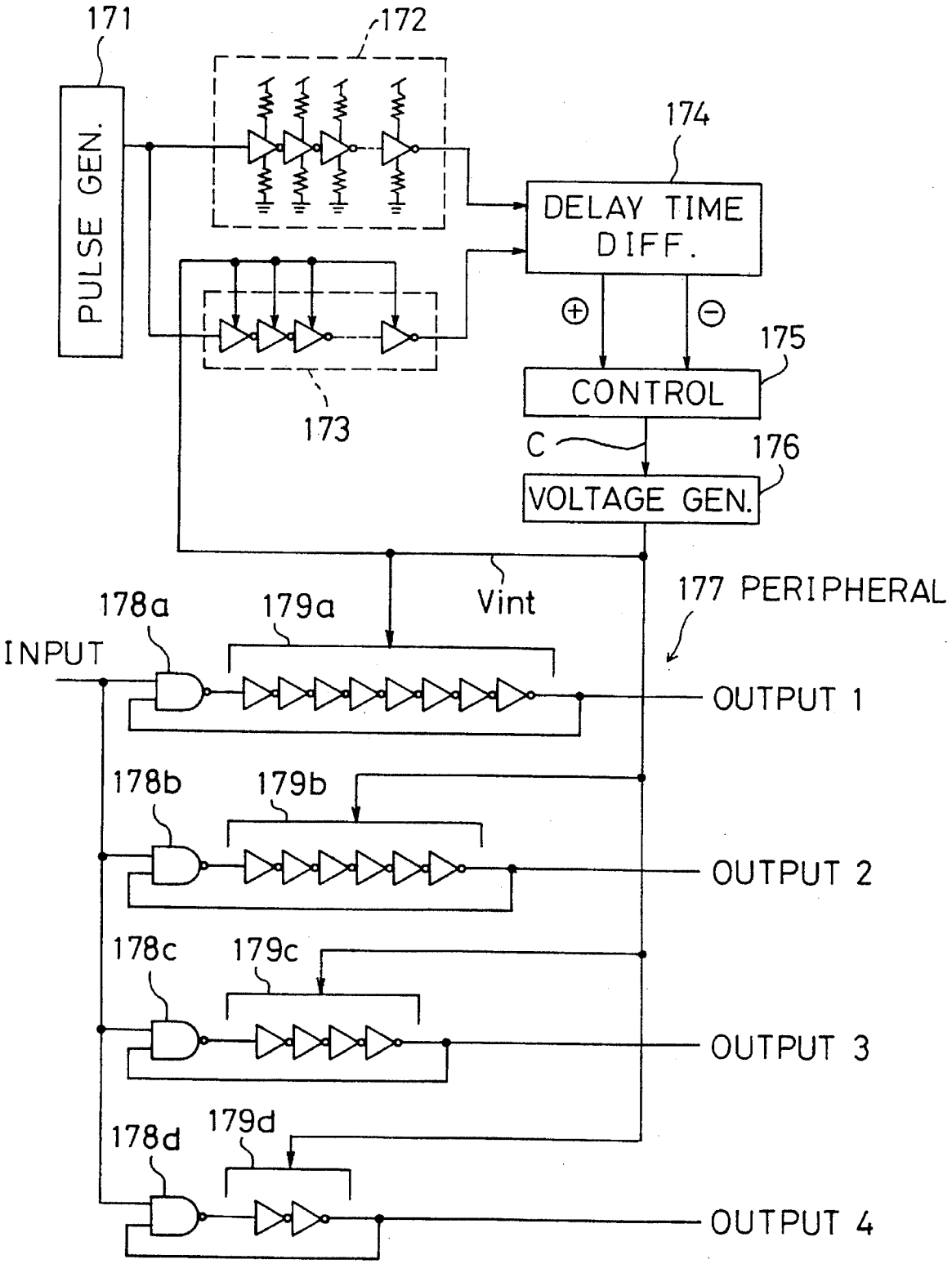
FIG. 37 is the circuit diagram of a fourth semiconductor integrated circuit arrangement according to the sixth embodiment of the present invention.

An arrangement in FIG. 37 is adapted to correct, according to temperature variations, delays of pulse signals in ring oscillators in a peripheral circuit block. In FIG. 37, there are disposed a pulse generating circuit block 171, a first delay circuit block 172, a second delay circuit block 173, a delay time difference detecting circuit block 174, a control circuit block 175, a constant voltage generating circuit block 176 and a peripheral circuit block 177, these circuit blocks respectively corresponding to the circuit blocks 101 to 107 in FIG. 26. In the semiconductor integrated circuit arrangement in FIG. 37, the peripheral circuit block 177 has first to fourth ring oscillators of four systems. An output voltage Vint of the constant voltage generating circuit block 176 is supplied, as a power supply voltage, to each of the second delay circuit block 173 and the ring oscillators.

The first to fourth ring oscillators respectively have two-input NAND circuits 178*a* to 178*d* and delay circuit parts 179*a* to 179*d* formed by normal inverter chains. The delay circuit parts 179*a* to 179*d* of the first to fourth ring oscillators are formed by inverters respectively arranged in 8 stages, 6 stages, 4 stages and 2 stages. That is, the delay circuit parts 179*a* to 179*d* respectively have delay times which are different from one another. An input pulse signal is supplied to the delay circuit parts 179*a* to 179*d* through the NAND circuits 178*a* to 178*d*. Outputs of the delay circuit parts 179*a* to 179*d* are feedbacked to the delay circuit parts 179*a* to 179*d* through the NAND circuits 178*a* to 178*d*. In the ring oscillators of the four systems having the arrangements above-mentioned, the frequencies of output pulse signals are equal to f, 4/3 f, 2 f and 4 f, respectively.

According to the arrangement shown in FIG. 37, the output voltage Vint of the constant voltage generating circuit block 176 is controlled according to temperature variations, the output voltage Vint being supplied, as a power supply voltage, to each of the four-system ring oscillators of the peripheral circuit block 177. It is therefore possible to correct the delay times in the delay circuit parts 179*a* to 179*d* forming the main portions of the ring oscillators. This reduces the output frequencies of the ring oscillators in temperature dependency, even though the ring oscillators use normal inverter chains.

(5) EXAMPLE 6.5

(Semiconductor Integrated Circuit Arrangement with Delay Time Correcting Circuit: Example of Application to DRAM)

Figure 38:
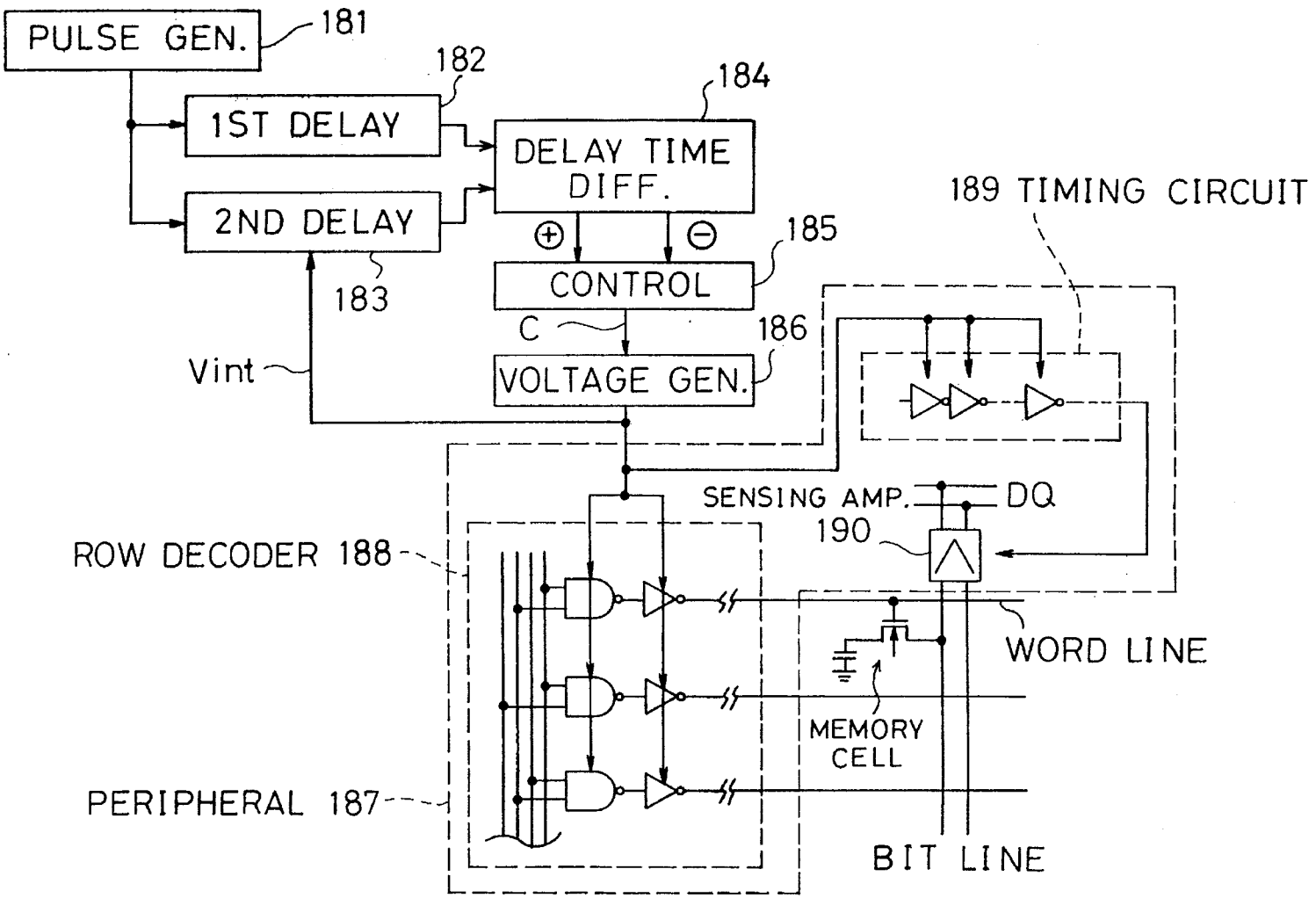
FIG. 38 is the circuit diagram of a fifth semiconductor integrated circuit arrangement according to the sixth embodiment of the present invention.

An arrangement in FIG. 38 is adapted to correct, according to temperature variations, delays of pulse signals in a row decoder and timing circuits in a DRAM. In FIG. 38, there are disposed a pulse generating circuit block 181, a first delay circuit block 182, a second delay circuit block 183, a delay time difference detecting circuit block 184, a control circuit block 185, a constant voltage generating circuit block 186 and a peripheral circuit block 187, these circuit blocks respectively corresponding to the circuit blocks 101 to 107 in FIG. 26. The semiconductor integrated circuit arrangement in FIG. 38 has memory cells disposed at positions where the word lines intersect the bit lines. The peripheral circuit block 187 has a row decoder 188, a timing circuit 189 and a sensing amplifier 190. The row decoder 188 has logical gates for selecting memory cells through a word line. The sensing amplifier 190 is adapted to amplify a small potential read out, to a bit line concerned, from one of the memory cells selected through the word line by the row decoder 188. The timing circuit 189 is adapted to adjust the timing at which an activating signal is supplied to the sensing amplifier 190, and comprises a normal inverter chain. An output voltage Vint of the constant voltage generating circuit block 186 is supplied, as a power supply voltage, to each of the second delay circuit block 183, the logical gates of the row decoder 188 and the inverters of the timing circuit 189.

According to the arrangement shown in FIG. 38, the delay characteristics of the row decoder 188 can be conformed to the delay characteristics of the word lines. The delay characteristics of the word lines present a CR-type small temperature dependency to be determined by the distribution constant of the word lines. Originally, the delay characteristics of the row decoder present a transistor-type great temperature dependency. Accordingly, it has been required to set the delay time in the timing circuit to a great value with the timing margin taken into consideration. This imposes restrictions on the memory-cell access speed. However, the arrangement in FIG. 38 so operates as to control the output voltage Vint of the constant voltage generating circuit block 186 in order to eliminate a difference in delay time between the first delay circuit block 182 formed by, for example, the conventional CR-type delay circuit block and the second delay circuit block 183 formed by logical gates likewise in the row decoder 188. Then, the output voltage Vint is supplied, as a power supply voltage, to the row decoder 188. Accordingly, the delay characteristics of the row decoder 188 are changed to the delay characteristics presenting a CR-type small temperature dependency as those of the word lines. Accordingly, even though the delay time in the timing circuit 189 is set to a small value, this does not interfere with the activating timing of the sensing amplifier 190, thus enabling the memory cells to be accessed at a high speed.

According to the arrangement in FIG. 38, the output voltage Vint of the constant voltage generating circuit block 186 is supplied, as a power supply voltage, to the timing circuit 189 in the peripheral circuit block 187. This reduces the temperature dependency of the delay characteristics of the timing circuit 189 formed by a normal inverter chain. Accordingly, the peripheral circuit block 187 can be reduced in layout area, yet assuring effects similar to those produced by an arrangement using the conventional CR delay circuit as the timing circuit.

It is noted that the delay time in the timing circuit 189 can be shortened even though the output voltage Vint of the constant voltage generating circuit block 186 is supplied, as a power supply voltage, only to the second delay circuit block 183 and the row decoder 188 in the peripheral circuit block 187. When the supply of the output voltage Vint of the delay time correcting circuit is limited to the row decoder 188, a high-speed access to memory cells can be assured, yet restraining an increase in electric current consumed in the semiconductor integrated circuit arrangement in its entirety.

(6) EXAMPLE 6.6

(Semiconductor Integrated Circuit Arrangement with Multiple Power Supplies)

Figure 39:
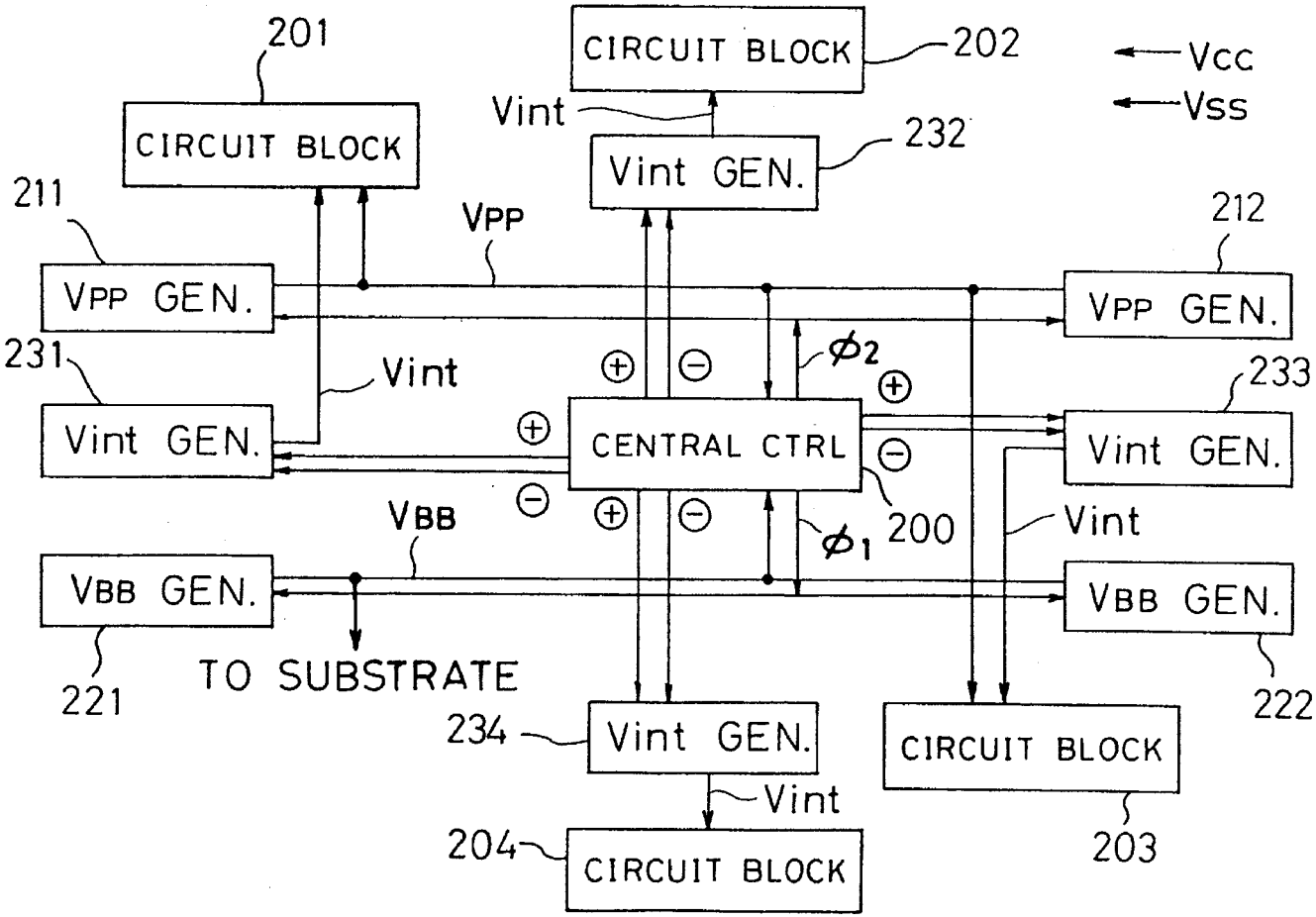
FIG. 39 is the circuit diagram of a sixth semiconductor integrated circuit arrangement according to the sixth embodiment of the present invention.
Figure 40:
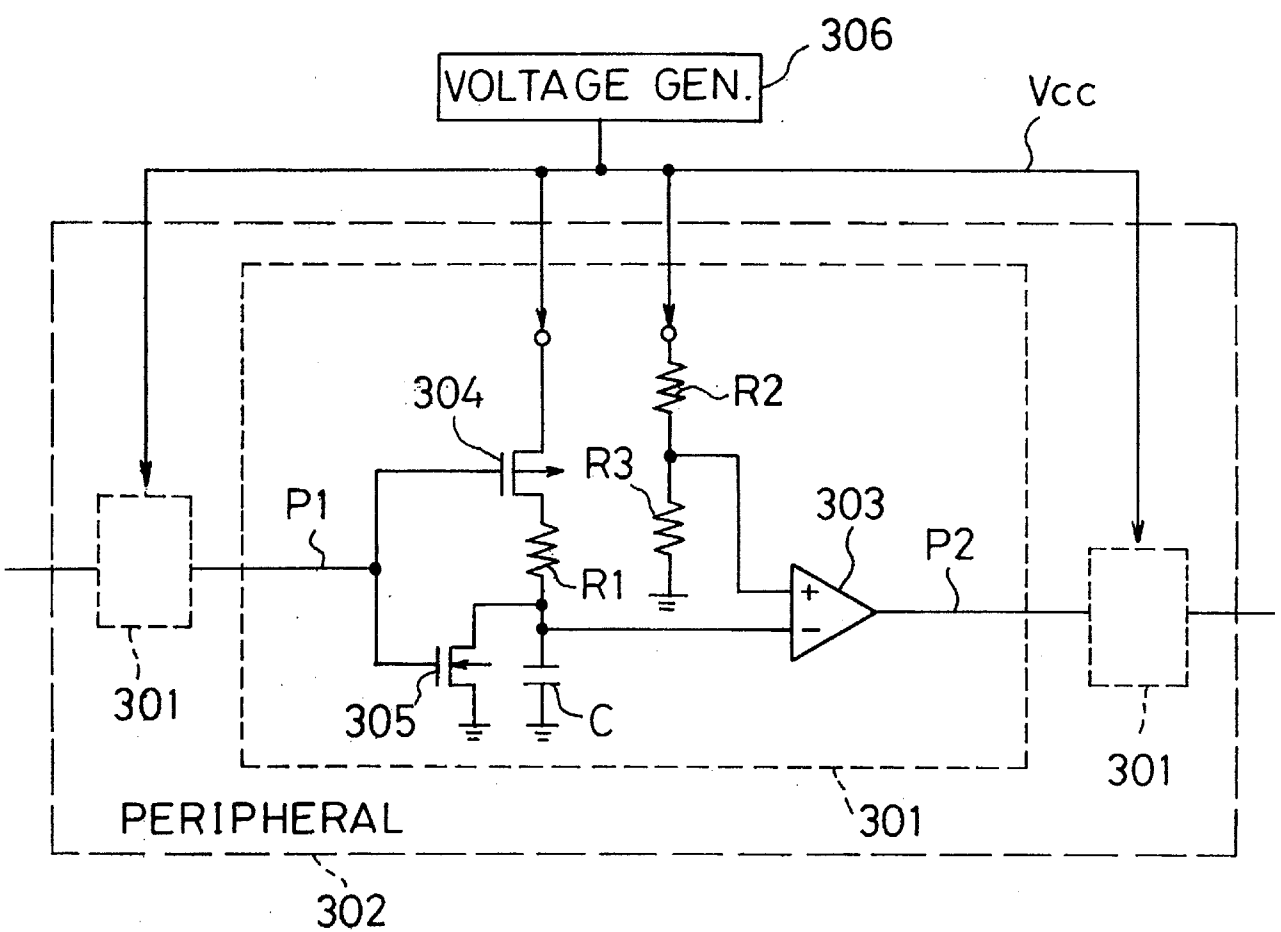
PRIOR ART FIG. 40
FIG. 40 is the circuit diagram of a semiconductor integrated circuit arrangement using conventional CR delay circuits.

FIG. 39 shows the arrangement of a semiconductor chip such as a DRAM or the like which internally requires power supplies respectively having different voltage levels. In FIG. 39, VPP generating circuits 211, 212 are adapted to generate, based on an externally supplied power voltage level VCC and the earth potential VSS, voltages of a word line increased voltage level VPP, which are then supplied to specific circuit blocks 201, 203 on a semiconductor substrate. VBB generating circuits 221, 222 are adapted to generate voltages of a substrate bias level VBB, which are then supplied to the semiconductor substrate. These VPP and VBB generating circuits 211, 212 and 221, 222 do not require considerably great output currents. Vint generating circuits 231 to 234 for generating an internal dropped voltage level Vint to be commonly supplied to all circuit blocks 201 to 204 on the semiconductor substrate, are disposed as distributed on the semiconductor substrate such that the circuits 231 to 234 are respectively located in the vicinity of the circuit blocks 201 to 204. Such a distributed layout is employed in order to lower output currents of the Vint generating circuits 231 to 234. Each of the Vint generating circuits 231 to 234 has the arrangement of the programmable constant voltage generating circuit (the arrangement in FIG. 12, or the arrangement of the circuit 82 or 85 in FIGS. 23 to 25).

A central control circuit 200 disposed substantially at the center of the semiconductor substrate, has the following three functions.

As a first function, the central control circuit 200 serves as a VPP level detecting circuit. The central control circuit 200 has the arrangement shown in FIG. 14 or 16 for monitoring the word line increased voltage level VPP. The central control circuit 200 is adapted to operate the VPP generating circuits 211, 212 by supplying an increased voltage level detection output $\phi 2$ when the word line increased level is lower than a predetermined level, and to stop the operations of the VPP generating circuits 211, 212 when the word line increased voltage level is sufficiently high.

As a second function, the central control circuit 200 serves as a VBB level detecting circuit. The central control circuit 200 has the arrangement shown in FIG. 13 or 15 for monitoring the substrate bias level VBB. The central control circuit 200 is adapted to control the operations of the VBB generating circuits 221, 222 by supplying a substrate level detection output $\phi 1$ according to the value of the substrate bias level VBB.

As a third function, the central control circuit 200 serves as the active voltage control circuit unit 95 in FIG. 25. More specifically, the central control circuit 200 has an arrangement including the pulse generating circuit 91, the first delay circuit 92, the second delay circuit 93 and the delay time difference detecting circuit 94 in FIG. 25. Two signal lines for respectively transmitting an accelerating signal and a restraining signal, are disposed between the central control circuit 200 and each of the plurality of the Vint generating circuits 231 to 234. Thus, when temperature rises, a signal for setting the internal dropped voltage level Vint to a value appropriate for such a temperature rise, is tansmitted, by a small number of signal lines, to the Vint generating circuits 231 to 234 disposed as distributed on the semiconductor substrate. Further, the central control circuit 200 can control outputs of the Vint generating circuits 231 to 234 based on the average temperature of the semiconductor substrate. Further, the signal lines for transmitting the accelerating and restraining signals can be shortened.

When the central control circuit 200 is disposed in the vicinity of the center of a heat generating part of the semiconductor substrate, temperature variations can be immediately reflected on outputs of the Vint generating circuits 231 to 234. The power supply lines of the respective voltage levels may or may not be connected to one another.

We claim:

1. A reference potential generating circuit in which a predetermined difference in potential is generated between an output node thereof and a first voltage supply line thereof, serving as a reference potential line, out of first and second voltage supply lines thereof across which a DC voltage is applied, so that a predetermined potential is generated at said output node, comprising:

resistance means interposed between said second voltage supply line and said output node;

feedback means having a MOS transistor of which gate is connected to said output node, and of which source is connected to said first voltage supply line; and diode means having a plurality of MOS transistors which are connected in series to one another, each of said plurality of MOS transistors having its gate connected to its drain, said plurality of MOS transistors interposed between the drain of said MOS transistor of said feedback means and said output node, wherein said difference in potential between said output node and first voltage supply line is determined according to the number of MOS transistors forming the diode means.

2. A reference potential generating circuit according to claim 1, wherein each of the MOS transistors of the feedback means and the diode means is an N-type MOS transistor, and the potential of the first voltage supply line is held as lower than that of the second voltage supply line.

3. A reference potential generating circuit according to claim 1, wherein each of the MOS transistors of the feedback means and the diode means is a P-type MOS transistor, and the potential of the first voltage supply line is held as higher than that of the second voltage supply line.

4. A reference potential generating circuit according to claim 1, wherein the resistance means is formed by the channel resistance of a further MOS transistor.

5. A reference potential generating circuit according to claim 1, wherein the resistance means is arranged such that the resistance value thereof is changed according to control signals.

6. A reference potential generating circuit according to claim 1, furhter comprising short-circuiting means for short-circuiting, according to control signals, at least one of the plurality of MOS transistors of the diode means, across the source and drain of said at least one MOS transistor.

7. A reference potential generating circuit according to claim 1, wherein the MOS transistors of the feedback means and of the diode means are arranged such that the total of the conductances of the plurality of MOS transistors of said diode means is substantially equal, under predetermined operational conditions, to the conductance of the MOS transistor of said feedback means.

8. A reference potential generating circuit according to claim 1, wherein the MOS transistors of the feedback means and of the diode means are arranged such that the ratio of W1/L1 to W2/L2 is substantially equal to N:1, wherein W1 and L1 are respectively the channel width and channel length of each of the plurality of MOS transistors of said diode means, N is the number of said plurality of MOS transistors connected in series to one another, and W2 and L2 are respectively the channel width and channel length of the MOS transistor of said feedback means.

9. A constant voltage generating circuit arrangement for holding the potential of an output line thereof at a predetermined value, comprising:

a reference potential generating circuit for generating a predetermined difference in potential between an output node thereof and a first voltage supply line thereof, serving as a reference potential line, out of first and second voltage supply lines thereof across which a DC voltage is applied;

a comparator circuit for comparing the potential of said output node of said reference potential generating circuit with the potential of said output line; and a driver circuit for driving said output line under control by an output of said comparator circuit;

said reference potential generating circuit comprising:

resistance means interposed between said second voltage supply line and said output node;

feedback means having a MOS transistor of which gate is connected to said output node and of which source is connected to said first voltage supply line; and diode means having a plurality of another MOS transistors which are connected in series to one another and which are interposed between the drain of said MOS transistor of said feedback means and said output node.

10. A constant voltage generating circuit arrangement according to claim 9, wherein the resistance means is arranged such that the resistance value thereof is changed according to control signals, and there is further disposed a control circuit for generating said control signals to be supplied to said resistance means, thereby to change the potential of the output line, said potential serving as a stabilized output voltage.

11. A constant voltage generating circuit arrangement according to claim 9, further comprising:

short-circuiting means for short-circuiting, according to control signals, at least one of the plurality of MOS transistors of the diode means, across the source and drain of said at least one MOS transistor; and a control circuit for generating said control signals to be supplied to said short-circuiting means, thereby to change the potential of the output line, said potential serving as a stabilized output voltage.

12. A constant voltage generating circuit arrangement for holding the potential of an output line thereof at a predetermined value, comprising:

a first reference potential generating circuit for generating a predetermined difference in potential between a first reference potential line thereof and a first node thereof;

a second reference potential generating circuit for generating a predetermined difference in potential between a second reference potential line thereof and a second node thereof;

a comparator circuit for comparing the potential of said first node with the potential of said second node; and a driver circuit for driving said output line under control by an output of said comparator circuit;

said output line being connected to said second reference potential generating circuit such that the potential of said output line is applied to said second reference potential line, wherein at least one of the first and second reference potential generating circuits is arranged such that a predetermined difference in potential is generated between an output node thereof serving as the first or second node and a first voltage supply line thereof, serving as the first or second reference potential line, out of first and second voltage supply lines thereof across which a DC voltage is applied, said at least one of the first and second reference potential generating circuits comprising:

resistance means interposed between said second voltage supply line and said output node;

feedback means having a MOS transistor of which gate is connected to said output node and of which source is connected to said first voltage supply line; and diode means having a plurality of another MOS transistors which are connected in series to one another and which are interposed between the drain of said MOS transistor of said feedback means and said output node.

13. A constant voltage generating circuit arrangement according to claim 12, wherein the resistance means is arranged such that the resistance value thereof is changed according to control signals, and there is further disposed a control circuit for generating said control signals to be supplied to said resistance means, thereby to change the potential of the output line, said potential serving as a stabilized output voltage.

14. A constant voltage generating circuit arrangement according to claim 12, further comprising:

short-circuiting means for short-circuiting, according to control signals, at least one of the plurality of MOS transistors of the diode means, across the source and drain of said at least one MOS transistor; and a control circuit for generating said control signals to be supplied to said short-circuiting means, thereby to change the potential of the output line, said potential serving as a stabilized output voltage.

15. A constant voltage generating circuit arrangement according to claim 12, wherein at least one of the first and second reference potential generating circuits is so arranged as to enable the potential of the output node to be changed according to control signals, and there is further disposed a control circuit for generating said control signals such that the potential of the output line, serving as a stabilized output voltage, is increased each time said control circuit receives an accelerating signal, and that said potential of said output line is decreased each time said control circuit receives a restraining signal.

16. A constant voltage generating circuit arrangement according to claim 12, further comprising a control circuit so arranged as to lower the amount of an electric current consumed in each of the first reference potential generating circuit, the second reference potential generating circuit and the comparator circuit when said control circuit receives a standby signal.

17. A constant voltage generating circuit arrangement according to claim 12, wherein at least one of the first and second reference potential generating circuits is so arranged as to enable the potential of the output node to be changed according to control signals;

there is further disposed a control circuit for generating said control signals such that the potential of the output line, serving as a stabilized output voltage, is set to a default value when said control circuit receives a reset signal.

18. A voltage level detecting circuit arrangement for judging the magnitude relation between the reference voltage level of a first line thereof and the voltage level to be measured of a second line thereof, comprising:

a first reference potential generating circuit for generating a predetermined difference in potential between said first line and a first node thereof;

a second reference potential generating circuit for generating a predetermined difference in potential between said second line and a second node thereof; and a comparator circuit for comparing the potential of said first node with the potential of said second node, at least one of the first and second reference potential generating circuits is so arranged as to enable the potential of the output node to be changed according to control signals; and wherein there is further disposed a control circuit for generating said control signals such that the potential of the output line serving as a stabilized output voltage, is set to a default value when said control circuit receives a reset signal, wherein each of the first and second reference potential generating circuits is arranged such that a predetermined difference in potential is generated between an output node thereof serving as the first or second node and a first voltage supply line thereof, serving as the first or second line, out of first and second voltage supply lines thereof across which a DC voltage is applied, each of said first and second reference potential generating circuits comprising:

resistance means interposed between said second voltage supply line and said output node;

feedback means having a MOS transistor of which gate is connected to said output node and of which source is connected to said first voltage supply line; and diode means having a plurality of another MOS transistors which are connected in series to one another and which are interposed between the drain of said MOS transistor of said feedback means and said output node.

19. A voltage level detecting circuit arrangement according to claim 18, wherein the resistance means in one of the first and second reference potential generating circuits is arranged such that the resistance value thereof is changed according to control signals; and there is further disposed a control circuit for generating said control signals according to an output of the comparator circuit, so that said voltage level detecting circuit arrangement is provided with hysteresis characteristics of voltage level detection.

20. A voltage level detecting circuit arrangement according to claim 18, further comprising:

short-circuiting means for short-circuiting, according to control signals, at least one of the plurality of MOS transistors of the diode means in one of the first and second reference potential generating circuits, across the source and drain of said at least one MOS transistor; and a control circuit for generating, according to an output of the comparator circuit, said control signals to be supplied to said short-circuiting means, so that said voltage level detecting circuit arrangement is provided with hysteresis characteristics of voltage level detection.

21. A temperature detecting circuit arrangement for judging whether or not ambient temperature has reached a predetermined temperature, comprising:

a first reference potential generating circuit for generating, between a first reference potential line thereof and a first node thereof, a difference in potential presenting a small temperature dependency due to reduction in the influence of variations of the threshold voltages of MOS transistors;

a second reference potential generating circuit for generating, between a second reference potential line thereof and a second node thereof, a difference in potential presenting a great temperature dependency resulting from variations of the threshold voltages of MOS transistors; and a comparator circuit for comparing the potential of said first node with the potential of said second node, said comparator circuit producing an output signal indicating that said ambient temperature reaches said predetermined temperature when said potential of said first node and said potential of said second node coincide.

22. A temperature detecting circuit arrangement according to claim 21, wherein:

the first reference potential generating circuit is so arranged as to generate a difference in potential presenting a small temperature dependency between the first node and a first voltage supply line thereof, serving as the first reference potential line, out of first and second voltage supply lines thereof across which a DC voltage is applied;

said first reference potential generating circuit comprising;

first resistance means interposed between said second voltage supply line and said first node, feedback means having a MOS transistor of which gate is connected to said first node and of which source is connected to said first voltage supply line, and first diode means having a plurality of another MOS transistors which are connected in series to one another and which are interposed between the drain of said MOS transistor of said feedback means and said first node; and the second reference potential generating circuit is so arranged as to generate a difference in potential presenting a great temperature dependency between the second node and a third voltage supply line thereof, serving as the second reference potential line, out of third and fourth voltage supply lines thereof across which a DC voltage is applied;

said second reference potential generating circuit comprising;

second resistance means interposed between said fourth voltage supply line and said second node, and second diode means having a plurality of another MOS transistors which are connected in series to one another and which have one end connected to said second node and the other end connected directly to said third voltage supply line.

23. A temperature detecting circuit arrangement according to claim 22, wherein at least one of the first and second resistance means is arranged such that the resistance value thereof is changed according to control signals; and there is further disposed a control circuit for generating said control signals according to an output of the comparator circuit, so that said temperature detecting circuit arrangement is provided with hysteresis characteristics of temperature detection.

24. A temperature detecting circuit arrangement according to claim 22, further comprising:

short-circuiting means for short-circuiting, according to control signals, at least one of the plurality of MOS transistors of each of the first and second diode means, across the source and drain of said at least one MOS transistor; and a control circuit for generating, according to an output of the comparator circuit, said control signals to be supplied to said short-circuiting means, so that said temperature detecting circuit arrangement is provided with hysteresis characteristics of temperature detection.

25. A power supply circuit arrangement for increasing the potential of an output line thereof according to a temperature rise, said potential serving as a stabilized output voltage adapted to be used as a power supply of each of logic circuits, thus maintaining a delay time in each of said logic circuits constant, comprising:

a temperature detecting circuit block for judging whether ambient temperature has reached a predetermined temperature and producing an output indicating that said predetermined temperature is achieved when a pair of reference potentials in said temperature detecting circuit block coincide; and a constant voltage generating circuit block for changing said potential of said output line according to said predetermined temperature detected by said temperature detecting circuit, thereby to increase said potential of said output line according to a temperature rise.

26. A power supply circuit arrangement according to claim 25, wherein the constant voltage generating circuit block comprises:

a reference potential generating circuit for generating a predetermined difference in potential between an output node thereof and a first voltage supply line thereof, serving as a reference potential line, out of first and second voltage supply lines thereof across which a DC voltage is applied;

a comparator circuit for comparing the potential of said output node of said reference potential generating circuit with the potential of the output line;

a driver circuit for driving said output line under control by an output of said comparator circuit; and a control circuit for supplying control signals to said reference potential generating circuit such that said potential of said output node of said reference potential generating circuit is changed to change said potential of said output line;

said reference potential generating circuit comprising:

resistance means interposed between said second voltage supply line and said output node;

feedback means having a MOS transistor of which gate is connected to said output node and of which source is connected to said first voltage supply line; and diode means having a plurality of another MOS transistors which are connected in series to one another and which are interposed between the drain of said MOS transistor of said feedback means and said output node;

said resistance means being arranged such that the resistance value thereof is changed according to said control signals supplied from said control circuit.

27. A power supply circuit arrangement according to claim 25, wherein the constant voltage generating circuit block comprises:

a reference potential generating circuit for generating a predetermined difference in potential between the output node and a first voltage supply line thereof, serving as a reference potential line, out of first and second voltage supply lines thereof across which a DC voltage is applied;

a comparator circuit for comparing the potential of said output node of said reference potential generating circuit with the potential of the output line;

a driver circuit for driving said output line under control by an output of said comparator circuit; and a control circuit for supplying control signals to said reference potential generating circuit such that said potential of said output node of said reference potential generating circuit is changed to change said potential of said output line;

said reference potential generating circuit comprising:

resistance means interposed between said second voltage supply line and said output node;

feedback means having a MOS transistor of which gate is connected to said output node and of which source is connected to said first voltage supply line;

diode means having a plurality of another MOS transistors which are connected in series to one another and which are interposed between the drain of said MOS transistor of said feedback means and said output node; and short-circuiting means for short-circuiting, according to said control signals supplied from said control circuit, at least one of said plurality of MOS transistors of said diode means, across the source and drain of said at least one MOS transistor.

28. A power supply circuit arrangement according to claim 25, wherein the constant voltage generating circuit block comprises:

a first reference potential generating circuit for generating a predetermined difference in potential between a first reference potential line thereof and a first node thereof;

a second reference potential generating circuit for generating a predetermined difference in potential between the output line serving as a second reference potential line and a second node thereof;

a capacitor element interposed between said output line and said second node;

a comparator circuit for comparing the potential of said first node with the potential of said second node;

a driver circuit for driving said output line under control by an output of said comparator circuit; and a control circuit for supplying control signals to at least one of said first and second-reference potential generating circuits such that the potential of said first or second node of said at least one reference potential generating circuit, is changed to change the potential of said output line;

at least one of said first and second reference potential generating circuits being arranged such that a predetermined difference in potential is generated between an output node thereof serving as said first or second node and a first voltage supply line thereof, serving as said first or second reference potential line, out of first and second voltage supply lines thereof across which a DC voltage is applied, said at least one reference potential generating circuit comprising:

resistance means interposed between said second voltage supply line and said output node;

feedback means having a MOS transistor of which gate is connected to said output node and of which source is connected to said first voltage supply line; and diode means having a plurality of another MOS transistors which are connected in series to one another and which are interposed between the drain of said MOS transistor of said feedback means and said output node;

said resistance means being arranged such that the resistance value thereof is changed according to said control signals supplied from said control circuit.

29. A power supply circuit arrangement according to claim 25, wherein the constant voltage generating circuit block comprises:

a first reference potential generating circuit for generating a predetermined difference in potential between a first reference potential line thereof and a first node thereof;

a second reference potential generating circuit for generating a predetermined difference in potential between the output line serving as a second reference potential line thereof and a second node thereof;

a capacitor element interposed between said output line and said second node;

a comparator circuit for comparing the potential of said first node with the potential of said second node;

a driver circuit for driving said output line under control by an output of said comparator circuit; and a control circuit for supplying control signals to at least one of said first and second reference potential generating circuits such that the potential of said first or second node of said at least one reference potential generating circuit, is changed to change the potential of said output line;

at least one of said first and second reference potential generating circuits being arranged such that a predetermined difference in potential is generated between an output node thereof serving as said first or second node and a first voltage supply line thereof, serving as said first or second reference potential line, out of first and second voltage supply lines thereof across which a DC voltage is applied, said at least one reference potential generating circuit comprising:

resistance means interposed between said second voltage supply line and said output node;

feedback means having a MOS transistor of which gate is connected to said output node and of which source is connected to said first voltage supply line;

diode means having a plurality of another MOS transistors which are connected in series to one another and which are interposed between the drain of said MOS transistor of said feedback means and said output node; and short-circuiting means for short-circuiting, according to said control signals supplied from said control circuit, at least one of said plurality of MOS transistors of said diode means, across the source and drain of said at least one MOS transistor.

30. A power supply circuit arrangement according to claim 25, wherein the temperature detecting circuit block comprises:

a first reference potential generating circuit for generating a difference in potential presenting a small temperature dependency between a first reference potential line thereof and a first node thereof;

a second reference potential generating circuit for generating a difference in potential presenting a great temperature dependency between a second reference potential line thereof and a second node thereof; and a comparator circuit for comparing the potential of said first node with the potential of said second node to make a judgement on whether or not temperature to be detected has reached a predetermined temperature, said comparator circuit being adapted to control the operation of the constant voltage generating circuit block according to the result of said judgment;

said first reference potential generating circuit being so arranged as to generate a difference in potential presenting a small temperature dependency between said first node and a first voltage supply line thereof, serving as said first reference potential line, out of first and second voltage supply lines thereof across which a DC voltage is applied;

said first reference potential generating circuit comprising:

first resistance means interposed between said second voltage supply line and said first node;

feedback means having a MOS transistor of which gate is connected to said first node and of which source is connected to said first voltage supply line; and first diode means having a plurality of another MOS transistors which are connected in series to one another and which are interposed between the drain of said MOS transistor of said feedback means and said first node; and said second reference potential generating circuit being so arranged as to generate a difference in potential presenting a great temperature dependency between said second node and a third voltage supply line thereof, serving as said second reference potenetial line, out of third and fourth voltage supply lines thereof across which a DC voltage is applied;

said second reference potential generating circuit comprising:

second resistance means interposed between said fourth voltage supply line and said second node; and second diode means having a plurality of another MOS transistors which are connected in series to one another and which have one end connected to said second node and the other end connected directly to said third voltage supply line.

31. A power supply circuit arrangement for increasing the potential of an output line thereof according to a temperature rise, said potential serving as a stabilized output voltage adapted to be used as a power supply of each of logic circuits, thus maintaining a delay time in each of said logic circuits constant, comprising:

a first delay circuit in which the delay time of a pulse signal presents a small temperature dependency;

a second delay circuit having a logic circuit part, as a temperature monitor, set such that the delay time of a pulse signal at a reference temperature is identical with said delay time in said first delay circuit;

a delay time difference detecting circuit for detecting a difference in delay time between said first and second delay circuits; and a constant voltage generating circuit block for changing said potential of said output line according to an output of said delay time difference detecting circuit such that said potential of said output line is increased when said delay time in said second delay circuit is greater than that in said first delay circuit, and that said potential of said output line is decreased when said delay time in said second delay circuit is smaller than that in said first delay circuit;

a stabilized output voltage supplied from said constant voltage generating circuit block to said output line being supplied, as a power supply, to said second delay circuit.

32. A power supply circuit arrangement according to claim 31, wherein the first delay circuit is so arranged as to utilize time constant to be determined by a resistance element and a capacitor element.

33. A power supply circuit arrangement according to claim 31, wherein the delay time difference detecting circuit has a function of supplying an accelerating signal when the delay time in the second delay circuit is greater than that in the first delay circuit, and of supplying a restraining signal when said delay time in said second delay circuit is smaller than that in said first delay circuit, said accelerating and restraining signals bieng supplied as control signals according to a difference in delay time between said first and second delay circuits, and the constant voltage generating circuit block has a function of increasing the potential of the output line each time said constant voltage generating circuit block receives said accelerating signal from said delay time difference detecting circuit, and of decreasing said potential of said output line each time said constant voltage generating circuit block receives said restraining signal from said delay time difference detecting circuit.

34. A power supply circuit arrangement according to claim 31, wherein the constant voltage generating circuit block comprises:

a reference potential generating circuit for generating a predetermined difference in potential between an output node thereof and a first voltage supply line thereof, serving as a reference potential line, out of first and second voltage supply lines thereof across which a DC voltage is applied;

a comparator circuit for comparing the potential of said output node of said reference potential generating circuit with the potential of the output line;

a driver circuit for driving said output line under control by an output of said comparator circuit; and a control circuit for supplying control signals to said reference potential generating circuit such that said potential of said output node of said reference potential generating circuit is changed to change said potential of said output line;

said reference potential generating circuit comprising:

resistance means interposed between said second voltage supply line and said output node;

feedback means having a MOS transistor of which gate is connected to said output node and of which source is connected to said first voltage supply line; and diode means having a plurality of another MOS transistors which are connected in series to one another and which are interposed between the drain of said MOS transistor of said feedback means and said output node;

said resistance means being arranged such that the resistance value thereof is changed according to said control signals supplied from said control circuit.

35. A power supply circuit arrangement according to claim 31, wherein the constant voltage generating circuit block comprises:

a reference potential generating circuit for generating a predetermined difference in potential between an output node thereof and a first voltage supply line thereof, serving as a reference potential line, out of first and second voltage supply lines thereof across which a DC voltage is applied;

a comparator circuit for comparing the potential of said output node of said reference potential generating circuit with the potential of the output line;

a driver circuit for driving said output line under control by an output of said comparator circuit; and a control circuit for supplying control signals to said reference potential generating circuit such that said potential of said output node of said reference potential generating circuit is changed to change said potential of said output line;

said reference potential generating circuit comprising:

resistance means interposed between said second voltage supply line and said output node;

feedback means having a MOS transistor of which gate is connected to said output node and of which source is connected to said first voltage supply line;

diode means having a plurality of another MOS transistors which are connected in series to one another and which are interposed between the drain of said MOS transistor of said feedback means and said output node; and short-circuiting means for short-circuiting, according to said control signals supplied from said control circuit, at least one of said plurality of MOS transistors of said diode means, across the source and drain of said at least one MOS transistor.

36. A power supply circuit arrangement according to claim 31, wherein the constant voltage generating circuit block comprises:

a first reference potential generating circuit for generating a predetermined difference in potential between a first reference potential line thereof and a first node thereof;

a second reference potential generating circuit for generating a predetermined difference in potential between the output line serving as a second reference potential line thereof and a second node thereof;

a capacitor element interposed between said output line and said second node;

a comparator circuit for comparing the potential of said first node with the potential of said second node;

a driver circuit for driving said output line under control by an output of said comparator circuit; and a control circuit for supplying control signals to at least one of said first and second reference potential generating circuits such that the potential of said first or second node of said at least one reference potential generating circuit, is changed to change the potential of said output line;

at least one of said first and second reference potential generating circuits being arranged such that a predetermined difference in potential is generated between an output node thereof serving as said first or second node and a first voltage supply line thereof, serving as said first or second reference potential line, out of first and second voltage supply lines thereof across which a DC voltage is applied;

said at least one reference potential generating circuit comprising:

resistance means interposed between said second voltage supply line and said output node;

feedback means having a MOS transistor of which gate is connected to said output node and of which source is connected to said first voltage supply line; and diode means having a plurality of another MOS transistors which are connected in series to one another and which are interposed between the drain of said MOS transistor of said feedback means and said output node;

said resistance means being arranged such that the resistance value thereof is changed according to said control signals supplied from said control circuit.

37. A power supply circuit arrangement according to claim 31, wherein the constant voltage generating circuit block comprises:

a first reference potential generating circuit for generating a predetermined difference in potential between a first reference potential line thereof and a first node thereof;

a second reference potential generating circuit for generating a predetermined difference in potential between the output line serving as a second reference potential line thereof and a second node thereof;

a capacitor element interposed between said output line and said second node;

a comparator circuit for comparing the potential of said first node with the potential of said second node;

a driver circuit for driving said output line under control by an output of said comparator circuit; and a control circuit for supplying control signals to at least one of said first and second reference potential generating circuits such that the potential of said first or second node of said at least one reference potential generating circuit, is changed to change the potential of said output line;

at least one of said first and second reference potential generating circuits being arranged such that a predetermined difference in potential is generated between an output node thereof serving as said first or second node and a first voltage supply line thereof, serving as said first or second reference potential line, out of first and second voltage supply lines thereof across which a DC voltage is applied, said at least one reference potential generating circuit comprising:

resistance means interposed between said second voltage supply line and said output node;

feedback means having a MOS transistor of which gate is connected to said output node and of which source is connected to said first voltage supply line;

diode means having a plurality of another MOS transistors which are connected in series to one another and which are interposed between the drain of said MOS transistor of said feedback means and said output node; and short-circuiting means for short-circuiting, according to said control signals supplied from said control circuit, at least one of said plurality of MOS transistors of said diode means, across the source and drain of said at least one MOS transistor.

38. A semiconductor integrated circuit arrangement comprising a peripheral circuit block and a delay time correcting circuit block for correcting a delay time in said peripheral circuit block, said delay time correcting circuit block comprising:

a first delay circuit for delaying a pulse signal;

a second delay circuit having a logic circuit part for delaying a pulse signal identical with a pulse signal supplied to said first delay circuit, said logic circuit part presenting a delay-time temperature dependency which is identical with that of said peripheral circuit block and which is different from that of said first delay circuit, said second delay circuit being arranged such that the delay time of said pulse signal at a reference temperature is equal to that in said first delay circuit;

a constant voltage generating circuit unit for holding, at a fixed value, the potential of an output line thereof to be used as a line for supplying a stabilized power supply voltage to each of said second delay circuit and said peripheral circuit block, said fixed value being variable according to control signals;

a delay time difference detecting circuit unit adapted to supply an accelerating signal when said delay time in said second delay circuit is greater than that in said first delay circuit, and to supply a restraining signal when said delay time in said second delay circuit is smaller than that in said first delay circuit, said accelerating and restraining signals being supplied as control signals according to output signals of said first and second delay circuits; and a control circuit adapted to supply control signals to said constant voltage generating circuit unit such that said potential of said output line is increased each time said control circuit receives said accelerating signal from said delay time difference detecting circuit unit, and that said potential of said output line is decreased each time said control circuit receives said restraining signal from said delay time difference detecting circuit unit.

39. A semiconductor integrated circuit arrangement according to claim 38, wherein the delay time correcting circuit block further comprises a pulse generating circuit for supplying a common pulse signal to the first and second delay circuits.

40. A semiconductor integrated circuit arrangement according to claim 38, wherein the delay time difference detecting circuit unit has a circuit for supplying first and second detection signals as the accelerating and restraining signals, said first and second detection signals having pulses to be simultaneously changed in state from LOW to HIGH or from HIGH to LOW and being arranged such that the pulse width of said second detection signal is greater than that of said first detection signal when the delay time in the second delay circuit is greater than that in the first delay circuit, and that said pulse width of said second detection signal is smaller than that of said first detection signal when the delay time in said second delay circuit is smaller than that in said first delay circuit.

41. A semiconductor integrated circuit arrangement according to claim 40, wherein the control circuit has a circuit part for supplying a plurality of logical signals as the control signals, the number of logical signals having a predetermined logical level, out of said plurality of logical signals, being changed according to a difference in pulse width between the first and second detection signals supplied from the delay time difference detecting circuit unit.

42. A semiconductor integrated circuit arrangement according to claim 41, wherein the constant voltage generating circuit unit comprises:

a reference potential generating circuit for generating a predetermined difference in potential between an output node thereof and a first voltage supply line thereof, serving as a reference potential line, out of first and second voltage supply lines thereof across which a DC voltage is applied;

a comparator circuit for comparing the potential of said output node of said reference potential generating circuit with the potential of the output line of said constant voltage generating circuit unit; and a driver circuit for driving said output line under control by an output of said comparator circuit;

said reference potential generating circuit comprising:

resistance means interposed between said second voltage supply line and said output node such that the resistance value thereof is changed according to the number of logical signals having the predetermined logical level, out of the plurality of logical signals supplied as the control signals from the control circuit;

feedback means having a MOS transistor of which gate is connected to said output node and of which source is connected to said first voltage supply line; and diode means having a plurality of another MOS transistors which are connected in series to one another and which are interposed between the drain of said MOS transistor of said feedback means and said output node.

43. A semiconductor integrated circuit arrangement according to claim 38, wherein the second delay circuit has a circuit part for supplying (i) a first output signal of which phase is delayed with respect to the phase of a reference signal of which delay time at a reference temperature is identical with that of an output signal of the first delay circuit, and (ii) a second output signal of which phase is advanced with respect to said phase of said reference signal, the delay time difference detecting circuit unit has a circuit for supplying a first detection signal representing the presence or absence of a difference in delay time between said first and second delay circuits and for supplying a second detection signal representing which delay time is greater, out of the delay times in said first and second delay circuits, said first and second detection signals being respectively supplied as the accelerating and restraining signals according to the input timings of said first and second output signals of said second delay circuit with respect to the input timing of an output signal of said first delay circuit, and said delay time difference detecting circuit unit is adapted to supply said first detection signal representing the presence of a difference in delay time and said second detection signal having a first logical level when the delay time in said second delay circuit is greater than that in said first delay circuit, and to supply said first detection signal representing the presence of a difference in delay time and said second detection signal having a second logical level when said delay time in said second delay circuit is smaller than that in said first delay circuit.

44. A semiconductor integrated circuit arrangement according to claim 43, wherein the delay time difference detecting circuit unit comprises:

a logical sum circuit adapted to receive, as input signals, the output signal of the first delay circuit and the first and second output signals of the second delay circuit;

a first latch circuit for latching an output signal of said logical sum circuit, thereby to supply the first detection signal; and a second latch circuit for latching said output signal of said first delay circuit at the output timing at which said first detection signal is supplied from said first latch circuit, thereby to supply the second detection signal.

45. A semiconductor integrated circuit arrangement according to claim 38, wherein the delay time difference detecting circuit unit has a circuit for supplying a first detection signal representing which delay time is greater, out of the delay times in the first and second delay circuits, and for supplying a second detection signal representing the presence or absence of a difference in delay time between said first and second delay circuits, said first and second detection signals being respectively supplied as the accelerating and restraining signals according to the input timing of an output signal of said second delay circuit with respect to the input timing of an output signal of said first delay circuit, and said delay time difference detecting circuit unit is adapted to supply said first detection signal having a first logical level and said second detection signal representing the presence of a difference in delay time between said first and second delay circuits when the delay time in said second delay circuit is greater than that in said first delay circuit, and to supply said first detection signal having a second logical level and said second detection signal representing the presence of a difference in delay time between said first and second delay circuits when the delay time in said second delay circuit is smaller than that in said first delay circuit.

46. A semiconductor integrated circuit arrangement according to claim 45, wherein the delay time difference detecting circuit unit comprises:

a flip-flop for amplifying a difference in potential between output signals of the first and second delay circuits, thereby to supply the first detection signal; and a monostable multivibrator adapted to be triggered by transition of one of said output signals of said first and second delay circuits, thereby to supply the second detection signal having a predetermined pulse width.

47. A semiconductor integrated circuit arrangement according to claim 38, wherein the peripheral circuit block has a row decoder for selecting memory cells through word lines, and the output line of the constant voltage generating circuit unit is used as a line for supplying a power supply voltage to each of the second delay circuit and said row decoder.

48. A semiconductor integrated circuit arrangement comprising:

a substrate potential generating circuit block for generating, from a DC voltage externally applied through first and second voltage supply lines thereof, a substrate potential to be applied to a semiconductor substrate; and a substrate potential controlling circuit block for controlling the operation of said substrate potential generating circuit block according to said substrate potential generated thereby such that said substrate potential is held at a predetermined value;

said substrate potential controlling circuit block comprising:

a first reference potential generating circuit for generating a predetermined difference in potential between a first node thereof and a first potential line out of first and second potential lines thereof, one of said first and second voltage supply lines serving as said first potential line, and the other serving as said second potential line;

a second reference potential generating circuit for generating a predetermined difference in potential between said semiconductor substrate and a second node thereof; and a comparator circuit for comparing the potential of said first node with the potential of said second node and adapted to control the operation of said substrate potential generating circuit block according to the result of comparison;

said first reference potential generating circuit comprising:

first resistance means interposed between said second potential line and said first node;

first feedback means having a MOS transistor of which gate is connected to said first node and of which source is connected to said first potential line; and first diode means having a plurality of another MOS transistors which are connected in series to one another and which are interposed between the drain of said MOS transistor of said first feedback means and said first node;

said second reference potential generating circuit comprising:

second resistance means interposed between one of said first and second voltage supply lines and said second node;

second feedback means having a further MOS transistor having the gate connected to said second node and the source to which said substrate potential is applied; and second diode means having a plurality of still another MOS transistors which are connected in series to one another and which are interposed between the drain of said MOS transistor of said second feedback means and said second node.

49. A semiconductor integrated circuit arrangement comprising:

a specific potential generating circuit block for generating, from a DC voltage externally applied through first and second voltage supply lines thereof, a specific potential on a specific potential line thereof, said specific potential being adapted to be applied to a specific circuit block on a semiconductor substrate; and a specific potential controlling circuit block for controlling the operation of said specific potential generating circuit block according to said specific potential generated on said specific potential line by said specific potential generating circuit block, such that said specific potential is held at a predetermined value;

said specific potential controlling circuit block comprising:

a first reference potential generating circuit for generating a predetermined difference in potential between a first node thereof and a first potential line out of first and second potential lines thereof, one of said first and second voltage supply lines serving as said first potential line, and the other serving as said second potential line;

a second reference potential generating circuit for generating a predetermined difference in potential between said specific potential line and a second node thereof; and a comparator circuit for comparing the potential of said first node with the potential of said second node and adapted to control the operation of said specific potential generating circuit block according to the result of comparison;

said first reference potential generating circuit comprising:

first resistance means interposed between said second potential line and said first node;

first feedback means having a MOS transistor of which gate is connected to said first node and of which source is connected to said first potential line; and first diode means having a plurality of another MOS transistors which are connected in series to one another and which are interposed between the drain of said MOS transistor of said first feedback means and said first node;

said second reference potential generating circuit comprising:

second resistance means interposed between one of said first and second voltage supply lines and said second node;

second feedback means having a further MOS transistor of which gate is connected to said second node and of which source is connected to said specific potential line; and second diode means having a plurality of still another MOS transistors which are connected in series to one another and which are interposed between the drain of said MOS transistor of said second feedback means and said second node.

50. A semiconductor integrated circuit arrangement for increasing, according to a temperature rise, a potential serving as a stabilized output voltage to be used, as a common power supply, in each of a plurality of circuit blocks formed by logic circuits on a semiconductor substrate, thereby to maintain a delay time in each of said plurality of circuit blocks constant, comprising:

a first delay circuit in which the delay time of a pulse signal presents a small temperature dependency;

a second delay circuit having a logic circuit part, serving as a temperature monitor, set such that the delay time of a pulse signal at a reference temperature is equal to that in said first delay circuit;

a delay time difference detecting circuit adapted to supply an accelerating signal when the delay time in said second delay circuit is greater than that in said first delay circuit, and to supply a restraining signal when said delay time in said second delay circuit is smaller than that in said first delay circuit, said accelerating and restraining signals being supplied as control signals according to a difference in delay time between said first and second delay circuits; and a constant voltage generating circuit block adapted to increase the potential of an output line thereof each time said constant voltage generating circuit block receives said accelerating signal from said delay time difference detecting circuit, and to decrease said potential of said output line each time said constant voltage generating circuit block receives said restraining signal from said delay time difference detecting circuit;

a stabilized output voltage supplied from said constant voltage generating circuit block to said output line, being supplied as a power supply to said second delay circuit.

51. A semiconductor integrated circuit arrangement according to claim 50, wherein the constant voltage generating circuit block comprises:

a reference potential generating circuit for generating a predetermined difference in potential between an output node thereof and a first voltage supply line thereof, serving as a reference potential line, out of first and second voltage supply lines thereof across which a DC voltage is applied;

a comparator circuit for comparing the potential of said output node of said reference potential generating circuit with the potential of the output line;

a driver circuit for driving said output line under control by an output of said comparator circuit; and a control circuit for supplying control signals to said reference potential generating circuit such that said potential of said output node of said reference potential generating circuit is changed to change said potential of said output line;

said reference potential generating circuit comprising:

resistance means interposed between said second voltage supply line and said output node;

feedback means having a MOS transistor of which gate is connected to said output node and of which source is connected to said first voltage supply line; and diode means having a plurality of another MOS transistors which are connected in series to one another and which are interposed between the drain of said MOS transistor of said feedback means and said output node, said resistance means being arranged such that the resistance value thereof is changed according to said control signals supplied from said control circuit.

52. A semiconductor integrated circuit arrangement according to claim 50, wherein the constant voltage generating circuit block comprises:

a reference potential generating circuit for generating a predetermined difference in potential between an output node thereof and a first voltage supply line thereof, serving as a reference potential line, out of first and second voltage supply lines thereof across which a DC voltage is applied;

a comparator circuit for comparing the potential of said output node of said reference potential generating circuit with the potential of the output line;

a driver circuit for driving said output line under control by an output of said comparator circuit; and a control circuit for supplying control signals to said reference potential generating circuit such that said potential of said output node of said reference potential generating circuit is changed to change said potential of said output line;

said reference potential generating circuit comprising:

resistance means interposed between said second voltage supply line and said output node;

feedback means having a MOS transistor of which gate is connected to said output node and of which source is connected to said first voltage supply line;

diode means having a plurality of another MOS transistors which are connected in series to one another and which are interposed between the drain of said MOS transistor of said feedback means and said output node; and short-circuiting means for short-circuiting, according to said control signals supplied from said control circuit, at least one of said plurality of MOS transistors of said diode means, across the source and drain of said at least one MOS transistor.

53. A semiconductor integrated circuit arrangement according to claim 50, wherein the constant voltage generating circuit block comprises:

a first reference potential generating circuit for generating a predetermined difference in potential between a first reference potential line thereof and a first node thereof;

a second reference potential generating circuit for generating a predetermined difference in potential between the output line serving as a second reference potential line thereof and a second node thereof;

a capacitor element interposed between said output line and said second node;

a comparator circuit for comparing the potential of said first node with the potential of said second node;

a driver circuit for driving said output line under control by an output of said comparator circuit; and a control circuit for supplying control signals to at least one of said first and second reference potential generating circuits such that the potential of said first or second node of said at least one reference potential generating circuit, is changed to change the potential of said output line;

at least one of said first and second reference potential generating circuits being arranged such that a predetermined difference in potential is generated between an output node thereof serving as said first or second node and a first voltage supply line thereof, serving as said first or second reference potential line, out of first and second voltage supply lines thereof across which a DC voltage is applied, said at least one reference potential generating circuit comprising:

resistance means interposed between said second voltage supply line and said output node;

feedback means having a MOS transistor of which gate is connected to said output node and of which source is connected to said first voltage supply line; and diode means having a plurality of another MOS transistors which are connected in series to one another and which are interposed between the drain of said MOS transistor of said feedback means and said output node;

said resistance means being arranged such that the resistance value thereof is changed according to said control signals supplied from said control circuit.

54. A semiconductor integrated circuit arrangement according to claim 50, wherein the constant voltage generating circuit block comprises:

a first reference potential generating circuit for generating a predetermined difference in potential between a first reference potential line thereof and a first node thereof;

a second reference potential generating circuit for generating a predetermined difference in potential between the output line serving as a second reference potential line thereof and a second node thereof;

a capacitor element interposed between said output line and said second node;

a comparator circuit for comparing the potential of said first node with the potential of said second node;

a driver circuit for driving said output line under control by an output of said comparator circuit; and a control circuit for supplying control signals to at least one of said first and second reference potential generating circuits such that the potential of said first or second node of said at least one reference potential generating circuit, is changed to change the potential of said output line;

at least one of said first and second reference potential generating circuits being arranged such that a predetermined difference in potential is generated between an output node thereof serving as said first or second node and a first voltage supply line thereof, serving as said first or second reference potential line, out of first and second voltage supply lines thereof across which a DC voltage is applied, said at least one reference potential generating circuit comprising:

resistance means interposed between said second voltage supply line and said output node;

feedback means having a MOS transistor of which gate is connected to said output node and of which source is connected to said first voltage supply line;

diode means having a plurality of another MOS transistors which are connected in series to one another and which are interposed between the drain of said MOS transistor of said feedback means and said output node; and short-circuiting means for short-circuiting, according to said control signals supplied from said control circuit, at least one of said plurality of MOS transistors of said diode means, across the source and drain of said at least one MOS transistor.

55. A semiconductor integrated circuit arrangement according to claim 50, wherein each of the first delay circuit, the second delay circuit and the delay time difference detecting circuit is disposed, in the single number, on the semiconductor substrate, the constant voltage generating circuit block is disposed on said semiconductor substrate at each of a plurality of distributed positions thereof in the vicinity of each of the plurality of circuit blocks, and two signal lines for respectively transmitting the accelerating and restraining signals are disposed between each of the plurality of constant voltage generating circuit blocks and said delay time difference detecting circuit.

56. A semiconductor integrated circuit arrangement according to claim 55, wherein the first and second delay circuits are disposed substantially at the center of the semiconductor substrate.

57. A semiconductor integrated circuit arrangement according to claim 55, wherein the first and second delay circuits are disposed on the semiconductor substrate in the vicinity of the center of a heat generating part thereof.

* * * * *